US010008167B2

(12) United States Patent
Yamazaki et al.

(10) Patent No.: US 10,008,167 B2
(45) Date of Patent: Jun. 26, 2018

(54) SEMICONDUCTOR DEVICE, METHOD FOR DRIVING SEMICONDUCTOR DEVICE, AND PROGRAM

(71) Applicant: Semiconductor Energy Laboratory Co., Ltd., Atsugi-shi, Kanagawa-ken (JP)

(72) Inventors: Shunpei Yamazaki, Setagaya (JP); Hiroyuki Miyake, Tochigi (JP); Yoshiharu Hirakata, Ebina (JP)

(73) Assignee: Semiconductor Energy Laboratory Co., Ltd., Kanagawa-ken (JP)

( * ) Notice: Subject to any disclaimer, the term of this patent is extended or adjusted under 35 U.S.C. 154(b) by 0 days. days.

(21) Appl. No.: 15/053,557

(22) Filed: Feb. 25, 2016

(65) Prior Publication Data

US 2016/0260400 A1 Sep. 8, 2016

(30) Foreign Application Priority Data

Mar. 3, 2015 (JP) ..... 2015-040985
Mar. 3, 2015 (JP) ..... 2015-040987

(51) Int. Cl.
*G09G 3/36* (2006.01)
*G09G 3/34* (2006.01)

(52) U.S. Cl.
CPC ..... *G09G 3/3648* (2013.01); *G09G 3/3406* (2013.01); *G09G 2320/0686* (2013.01); *G09G 2354/00* (2013.01)

(58) Field of Classification Search
CPC ... G09G 2320/0606; G09G 2320/0626; G09G 2320/0646; G09G 2320/066;
(Continued)

(56) References Cited

U.S. PATENT DOCUMENTS

2004/0252084 A1* 12/2004 Miyagawa ..... G09G 3/3266 345/76
2008/0192158 A1* 8/2008 Yoshihara ..... G02F 1/13471 349/33

(Continued)

FOREIGN PATENT DOCUMENTS

JP 2014-115641 6/2014

OTHER PUBLICATIONS

Shimada Nobuhiro, JP 2005049631 A with translated Abstract, Feb. 24, 2005.*

(Continued)

*Primary Examiner* — Dmitriy Bolotin
(74) *Attorney, Agent, or Firm* — Robinson Intellectual Property Law Office; Eric J. Robinson

(57) ABSTRACT

To reduce eye fatigue of a user and perform eye-friendly display. An information processing device provided with a display portion and an input portion has a first mode in which the contrast or the brightness of a displayed image is adjusted and a second mode in which the contrast or the brightness of a displayed image is set to the initial set value. In the case where an image is displayed and a signal such as a scroll instruction is input to the input portion, the contrast or the brightness of the displayed image is adjusted depending on the content of the scroll instruction; thus, the information processing device can perform eye-friendly display.

25 Claims, 33 Drawing Sheets

(58) Field of Classification Search
CPC ..... G09G 2354/00; G09G 3/3413; G09G 3/3607; G09G 3/3648; G09G 5/346; G09G 2320/0686; G09G 3/3406
See application file for complete search history.

(56) References Cited

U.S. PATENT DOCUMENTS

2008/0297695 A1* 12/2008 Sekiguchi ..... G02B 6/0038 349/65
2010/0073276 A1* 3/2010 Koike ..... G09G 3/3426 345/102
2011/0156026 A1* 6/2011 Yamazaki ..... H01L 21/02422 257/43
2012/0013583 A1* 1/2012 Powell ..... G06F 1/1637 345/207
2013/0092927 A1* 4/2013 Murai ..... H01L 27/1222 257/43
2013/0265337 A1* 10/2013 Furumoto ..... G09G 5/10 345/690
2013/0300313 A1 11/2013 Yamazaki et al.
2013/0301124 A1 11/2013 Yamazaki et al.
2013/0322114 A1* 12/2013 Nishitani ..... G02B 6/0051 362/606
2014/0014961 A1* 1/2014 Tsai ..... H01L 33/0041 257/59
2014/0055507 A1* 2/2014 Sakurai ..... G09G 3/3406 345/690
2014/0111558 A1 4/2014 Ishitani et al.
2014/0146033 A1 5/2014 Koyama et al.
2014/1011837 5/2014 Koyama et al.
2014/1013264 5/2014 Yamazaki et al.
2014/0152533 A1 6/2014 Imada
2014/0152630 A1 6/2014 Koyama
2014/0152685 A1 6/2014 Iwaki
2014/0152932 A1 6/2014 Miyake
2014/0184484 A1 7/2014 Miyake et al.
2014/0184968 A1 7/2014 Niikura et al.
2014/0192102 A1* 7/2014 Im ..... H05B 33/0827 345/691
2014/0198123 A1* 7/2014 Shibamiya ..... G09G 3/36 345/589
2014/0240362 A1 8/2014 Kurita
2014/0347588 A1 11/2014 Hatsumi et al.
2014/0368488 A1 12/2014 Hatsumi et al.
2015/0034870 A1 2/2015 Kato et al.
2015/0038722 A1 2/2015 Kato et al.
2015/0153599 A1* 6/2015 Yamazaki ..... H01L 27/1225 257/43
2015/0242701 A1* 8/2015 Tokui ..... H04N 5/243 382/190
2015/0279324 A1* 10/2015 Ohta ..... G09G 3/3283 345/690
2015/0364073 A1* 12/2015 Ogawa ..... G06F 3/0485 345/690
2016/0154435 A1 6/2016 Yanagisawa

OTHER PUBLICATIONS

Burr et al., "Impulse-response functions for chromatic and achromatic stimuli", Journal of the Optical Society of America A: Optical Physics, vol. 10, No. 8, pp. 1706-1713 dated in Aug. 1993.

* cited by examiner

SEMICONDUCTOR DEVICE, METHOD FOR DRIVING SEMICONDUCTOR DEVICE, AND PROGRAM

BACKGROUND OF THE INVENTION

1. Field of the Invention

One embodiment of the present invention relates to an information processing device and a method for driving the information processing device. One embodiment of the present invention also relates to a program for driving the information processing device.

Note that one embodiment of the present invention is not limited to the above technical field. The technical field of one embodiment of the invention disclosed in this specification and the like relates to an object, a method, or a manufacturing method. In addition, one embodiment of the present invention relates to a process, a machine, manufacture, or a composition of matter. Specifically, examples of the technical field of one embodiment of the present invention disclosed in this specification include a semiconductor device, a display device, a liquid crystal display device, a light-emitting device, a power storage device, a memory device, a method for driving any of them, and a method for manufacturing any of them.

2. Description of the Related Art

A method is known in which an information processing device including a display portion and an input portion is driven in the following steps: a first step of acquiring an input signal with the input portion, a second step of starting the movement of an image displayed on the display portion in accordance with the input signal, a third step of reducing the luminance of the image, a fourth step of judging whether the image has reached predetermined coordinates or not, a fifth step of increasing the luminance of the image when it is determined that the image has reached the predetermined coordinates, and a sixth step of stopping the movement of the image. This method can reduce eye fatigue of a user and achieve eye-friendly display (Patent Document 1).

REFERENCE

Patent Document

[Patent Document 1] Japanese Published Patent Application No. 2014-115641

SUMMARY OF THE INVENTION

An object of one embodiment of the present invention is to reduce eye fatigue of a user and perform eye-friendly display. Another object of one embodiment of the present invention is to provide a novel semiconductor device, a novel display device, a novel electronic device, a novel information processing device, a method for driving any of them, a novel program, and the like.

Note that the description of these objects does not disturb the existence of other objects. In one embodiment of the present invention, there is no need to achieve all the objects. Other objects will be apparent from and can be derived from the description of the specification, the drawings, the claims, and the like.

One embodiment of the present invention is a program including the following steps.

In a first step, the setting is initialized.

In a second step, interrupt processing is allowed.

In a third step, image information is displayed in a predetermined mode selected in the first step or in the interrupt processing.

In a fourth step, the next step is determined as follows: a fifth step is selected when a termination instruction has been supplied, whereas the third step is selected when the termination instruction has not been supplied.

In the fifth step, processing is terminated.

The interrupt processing includes the following sixth to eleventh steps.

In the sixth step, the processing proceeds to the seventh step when a predetermined event has been supplied, whereas the processing proceeds to the eleventh step when the predetermined event has not been supplied.

In the seventh step, the processing proceeds to the eighth step when image information to be displayed next has a predetermined contrast, whereas the processing proceeds to the tenth step when the image information to be displayed next does not have the predetermined contrast.

In the eighth step, the processing proceeds to the ninth step when the proportion of the area of a dark portion in the image information to be displayed next is higher than or equal to a predetermined proportion, whereas the processing proceeds to the tenth step when the proportion of the area of the dark portion is lower than the predetermined proportion.

In the ninth step, a first mode is selected.

In the tenth step, a second mode is selected.

In the eleventh step, the processing returns from the interrupt processing.

In this manner, eye strain on a user at the time of switching displayed image information in accordance with a predetermined event such as scrolling can be reduced, whereby eye-friendly display for the user can be achieved. Thus, a novel program which is highly convenient can be provided.

One embodiment of the present invention is an information processing device including a display portion, an input portion, and a control portion. The display portion includes a light-emitting portion. The input portion is configured to sense an input by a user and output a signal to the control portion. The control portion is configured to execute a first mode and a second mode. In the first mode executed by the control portion, the light-emitting portion emits light with first luminance. In the second mode executed by the control portion, the light-emitting portion emits light with second luminance. The control portion is configured to switch between the first mode and the second mode in accordance with the signal.

One embodiment of the present invention is the above information processing device in which the control portion executes the first mode when the input is a first input which corresponds to switching of images or screen scrolling and the control portion executes the second mode when there is not input or the input is not the first input.

One embodiment of the present invention is the above information processing device in which the display portion includes a liquid crystal element or a light-emitting element.

One embodiment of the present invention is the above information processing device in which the display portion includes a plurality of pixels each including a transistor and a semiconductor layer of the transistor where a channel is formed includes an oxide semiconductor.

One embodiment of the present invention is the above information processing device in which the display portion includes a plurality of pixels each including a transistor and a semiconductor layer of the transistor where a channel is formed includes amorphous silicon or polycrystalline silicon.

One embodiment of the present invention is the above information processing device in which the input portion includes at least one of a keyboard, a hardware button, a pointing device, a touch sensor, an imaging device, an audio input device, a viewpoint input device, and a pose detection device.

One embodiment of the present invention is the above information processing device in which the display portion and the input portion form a touch panel.

According to one embodiment of the present invention, an information processing device which gives a user less eye fatigue and can perform eye-friendly display can be provided. Furthermore, according to one embodiment of the present invention, a novel semiconductor device, a novel display device, a novel electronic device, a novel information processing device, a method for driving any of them, a novel program, and the like can be provided.

Note that the description of these effects does not disturb the existence of other effects. One embodiment of the present invention does not necessarily achieve all the effects listed above. Other effects will be apparent from and can be derived from the description of the specification, the drawings, the claims, and the like.

BRIEF DESCRIPTION OF THE DRAWINGS

FIGS. 7A-1, 7A-2, 7B-1, 7B-2, 7C-1, and 7C-2 schematically illustrate examples of a scroll instruction of one embodiment.

DETAILED DESCRIPTION OF THE INVENTION

One embodiment of the present invention includes, for example, a step of selecting a first mode or a second mode and a step of performing display in the selected mode.

For example, one embodiment of the present invention can include a step of selecting the first mode or the second mode when a scroll event occurs, in accordance with the contrast between a dark portion and a bright portion or the proportion of the area of the dark portion in image information to be displayed.

<<First Mode>>

In the case where the first mode is selected, image information to be displayed next is displayed by the following method to reduce visual stimulation.

For example, the image information to be displayed next is displayed such that an influence of lateral inhibition caused by presently displayed image information may be avoided.

Specifically, in the case where a scroll event or the like is supplied to an input portion, depending on the content of the information on the scroll event, the brightness level of a display portion is adjusted such that an image with a lower contrast (a smaller difference in gray levels) than an image before the supply of the scroll event is displayed.

Alternatively, in the case where the scroll event or the like is supplied to the input portion, depending on the content of the information on the scroll event, the brightness level of the display portion is adjusted such that an image with a lower brightness level than the image before the supply of the scroll event is displayed.

<<Second Mode>>

In the case where the second mode is selected, image information is displayed by the following method.

Specifically, an image is displayed while keeping the contrast (the difference in gray levels) or the brightness of the image before the supply of the scroll event.

In this manner, eye strain on a user at the time of switching displayed image information in accordance with a predetermined event such as scrolling can be reduced, whereby eye-friendly display for the user can be achieved. Thus, a novel program which is highly convenient can be provided.

<Display Method in which Influence of Lateral Inhibition is Avoided>

A display method in which an influence of lateral inhibition is avoided will be described with reference to FIGS. 3A to 3D and FIGS. 4A to 4D.

Figure 3A:
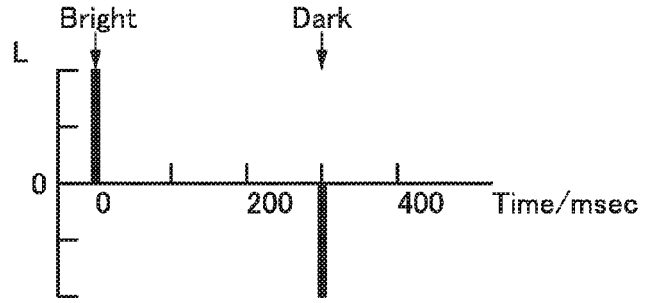
FIGS. 3A to 3D schematically illustrate an optic nerve and a visual transfer function of one embodiment.
Figure 3B:
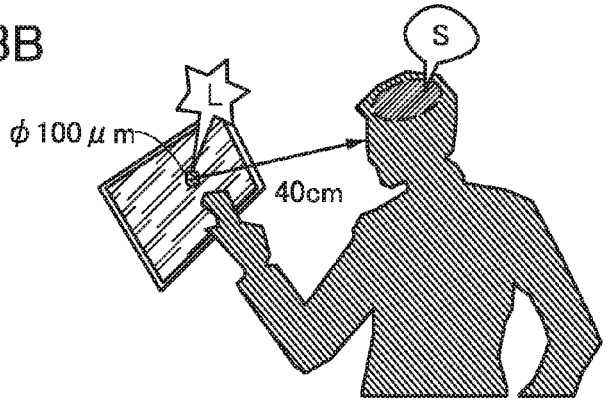
Figure 3C:
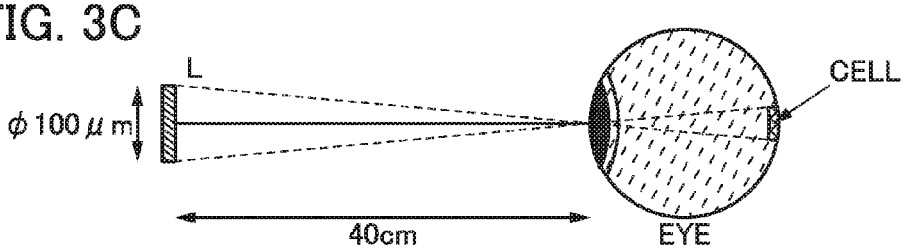
Figure 3D:
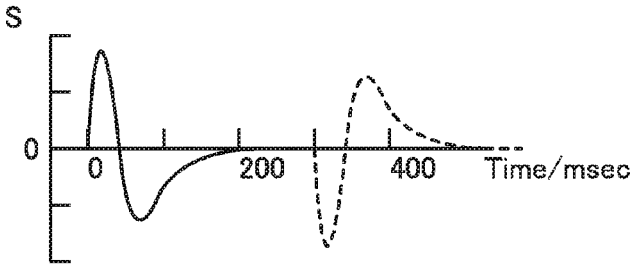

FIGS. 3A to 3D schematically illustrate an optic nerve and a visual transfer function. FIG. 3A schematically illustrates an example of stimuli applied to an optic nerve when image information is switched from one to another. FIGS. 3B and 3C schematically illustrate a positional relation between a display device and a user of the display device. FIG. 3D schematically illustrates responses of an optic nerve to the applied stimuli which are transformed in accordance with the visual transfer function. Note that the vertical axis L in FIG. 3A represents the brightness, where the brightness to which the eyes are adapted is assumed to be 0. The vertical axis S in FIG. 3D represents the intensity of a response.

Figure 4A:
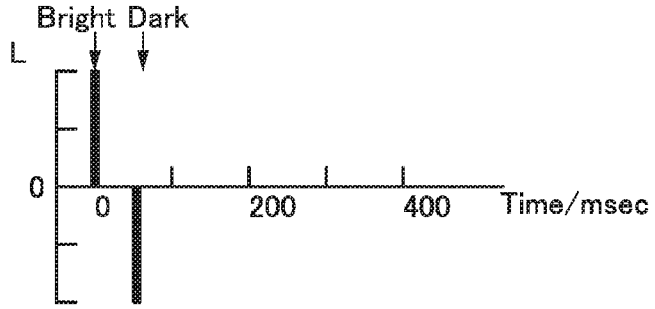
FIGS. 4A to 4D schematically illustrate a visual transfer function of one embodiment.
Figure 4B:
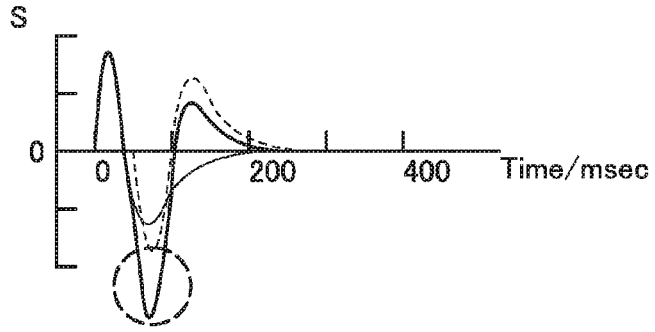
Figure 4C:
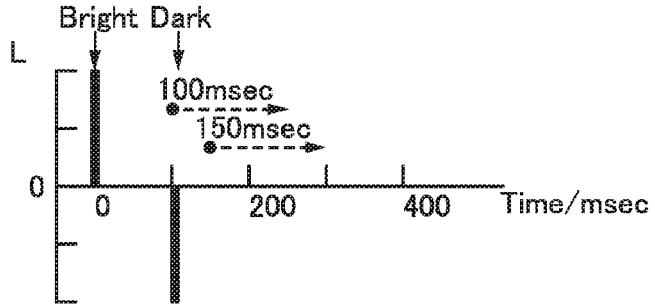
Figure 4D:
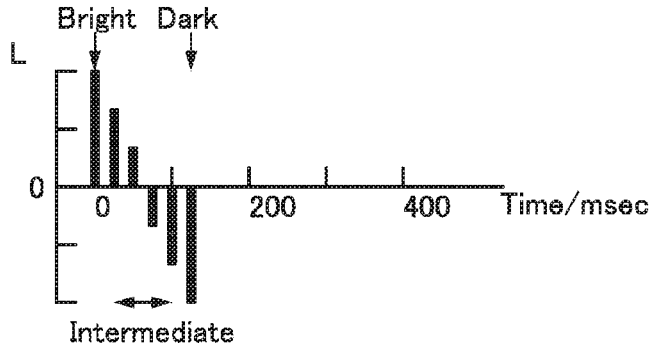

FIGS. 4A to 4D schematically illustrate an optic nerve and a visual transfer function. FIG. 4A schematically illustrates an example of stimuli applied to an optic nerve when image information is switched from one to another. FIG. 4B schematically illustrates responses of an optic nerve to the applied stimuli which are transformed in accordance with the visual transfer function. FIGS. 4C and 4D each schematically illustrate the display method of one embodiment of the present invention, in which amplification of responses to applied stimuli can be suppressed.

In the first mode, for example, image information is switched from one to another at a time interval of 100 msec or longer, preferably 150 msec or longer, whereby an influence of lateral inhibition can be avoided. Thus, amplification of responses to visual stimuli can be suppressed.

<<Lateral Inhibition>>

A neuron of a stimulated optic nerve is capable of inhibiting activities of adjacent other neurons. This phenomenon may cause transformation of responses to a pulsed visual stimulus.

For example, a bright image and a dark image are displayed in a pulsed manner in a region which is on a plane at a distance of 40 cm from the user's eye and has a diameter of 100 μm (see FIG. 3A). Note that the size of one photoreceptor cell (CELL) corresponds to that of a region which is on a plane at a distance of 40 cm from the user's eye and has a diameter of approximately 100 μm (see FIGS. 3B and 3C).

In some cases, a pulsed stimulus is transformed into wave-shaped responses in accordance with the visual transfer function (see FIGS. 3A and 3D). Specifically, a pulsed positive visual stimulus is transformed into a positive response accompanied with a negative response, whereas a pulsed negative visual stimulus is transformed into a negative response accompanied with a positive response (David C. Burr and M. Concetta Morrone, "Impulse-response functions for chromatic and achromatic stimuli," Journal of Optical Society of America, 1993, Vol. 10, No. 8, p. 1706).

When a bright image and a dark image are sequentially displayed at a sufficiently short time interval, for example, a response to the preceding stimulus and a response to the following stimulus are both wave-shaped, and these waves may be superimposed on each other to increase the amplitude.

For example, bright first image information is displayed in a pulsed manner, and 50 msec later, dark second image information is displayed in a pulsed manner. In that case, a negative response which follows a positive response to the displayed first image information may be superimposed on a negative response to the displayed second image information. Accordingly, a significantly amplified negative response may be formed (see FIGS. 4A and 4B).

In the first mode, for example, displayed image information is switched from one to another at a time interval of 100 msec or longer, preferably 150 msec or longer (see FIG. 4C), whereby an influence of wave-shaped responses caused by the visual transfer function can be avoided. Thus, amplification of responses to visual stimuli can be suppressed.

As another example, in the first mode, displayed image information is switched from one to another with intermediate image information displayed therebetween. Specifically, a gray image or an image with a gray level between that of the preceding image information and that of the following image information can be used for the intermediate image information (see FIG. 4D). Thus, wave-shaped responses to the preceding stimulus can be canceled by wave-shaped responses to the following stimulus, thereby weakening in amplitude.

Alternatively, intermediate image information can be obtained by displaying images in such a manner that the preceding image information fades out while the following image information fades in (this technique is also referred to as cross-fade).

As another example, a display element may be overdriven in the second mode, whereas the overdrive may be turned down or stopped in the first mode. Specifically, the overdrive of a liquid crystal element may be stopped in the first mode, whereas the liquid crystal element may be overdriven in the second mode.

In this manner, an influence of lateral inhibition can be avoided. Thus, amplification of responses to visual stimuli can be suppressed.

Program Example

A program of one embodiment of the present invention will be described with reference to FIG. 5 and FIG. 6.

Figure 5:
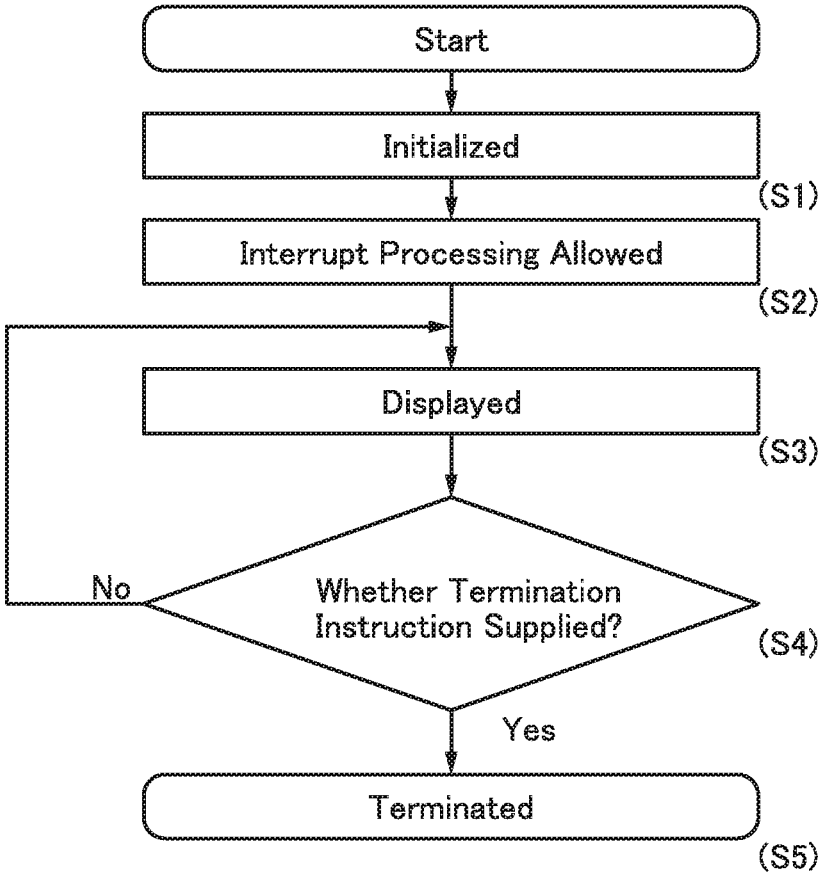
FIG. 5 is a flow chart illustrating a program of one embodiment.

FIG. 5 is a flow chart illustrating main processing of the program of one embodiment of the present invention. FIG. 6 is a flow chart illustrating interrupt processing of the program of one embodiment of the present invention.

Figure 6:
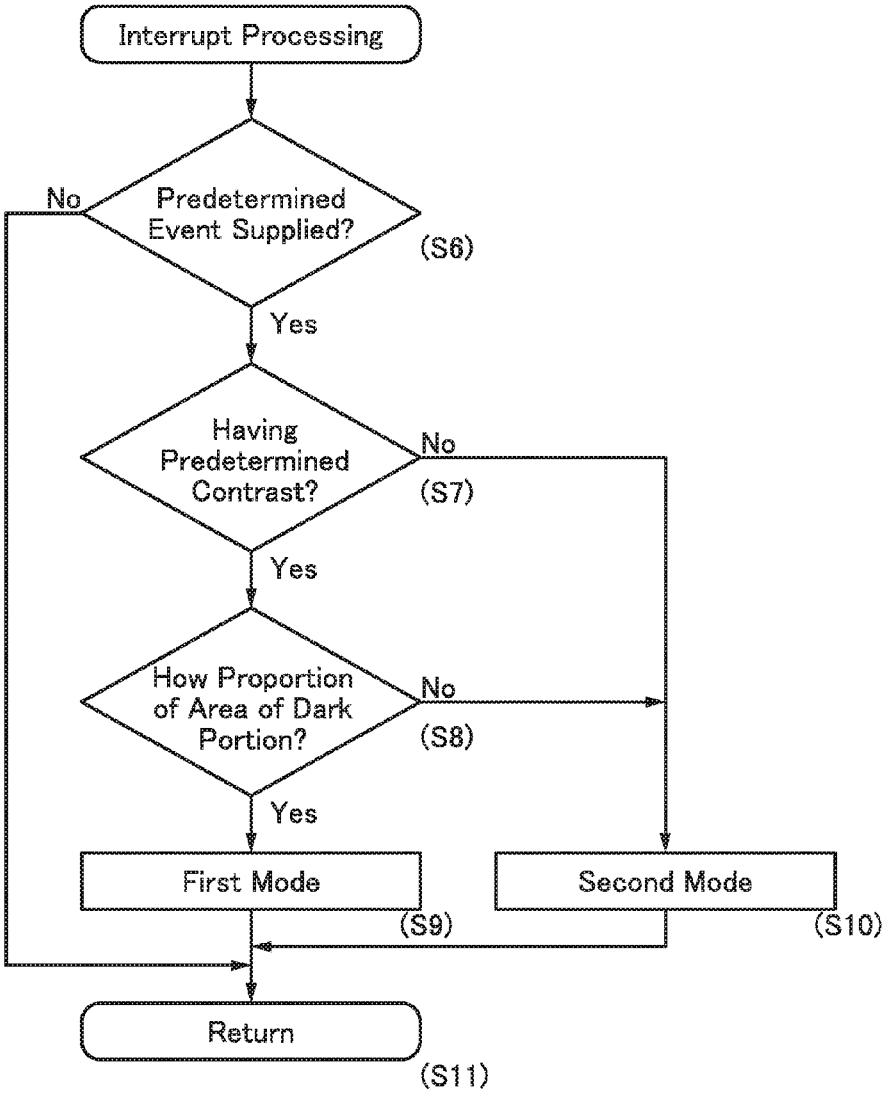
FIG. 6 is a flow chart illustrating a program of one embodiment.

The program of one embodiment of the present invention includes the following eleven steps (see FIG. 5 and FIG. 6).

In a first step (S1), the setting is initialized. For example, the first mode or the second mode is set as initial setting, and a predetermined image is loaded.

In a second step (S2), interrupt processing is allowed. Note that an arithmetic device allowed to execute the interrupt processing can perform the interrupt processing in parallel with the main processing. The arithmetic device which has returned from the interrupt processing to the main processing can reflect the results of the interrupt processing in the main processing.

The arithmetic device may execute the interrupt processing when a counter has an initial value. Thus, the interrupt processing is ready to be executed after the program is started up.

In a third step (S3), image information is displayed in a predetermined mode selected in the first step or in the interrupt processing.

In a fourth step (S4), the next step is determined as follows: a fifth step is selected when a termination instruction has been supplied, whereas the third step is selected when the termination instruction has not been supplied.

In the fifth step (S5), processing is terminated.

The interrupt processing includes the following sixth to eleventh steps (see FIG. 6).

In the sixth step (S6), the processing proceeds to the seventh step when a predetermined event has been supplied, whereas the processing proceeds to the eleventh step when the predetermined event has not been supplied.

In the seventh step (S7), the processing proceeds to the eighth step when image information to be displayed next has a predetermined contrast, whereas the processing proceeds to the tenth step when the image information to be displayed next does not have the predetermined contrast.

In the eighth step (S8), the processing proceeds to the ninth step when the proportion of the area of a dark portion in the image information to be displayed next is higher than or equal to a predetermined proportion, whereas the processing proceeds to the tenth step when the proportion of the area of the dark portion is lower than the predetermined proportion.

In the ninth step (S9), the first mode is selected.

In the tenth step (S10), the second mode is selected.

In the eleventh step (S11), the processing returns from the interrupt processing.

<<Predetermined Event>>

A variety of instructions can be associated with a variety of events.

The following instructions can be given as examples: "page-turning instruction" for switching displayed image information from one to another and "scroll instruction" for moving the display position of part of image information and displaying another part continuing from that part.

Examples of the event supplied to the input portion include events supplied using a pointing device (e.g., "click" and "drag") and events supplied to a touch panel with a finger or the like used as a pointer (e.g., "tap", "drag" and "swipe").

For example, the position of a thumb (also referred to as a handle or knob) of a scroll bar pointed by a pointer, the swipe speed, and the drag speed can be used as parameters assigned to various instructions.

Specifically, a parameter that determines the page-turning speed or the like can be used to execute the "page-turning instruction," and a parameter that determines the moving speed of the display position or the like can be used to execute the "scroll instruction."

Furthermore, the display brightness or contrast may be changed in accordance with the page-turning speed and/or the scroll speed, for example. Specifically, in the case where the page-turning speed and/or the scroll speed are/is higher than the speed at which user's eyes can follow displayed images, the display brightness or contrast may be decreased in synchronization with the page-turning speed and/or the scroll speed.

<<Scroll Instruction>>

Examples of a scroll instruction for moving the display position of image information at various speeds will be described with reference to FIGS. 7A-1, 7A-2, 7B-1, 7B-2, 7C-1, and 7C-2. In the scroll instruction, for example, the speed at which a touch panel is swiped can be used to determine the moving speed of the display position.

FIGS. 7A-1, 7B-1, and 7C-1 each schematically illustrate a scroll instruction for moving the display position of image information at a time-varying speed V.

Figure 1:
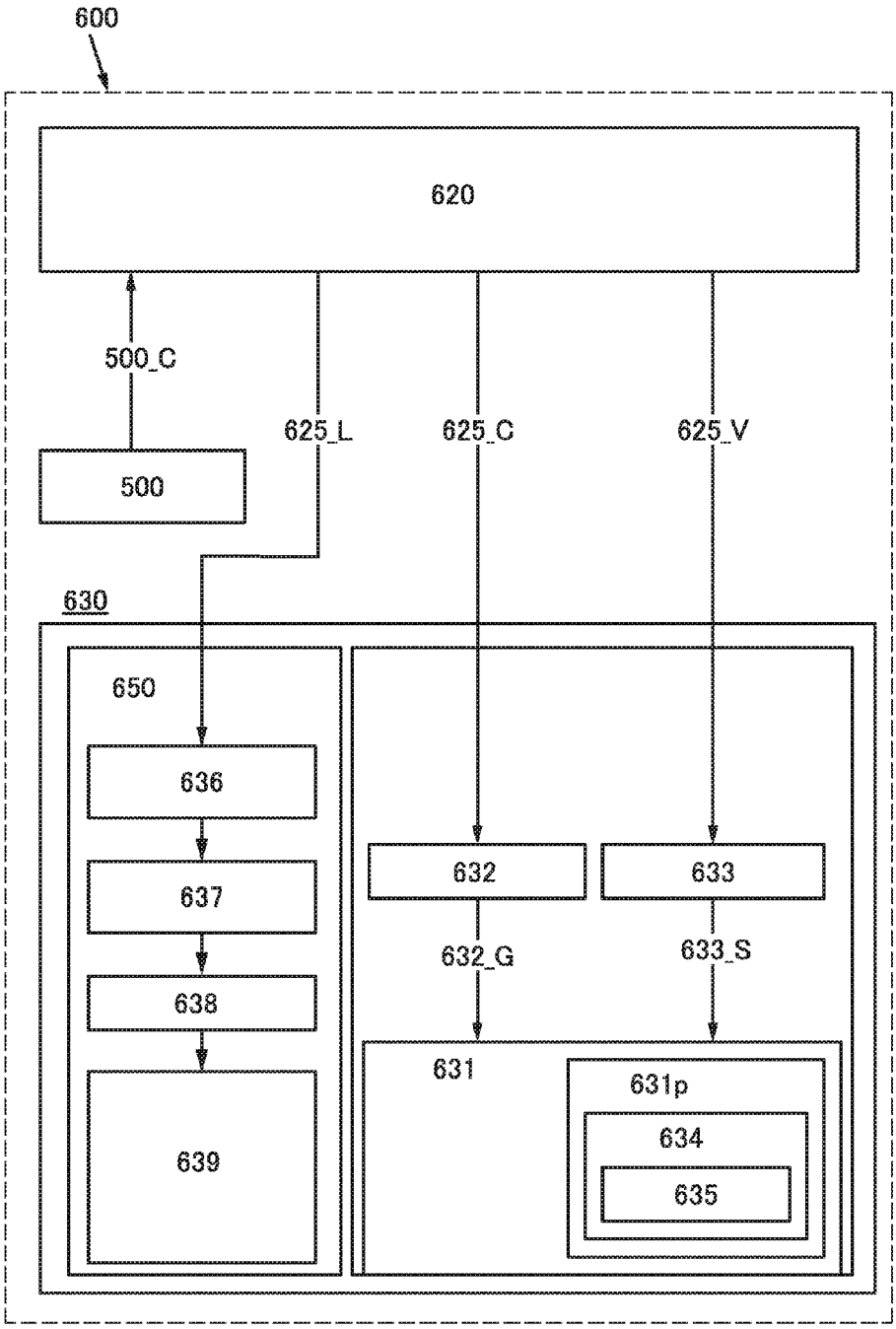
FIG. 1 illustrates a configuration example of an information processing device of one embodiment.
Figures 1, 7A:
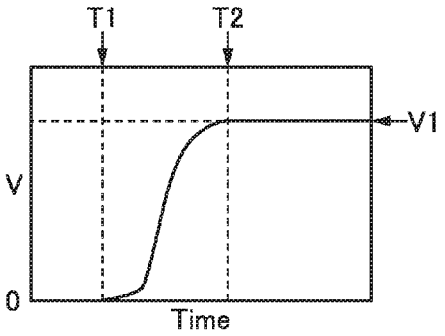
Figures 2, 7A:
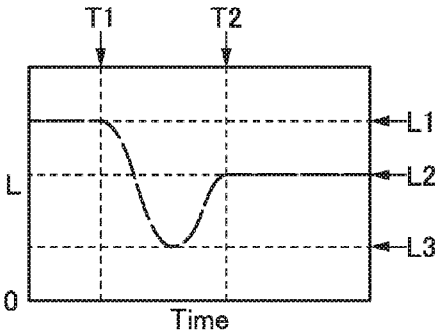

FIG. 7A-2 illustrates a method for adjusting the brightness L of a bright portion of the image information whose display position is moved at the speed illustrated in FIG. 7A-1.

Figures 1, 7B:
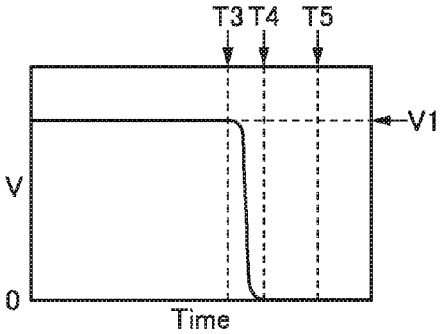
Figures 2, 7B:
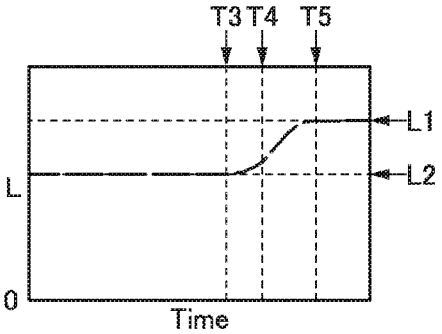

FIG. 7B-2 illustrates a method for adjusting the brightness L of the bright portion of the image information whose display position is moved at the speed illustrated in FIG. 7B-1.

Figures 1, 7C:
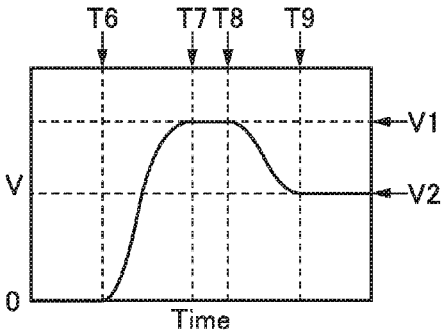
Figures 2, 7C:
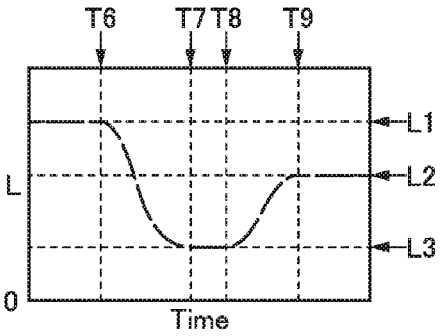

FIG. 7C-2 illustrates a method for adjusting the brightness L of the bright portion of the image information whose display position is moved at the speed illustrated in FIG. 7C-1.

<<Example 1 of Scroll Instruction>>

Described will be an example of a scroll instruction in which the moving speed of the display position of the image information is increased from 0 to V1 in a period from Time T1 to Time T2 (see FIGS. 7A-1 and 7A-2).

For example, in a period until Time T1, in which the display position of the image information does not change, the bright portion is displayed at Brightness L1.

In the period from Time T1 to Time T2, in which the display position of the image information is moved at an increasing speed, the bright portion is displayed at a brightness changing between Brightness L1 and Brightness L3, which is lower than Brightness L1.

In a period after Time T2, in which the display position of the image information is moved constantly at Speed V1, the bright portion is displayed at Brightness L2, which is lower than Brightness L1 and higher than Brightness L3. In the case where the brightness is changed as described above, the luminance is changed so as to be increased or decreased gradually because a rapid change of the brightness leads to a heavy eye strain.

<<Example 2 of Scroll Instruction>>

Described will be an example of a scroll instruction in which the moving speed of the display position of the image information is decreased from V1 to 0 in a period from Time T3 to Time T4 (see FIGS. 7B-1 and 7B-2).

For example, in a period until Time T3, in which the display position of the image information is moved constantly at Speed V1, the bright portion is displayed at Brightness L2.

In the period from Time T3 to Time T4, in which the display position of the image information is moved at a decreasing speed, the bright portion is displayed at a brightness increasing from Brightness L2.

In a period from Time T4 to Time T5, in which the display position of the image information is fixed, the bright portion is displayed at a brightness increasing to predetermined Brightness L1, which is higher than Brightness L2. Note that the period from Time T4 to Time T5 is preferably 0 seconds or longer.

<<Example 3 of Scroll Instruction>>

The following scroll instruction will be described as an example. The display position of the image information is moved at a speed increasing from 0 to V1 in a period from Time T6 to Time T7 and moved at Speed V1 in a period from Time T7 to Time T8. Then, the display position of the image information is moved at a speed decreasing from V1 to V2 in a period from Time T8 to Time T9 and moved at Speed V2 in a period after Time T9 (see FIGS. 7C-1 and 7C-2).

For example, in a period until Time T6, in which the display position of the image information does not change, the bright portion is displayed at Brightness L1.

In the period from Time T6 to Time T7, in which the display position of the image information is moved at an increasing speed, the bright portion is displayed while decreasing the brightness from Brightness L1.

In the period from Time T7 to Time T8, in which the display position of the image information is moved constantly at Speed V1, the bright portion is displayed at Brightness L3.

In the period from Time T8 to Time T9, in which the display position of the image information is moved at a decreasing speed, the bright portion is displayed at a brightness increasing from Brightness L3.

In the period after Time T9, in which the display position of the image information is moved constantly at Speed V2, which is lower than Speed V1, the bright portion is displayed at Brightness L2, which is lower than Brightness L1 and higher than Brightness L3.

<<Conditions for Mode Selection>>

A method in which characteristics of image information to be displayed next are used as conditions for mode selection will be described with reference to FIGS. 8A to 8C.

Figure 8A:
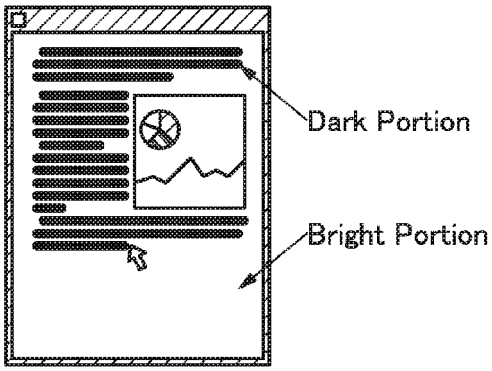
FIGS. 8A to 8C schematically illustrate a configuration of image information of one embodiment.

FIG. 8A schematically illustrates image information including a dark portion and a bright portion.

Figure 8B:
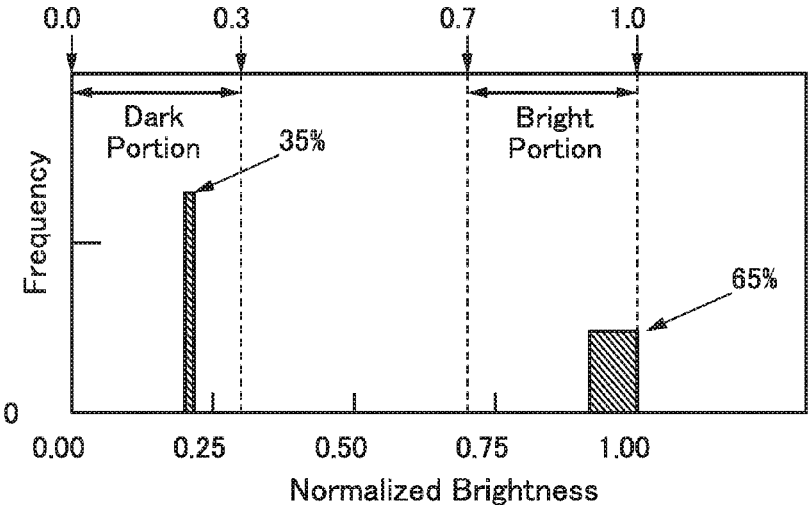

FIG. 8B schematically illustrates the area ratio in terms of brightness in the image information to be displayed next. Note that the horizontal axis represents the normalized brightness, where the lowest brightness and the highest brightness of the display device are 0 and 1, respectively.

Figure 8C:
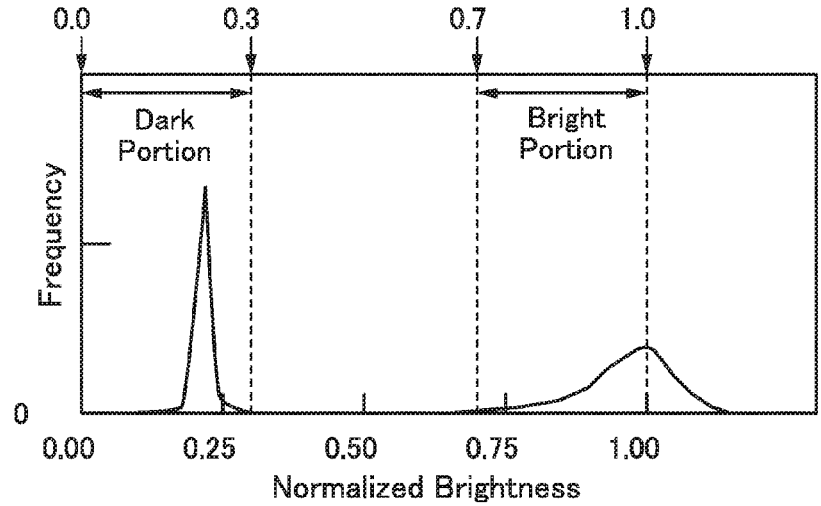

FIG. 8C is a diagram (or a histogram) showing the results of determining the area ratio in terms of brightness in a general document in which, for example, texts are printed on white paper. Note that the horizontal axis represents the normalized brightness, where the brightness at which the proportion of the area of the bright portion peaks is 1.

Specifically, the case where the contrast or the proportion of the area of the dark portion in the image information to be displayed next is used as a condition for mode selection will be described.

<<Contrast>>

For example, the first mode can be selected depending on whether the contrast in the image information to be displayed next exceeds a predetermined value or not.

Specifically, in the image information, a region with a normalized brightness of higher than or equal to 0 and lower than or equal to 0.3 is defined as a dark portion, and a region with a normalized brightness of higher than or equal to 0.7 and lower than or equal to 1.0 is defined as a bright portion. The mode can be selected depending on whether the image information includes both the bright portion and the dark portion or not.

For example, image information including a region with a normalized brightness of 0.2 and a region with a normalized brightness of 0.95 satisfies the condition for selection of the first mode (see FIG. 8B).

In the case where the contrast in the image information to be displayed next is lower than that in a general document in which, for example, texts are printed on white paper (see FIG. 8C), the second mode may be selected because only a little visual stimulation is caused by display change.

<<Proportion of Area of Dark Portion>>

As a condition for mode selection, for example, it is also possible to use the proportion of the area of the dark portion in the image information to be displayed next.

Specifically, the mode can be selected depending on whether the dark portion occupies 30% or more of the image information or not.

For example, image information in which the proportion of the area of a region with a normalized brightness of 0.2 is 35% satisfies the condition for selection of the first mode (see FIG. 8B).

In the case where the proportion of the area of the dark portion in the image information to be displayed next is lower than that in a general document in which, for example, texts are printed on white paper (see FIG. 8C), the second mode may be selected because only a little visual stimulation is caused by display change.

Embodiments will be described in detail with reference to the drawings. Note that the present invention is not limited to the description below, and it is easily understood by those skilled in the art that various changes and modifications can be made without departing from the spirit and scope of the present invention. Therefore, the present invention should not be construed as being limited to the description in the following embodiments. In the structures of the invention described below, the same portions or portions having similar functions are denoted by the same reference numerals in different drawings, and description of such portions is not repeated.

Embodiment 1

In this embodiment, an example of a transmissive display device that can be used as a display device of an information processing device disclosed in this specification will be described with reference to FIG. 1, FIGS. 2A and 2B, FIGS. 7A-1 to 7C-2, and FIGS. 33A to 33E.

Specifically, the configuration of a transmissive display device capable of adjusting the luminance of a backlight depending on an operation such as page scrolling sensed at an input portion of an information processing device will be described. With this configuration, display that can reduce eye strain can be performed.

FIG. 1 is a block diagram illustrating the configuration of a liquid crystal display device 600 of one embodiment of the present invention.

Figure 2A:
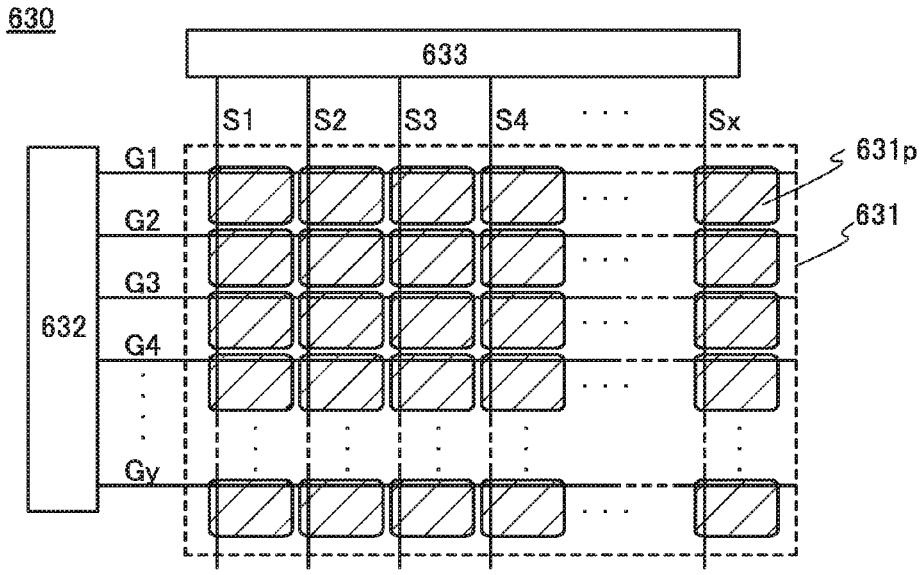
FIGS. 2A and 2B each illustrate a configuration example of a display portion in an information processing device of one embodiment.
Figure 2B:
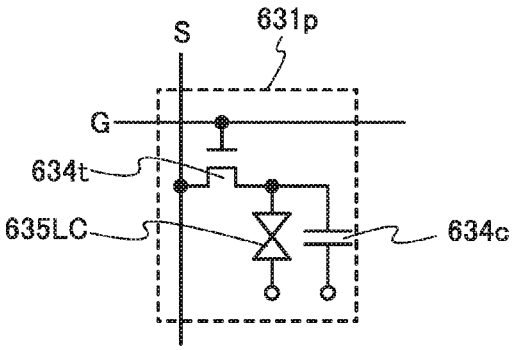

FIGS. 2A and 2B are a top view and a circuit diagram, respectively, which illustrate the configuration of a display portion 630 that can be used in the liquid crystal display device 600 of one embodiment of the present invention.

<Configuration of Transmissive Display Device>

The liquid crystal display device 600 included in the information processing device with a display function and an input function, which is described in this embodiment, includes the display portion 630, an arithmetic device 620, and an input portion 500. Note that the arithmetic device 620 can also be called a control portion.

<Display Portion>

The display portion 630 includes a pixel portion 631, a first driver circuit (S driver circuit) 633, and a second driver circuit (G driver circuit) 632.

An image signal 625_V, a power supply potential, and a control signal 625_C are supplied to the display portion 630.

FIG. 2A illustrates an example of the configuration of the display portion 630.

The display portion 630 includes the pixel portion 631. In the pixel portion 631, a plurality of pixels 631*p*, a plurality of scan lines G1 to Gy for selecting the pixels 631*p* row by row, and a plurality of signal lines S1 to Sx for supplying first driving signals 633_S to the selected pixels 631*p* are provided.

The input of second driving signals 632_G to the scan lines G1 to Gy is controlled by the second driver circuit 632. The input of the first driving signals 633_S to the signal lines S1 to Sx is controlled by the first driver circuit 633. Each of the plurality of pixels 631*p* is connected to at least one of the scan lines G1 to Gy and at least one of the signal lines S1 to Sx.

Note that the kinds and the number of wirings provided in the pixel portion 631 can be determined by the structure, the number, and the positions of the pixels 631*p*. Specifically, in the pixel portion 631 illustrated in FIG. 2A, the pixels 631*p* are arranged in a matrix of x columns and y rows, and the signal lines S1 to Sx and the scan lines G1 to Gy are provided in the pixel portion 631.

<<Pixel Portion>>

The pixel portion 631 includes the pixels 631*p*, and each of the pixels 631*p* includes a pixel circuit 634 (see FIG. 1). For example, the plurality of pixels 631*p* are arranged in a matrix.

The pixel circuit 634 includes a display element 635 and holds the input first driving signal 633_S. The display element 635 displays an image based on the first driving signal 633_S.

<<Display Element>>

For example, a display element capable of controlling the transmission of light can be used as the display element 635. Specifically, a transmissive display element or a MEMS shutter display element can be used.

Specifically, a liquid crystal element using any of the following modes can be used: an in-plane-switching (IPS) mode, a twisted nematic (TN) mode, a fringe field switching (FFS) mode, an axially symmetric aligned micro-cell (ASM) mode, an optically compensated birefringence (OCB) mode, a ferroelectric liquid crystal (FLC) mode, an antiferroelectric liquid crystal (AFLC) mode, and the like.

An example in which a liquid crystal element is used as the display element 635 will be described with reference to FIG. 2B. A liquid crystal element 635LC includes a first electrode, a second electrode, and a liquid crystal layer which is provided between the first electrode and the second electrode and includes a liquid crystal material. A voltage is applied to the liquid crystal layer. In the liquid crystal element 635LC, the orientation of liquid crystal molecules is changed in accordance with the level of the voltage applied between the first electrode and the second electrode, so that the transmittance is changed. Accordingly, the display element 635 can express a gray level based on the first driving signal 633_S.

<<Pixel Circuit>>

The configuration of the pixel circuit 634 in which the liquid crystal element 635LC is used as the display element 635 will be described with reference to FIG. 2B. The configuration of the pixel circuit 634 can be selected in accordance with the kind or the driving method of the display element 635.

The pixel circuit 634 includes a transistor 634*t*. The transistor 634*t* controls whether to supply the first driving signal 633_S to the first electrode of the liquid crystal element 635LC.

A potential Vcom is applied to the second electrode of the liquid crystal element 635LC.

A gate of the transistor 634*t* is connected to one of the scan lines G1 to Gy. One of a source and a drain of the transistor 634*t* is connected to one of the signal lines S1 to Sx. The other of the source and the drain of the transistor 634*t* is connected to the first electrode of the liquid crystal element 635LC.

One or a plurality of transistors can be used as a switching element of the pixel 631*p*. For example, a plurality of transistors connected in parallel, a plurality of transistors connected in series, or a plurality of transistors connected in combination of parallel connection and series connection can be used as one switching element.

The pixel 631*p* can include a capacitor 634*c* for holding the voltage between the first electrode and the second electrode of the liquid crystal element 635LC. The pixel 631*p* can also include another circuit element such as a transistor, a diode, a resistor, a capacitor, or an inductor.

The capacitance of the capacitor 634*c* is adjusted as appropriate so that it can be used in the pixel circuit 634. The capacitance in the pixel circuit 634 may also be adjusted using a component other than the capacitor 634*c*. For example, the first electrode and the second electrode of the liquid crystal element 635LC may be used to form a capacitor in which the second electrode includes a region that overlaps with the first electrode.

<Transistor>

For example, a transistor including an oxide semiconductor can be used. Alternatively, a transistor including silicon, germanium, an organic semiconductor, or the like can be used.

<<First Driver Circuit>>

The first driver circuit 633 is supplied with the power supply potential and the image signal 625_V and outputs the first driving signal 633_S to the pixel portion 631 (see FIG. 1).

<<Second Driver Circuit>>

The second driver circuit 632 is supplied with the power supply potential and the control signal 625_C and outputs the second driving signal 632_G for selecting the pixels 631*p* to the pixel portion 631.

The second driver circuit 632 outputs the second driving signal 632_G to the pixels 631*p*. Specifically, the second driver circuit 632 can output the second driving signal 632_G with a frame frequency which corresponds to an image to be displayed. To switch images such as moving images smoothly, the second driving signal 632_G may be output with a frame frequency of, for example, 60 Hz or higher. In the case where still images are displayed with a lower frame frequency, the second driving signal 632_G may be output with a frame frequency of, for example, 1 Hz or lower.

<<Light Supply Portion>>

A light supply portion 650 includes a region overlapping with the pixel portion 631 and serves as a backlight for supplying light to the pixel portion 631.

The arithmetic device 620 receives an image switching signal 500_C output from the input portion 500, generates the control signal 625_C and the image signal 625_V, and outputs the signals to the display portion 630. The arithmetic device 620 also outputs, to the light supply portion 650, a control signal 625_L for adjusting the luminance of a light-emitting portion 639 in accordance with the image switching signal 500S.

<Arithmetic Device>

The arithmetic device 620 has a function of generating the image signal 625_V, the control signal 625_C, and the control signal 625_L (see FIG. 1).

Note that the control signal 625_C may include a start pulse signal SP, a clock signal CK, a latch signal LP, a pulse width control signal PWC, and the like which control the operation of the second driver circuit 632.

For example, the arithmetic device 620 outputs the control signal 625_L, the control signal 625_C, the image signal 625_V, and the like in accordance with the image switching signal 500_C supplied from the input portion 500.

The arithmetic device 620 generates the image signal 625_V including a change in image information accompanying a page-turning operation or a page-scrolling operation and outputs the image signal 625_V together with the control signal 625_C.

The arithmetic device 620 may have a function of inverting the polarity of the image signal 625_V. Specifically, the arithmetic device 620 may include an inversion control circuit, and the polarity of the image signal 625_V may be inverted at the timing informed by the inversion control circuit. Alternatively, the polarity of the image signal 625_V may be inverted in the display portion 630 in accordance with an instruction from the arithmetic device 620.

The inversion control circuit has a function of determining the timing of inverting the polarity of the image signal 625_V by using a synchronization signal. For example, the inversion control circuit can include a counter and a signal generation circuit. Note that the polarity of the image signal 625_V can be inverted every signal line, every scan line, every pixel, or every frame.

<Input Portion>

The input portion 500 has a function of outputting the image switching signal 500_C to the arithmetic device 620. For example, the input portion 500 senses an operation, such as tap or swipe, associated with a page turning instruction, a scroll instruction, or the like and supplies the image switching signal 500_C to the arithmetic device 620.

As the input portion 500, a touch panel, a touch pad, a joystick, a trackball, a data glove, or an imaging device can be used, for example. In the arithmetic device 620, an electric signal input from the input portion 500 can be associated with coordinates of the display portion 630. Thus, an instruction for processing information displayed on the display portion can be input by the user.

Examples of information input with the input portion 500 by the user include an instruction for dragging an image displayed on the display portion to another position on the display portion, an instruction for swiping a screen for turning a displayed image and displaying the next image, an instruction for scrolling a screen to move an image that continues to the outside of a display region, an instruction for selecting a specific image, an instruction for pinching in or out a screen for changing the size of a displayed image, and an instruction for inputting handwritten characters.

<Light Supply Portion>

The light supply portion 650 includes a timing controller 636, a luminance adjustment circuit 637, a driver 638, and the light-emitting portion 639. The arithmetic device 620 outputs the control signal 625_L which controls the driving of a light source in the light supply portion 650.

For the light-emitting portion 639 in the light supply portion 650, a cold cathode fluorescent lamp, a light-emitting diode (LED), an organic electroluminescent (EL) element (also referred to as an organic light-emitting diode (OLED) element) that generates luminescence (electroluminescence) by application of an electric field, or the like can be used. The light source in the light supply portion 650 can emit light in three colors by any of the following methods: a three-color method in which red light, green light, and blue light are used, a color conversion method or a quantum dot method in which part of blue light is converted into red light or green light, a color filter method in which part of white light is converted into red light, green light, and blue light through a color filter, and the like.

The timing controller 636 supplies gray level data for adjusting the luminance at the time of page scrolling to the luminance adjustment circuit 637 in accordance with the control signal 625_L output from the arithmetic device 620. The timing controller 636 may also have a function of supplying a timing signal for controlling a light-emitting region of the light-emitting portion 639 in accordance with the control signal 625_L.

In order to control the light-emitting region, for example, the light-emitting region may be divided into a plurality of regions $A_1$ to $A_n$, and the divided regions may sequentially emit light as follows: the region $A_1$ emits light in synchronization with the timing signal, and then, the regions $A_2$ to $A_n$ sequentially emit light at regular intervals.

Figure 33A:
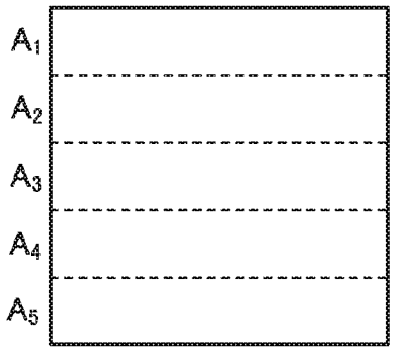
FIGS. 33A to 33E are schematic views each illustrating the operation of a backlight of one embodiment.
Figure 33B:
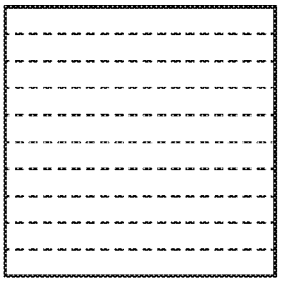
Figure 33C:
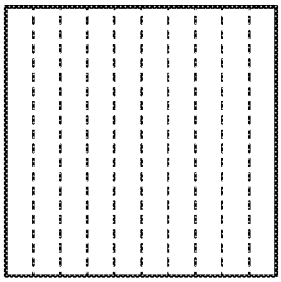

FIG. 33A schematically illustrates an example in which the light-emitting region is divided into five regions $A_1$ to $A_5$.

Figure 33D:
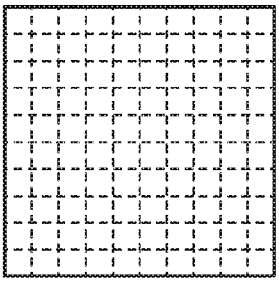

The light-emitting region may be divided into a plurality of rows (FIG. 33B) or a plurality of columns (FIG. 33C), or divided in both the row direction and the column direction into a matrix (FIG. 33D). The smaller the divided region is, the more precisely the luminance of the light-emitting region can be controlled.

A method for dividing the light-emitting region may be selected as appropriate depending on the specifications of the display device without being limited to the methods described in this embodiment.

The plurality of divided regions may emit light in synchronization with the timing signal in such a manner that the brightness of the plurality of regions is adjusted in an image data rewriting period and the brightness is changed gradually before and after the image data rewriting period.

Figure 33E:
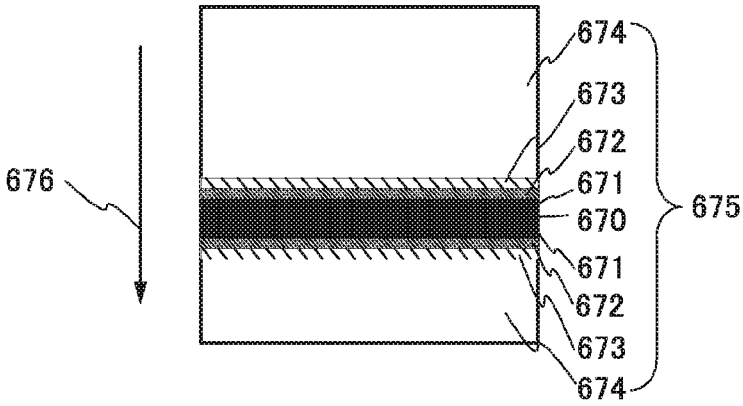

FIG. 33E schematically illustrates an example in which the brightness of the light-emitting region is adjusted to five levels, that is, the maximum brightness 1, the minimum brightness 0, and the intermediate brightness 0.25, 0.5, and 0.75 and scanning is performed. A region 670 has the brightness 0, the region 671 has the brightness 0.25, the region 672 has the brightness 0.5, the region 673 has the brightness 0.75, and the region 674 has the brightness 1. The region 670 with the brightness 0 is positioned at the center, and the regions 671, 672, 673, and 674 are provided on each side of the region 670 so that the brightness is increased stepwise. A region 675 including the regions 670, 671, 672, 673, and 674 with the adjusted brightness is scanned in a scanning direction 676 indicated by an arrow.

Rewriting of image data and the scanning of the region 675 are performed in synchronization; thus, display problems in switching of the frames can be reduced.

The number of brightness levels and the number of divided regions in the region 675 are schematically illustrated for explanation in FIG. 33E. The number of brightness levels, the number of divided regions, and the area of each divided region in the region 675 are not limited those in this embodiment and can be determined as appropriate in accordance with the specifications of the display device.

The luminance adjustment circuit 637 generates gray level data and outputs the data to the driver 638. The driver 638 outputs a signal corresponding to the gray level data to the light-emitting portion 639. The luminance may be adjusted by the amplitude of the emission intensity of the light-emitting portion 639. As a waveform for adjusting the emission intensity, an oscillatory waveform in which a triangular wave, a rectangular wave, a sine wave, and the like are superimposed can be used.

A method in which the luminance is effectively adjusted by controlling the emission time in one cycle while keeping a constant amplitude of the emission intensity, like a pulse width modulation method, can also be used.

Operation Example

An example of display which can reduce eye strain will be described with reference to timing charts in FIGS. 7A-1 to 7C-2. Specifically, a predetermined event such as a scroll operation is input to the input portion, the contrast and the proportion of the area of the dark portion on the screen in image information displayed at that time are examined, and the first mode is selected in accordance with the examination results to adjust the luminance of the light supply portion by any of the methods described in this specification.

<<Example 1 of Scroll Instruction>>

In the case where the scroll instruction for increasing the moving speed of the display position of image information from 0 to V1 in the period from Time T1 to Time T2 as illustrated in FIG. 7A-1 is supplied, the control signal 625_L for changing the luminance as illustrated in FIG. 7A-2 is output from the arithmetic device 620 to the luminance adjustment circuit 637 via the timing controller 636.

For example, with the output control signal 625_L, in the period until Time T1, in which the display position of the image information does not change, the bright portion is displayed at Brightness L1.

Then, with the output control signal 625_L, in the period from Time T1 to Time T2, in which the display position of the image information is moved at an increasing speed, the bright portion is displayed at a brightness changing between Brightness L1 and Brightness L3, which is lower than Brightness L1.

With the output control signal 625_L, in the period after Time T2, in which the display position of the image information is moved constantly at Speed V1, the bright portion is displayed at Brightness L2, which is lower than Brightness L1 and higher than Brightness L3.

Since the display position of the image information is moved while increasing the moving speed in the period from Time T1 to Time T2, display of images under this condition can lead to a heavy eye strain. Therefore, the acceleration and the like of an event such as swipe and drag that is input to the input portion is examined in the arithmetic device 620. When it is determined that the acceleration state has a value exceeding a predetermined value, the luminance of the light-emitting portion is reduced to Brightness L3 so as to reduce eye strain and then increased to reach Brightness L2 at Time T2.

In the case where the brightness is changed as described above, the luminance is changed so as to be increased or decreased gradually because a rapid change of the brightness leads to a heavy eye strain.

<<Example 2 of Scroll Instruction>>

In the case where the scroll instruction for decreasing the moving speed of the display position of image information from V1 to 0 in the period from Time T3 to Time T4 as illustrated in FIG. 7B-1 is supplied, the control signal 625_L for changing the luminance as illustrated in FIG. 7B-2 is output from the arithmetic device 620 to the luminance adjustment circuit 637 via the timing controller 636.

For example, with the output control signal 625_L, in the period until Time T3, in which the display position of the image information is moved constantly at Speed V1, the bright portion is displayed at Brightness L2.

With the output control signal 625_L, in the period from Time T3 to Time T4, in which the display position of the image information is moved at a decreasing speed, the bright portion is displayed at a brightness increasing from Brightness L2.

In the period from Time T4 to Time T5, in which the display position of the image information is fixed, the bright portion is displayed at a brightness increasing to predetermined Brightness L1, which is higher than Brightness L2. Note that the period from Time T4 to Time T5 is preferably 0 seconds or longer.

Since the moving speed of the display position of the image information is rapidly decreased in the period from Time T3 to Time T4, display of images so as to correspond to this change can lead to a heavy eye strain. Therefore, the acceleration and the like of an event such as swipe and drag that is input to the input portion is examined in the arithmetic device 620. The luminance of the light-emitting portion is changed not only in the period from Time T3 to Time T4 but also in the period from Time T4 to Time T5 so that the luminance is increased gradually to reach Brightness L1, in which case eye strain can be reduced.

<<Example 3 of Scroll Instruction>>

In the case where the scroll instruction for increasing the moving speed of the display position of image information from 0 to V1 in the period from Time T6 to Time T7, keeping the speed at V1 in the period from Time T7 to Time T8, decreasing the speed from V1 to V2 in the period from Time T8 to Time T9, and keeping the speed at V2 after Time T9 as illustrated in FIG. 7C-1 is supplied, the control signal 625_L for changing the luminance as illustrated in FIG. 7C-2 is output from the arithmetic device 620 to the luminance adjustment circuit 637 via the timing controller 636.

The scroll speed in FIG. 7C-1 is changed in a manner similar to that in FIG. 7A-1 until Time T7. However, FIG. 7C-1 is different from FIG. 7A-1 in that the scroll speed is constant at V1 in the period from Time T7 to Time T8 and then decreased to V2.

As in FIG. 7A-1, the acceleration and the like of an event such as swipe and drag that is input to the input portion in the period from Time T6 to Time T7 is examined in the arithmetic device 620. When it is determined that the acceleration state has a value exceeding a predetermined value, the luminance of the light-emitting portion is reduced to Brightness L3 so as to reduce eye strain.

After that, the speed is constant in the period from Time T7 to Time T8. Thus, the luminance is held at Brightness L3 so that the next change in scroll speed can also be used to determine whether to adjust the luminance.

The scroll speed is decreased to V2 in the period from Time T8 to Time T9, but the change in scroll speed is not as rapid as in the period from Time T6 to Time T7. Accordingly, the luminance is increased to Brightness L2 to correspond to the change in scroll speed.

This embodiment can be combined with any of the other embodiments in this specification as appropriate.

Embodiment 2

In this embodiment, structural examples of a display device that can be used as the transmissive display device described in the above embodiment will be described. A display device 200 will be described below with reference to FIGS. 9A and 9B to FIG. 24.

Figure 9A:
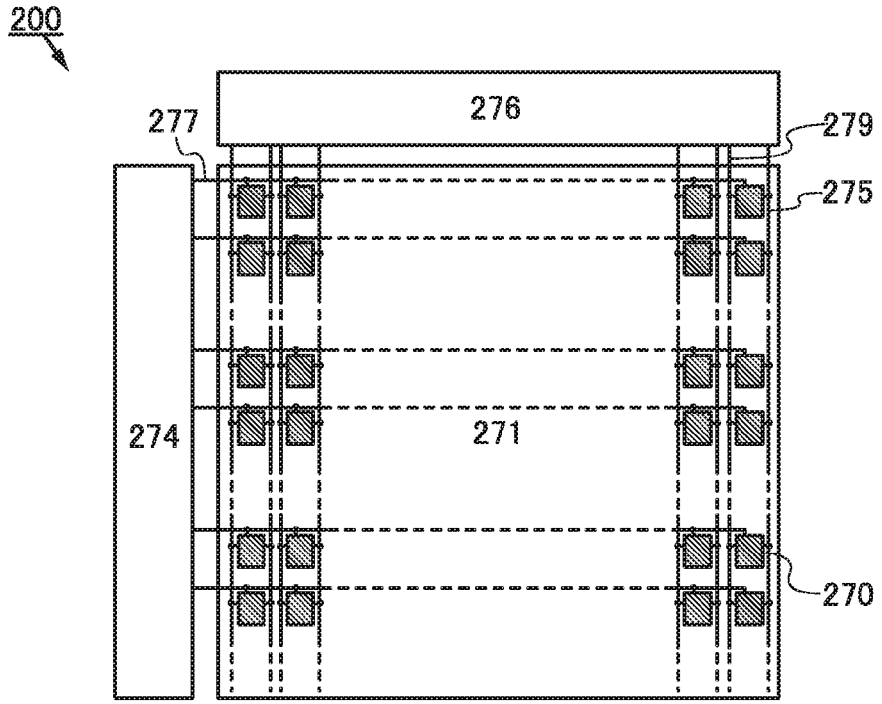
FIGS. 9A and 9B illustrate a configuration example of a display device of one embodiment.

The display device 200 illustrated in FIG. 9A includes a pixel portion 271, a scan line driver circuit 274, a signal line driver circuit 276, m scan lines 277 that are arranged parallel or substantially parallel to each other and whose potentials are controlled by the scan line driver circuit 274, and n signal lines 279 that are arranged parallel or substantially parallel to each other and whose potentials are controlled by the signal line driver circuit 276. The pixel portion 271 includes a plurality of pixels 270 arranged in a matrix. Furthermore, common lines 275 arranged parallel or substantially parallel to each other are provided along the signal lines 279. The scan line driver circuit 274 and the signal line driver circuit 276 are collectively referred to as a driver circuit portion in some cases.

Each of the scan lines 277 is electrically connected to n pixels 270 in the corresponding row among the pixels 270 arranged in m rows and n columns in the pixel portion 271. Each of the signal lines 279 is electrically connected to m pixels 270 in the corresponding column among the pixels 270 arranged in m rows and n columns. Note that m and n are each an integer of 1 or more. Each of the common lines 275 is electrically connected to m pixels 270 in the corresponding column among the pixels 270 arranged in m rows and n columns.

Figure 9B:
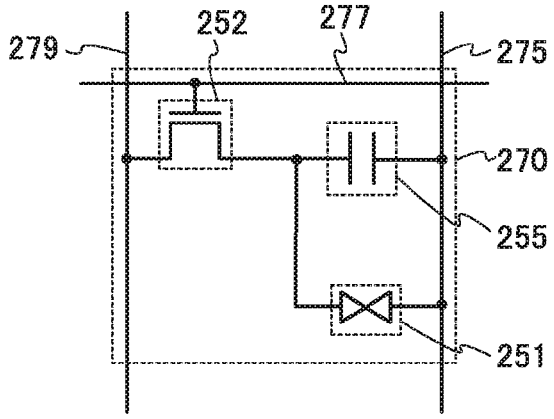

FIG. 9B illustrates an example of a circuit configuration that can be used for the pixel 270 in the display device 200 illustrated in FIG. 9A.

The pixel 270 illustrated in FIG. 9B includes a liquid crystal element 251, a transistor 252, and a capacitor 255.

One of a pair of electrodes of the liquid crystal element 251 is connected to the transistor 252, and the potential thereof is set as appropriate in accordance with the specifications of the pixel 270. The other of the electrodes of the liquid crystal element 251 is connected to the common line 275, and a common potential is applied thereto. The orientation of liquid crystal molecules of the liquid crystal element 251 is controlled in accordance with data written to the transistor 252.

The liquid crystal element 251 controls transmission or non-transmission of light utilizing an optical modulation action of liquid crystal. Note that optical modulation action of liquid crystal is controlled by an electric field applied to the liquid crystal (including a horizontal electric field, a vertical electric field, and an oblique electric field). As the liquid crystal used for the liquid crystal element 251, thermotropic liquid crystal, low-molecular liquid crystal, high-molecular liquid crystal, polymer dispersed liquid crystal, ferroelectric liquid crystal, anti-ferroelectric liquid crystal, or the like can be used. These liquid crystal materials exhibit a cholesteric phase, a smectic phase, a cubic phase, a chiral nematic phase, an isotropic phase, or the like depending on conditions.

In the case where a horizontal electric field mode is employed, liquid crystal exhibiting a blue phase for which an alignment film is unnecessary may be used. A blue phase is one of liquid crystal phases, which is generated just before a cholesteric phase changes into an isotropic phase while temperature of cholesteric liquid crystal is increased. Since the blue phase appears only in a narrow temperature range, a liquid crystal composition in which several weight percent or more of a chiral material is mixed is used for the liquid crystal layer in order to improve the temperature range. The liquid crystal composition which includes liquid crystal exhibiting a blue phase and a chiral material has a short response time and has optical isotropy. In addition, the liquid crystal composition which includes liquid crystal exhibiting a blue phase and a chiral material does not need alignment treatment and has a small viewing angle dependence. An alignment film is not necessarily provided and rubbing treatment is thus not necessary; accordingly, electrostatic discharge damage caused by the rubbing treatment can be prevented, and defects and damage of the liquid crystal display device in the manufacturing process can be reduced.

The display device 200 including the liquid crystal element 251 can be driven in a twisted nematic (TN) mode, an in-plane-switching (IPS) mode, a fringe field switching (FFS) mode, an axially symmetric aligned micro-cell (ASM) mode, an optical compensated birefringence (OCB) mode, a ferroelectric liquid crystal (FLC) mode, an antiferroelectric liquid crystal (AFLC) mode, or the like.

The display device 200 may be a normally black liquid crystal display device such as a transmissive liquid crystal display device utilizing a vertical alignment (VA) mode. Examples of the vertical alignment mode include a multi-domain vertical alignment (MVA) mode, a patterned vertical alignment (PVA) mode, and an advanced super view (ASV) mode.

In this embodiment, horizontal electric field modes typified by an FFS mode and an IPS mode are mainly described.

In the pixel 270 illustrated in FIG. 9B, one of a source electrode and a drain electrode of the transistor 252 is electrically connected to the signal line 279, and the other is electrically connected to the one of the pair of electrodes of the liquid crystal element 251. A gate electrode of the transistor 252 is electrically connected to the scan line 277. The transistor 252 has a function of controlling whether to write a data signal.

In the pixel 270 illustrated in FIG. 9B, one of a pair of electrodes of the capacitor 255 is electrically connected to the other of the source electrode and the drain electrode of the transistor 252. The other of the electrodes of the capacitor 255 is electrically connected to the common line 275. The potential of the common line 275 is set as appropriate in accordance with the specifications of the pixel 270. The capacitor 255 has a function of a storage capacitor for storing written data. In the display device 200 driven in the FFS mode, the one of the electrodes of the capacitor 255 corresponds to part or the whole of the one of the electrodes of the liquid crystal element 251, and the other of the electrodes of the capacitor 255 corresponds to part or the whole of the other of the electrodes of the liquid crystal element 251.

<Example of Pixel Structure>

Figure 10:
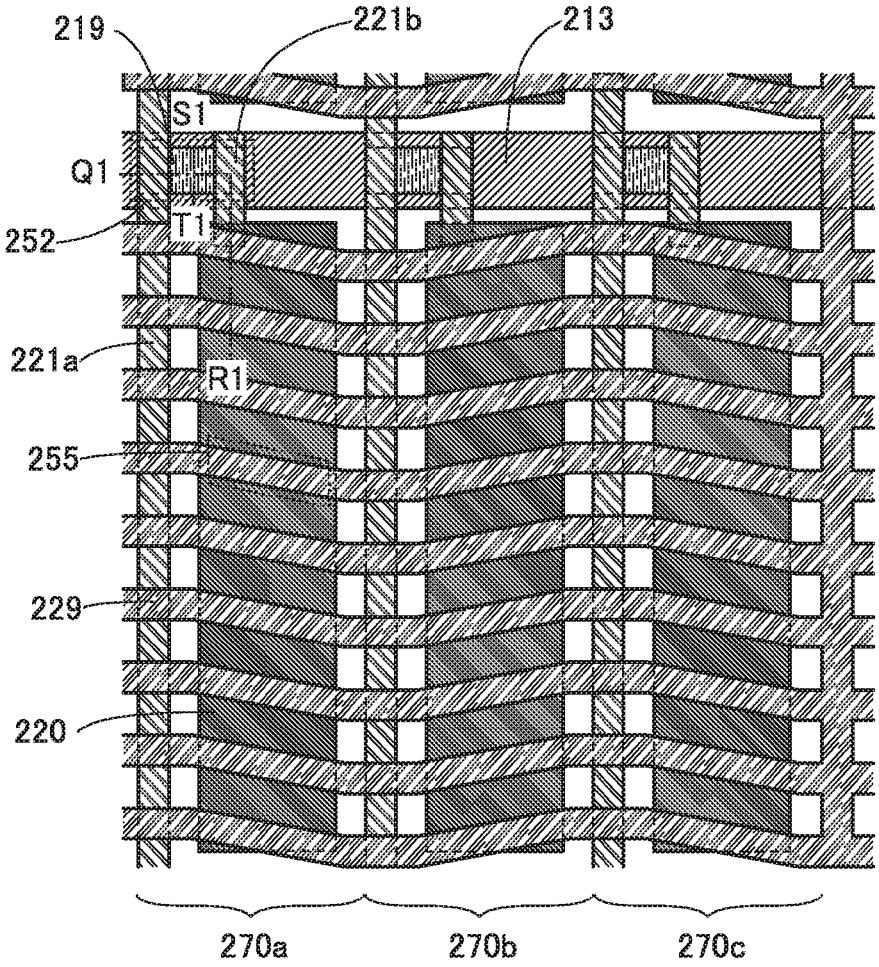
FIG. 10 is a top view illustrating the structure of pixels of one embodiment.

Next, a specific structure of a pixel included in the display device 200 is described. FIG. 10 is a top view illustrating pixels 270*a*, 270*b*, and 270*c* included in the display device 200 driven in the FFS mode.

In FIG. 10, a conductive film 213 functioning as a scan line extends substantially perpendicularly to the signal line (in the horizontal direction in the drawing). A conductive film 221*a* functioning as a signal line extends substantially perpendicularly to the scan line (in the vertical direction in the drawing). Note that the conductive film 213 functioning as a scan line is electrically connected to the scan line driver circuit 274, and the conductive film 221*a* functioning as a signal line is electrically connected to the signal line driver circuit 276 (see FIG. 9A).

The transistor 252 is provided near the intersection portion of the scan line and the signal line. The transistor 252 includes the conductive film 213 functioning as a gate electrode, a gate insulating film (not illustrated in FIG. 10), a semiconductor film 219, where a channel region is formed, over the gate insulating film, and the conductive film 221*a* and a conductive film 221*b* which function as a source electrode and a drain electrode. The conductive film 213 also functions as a scan line, and a region of the conductive film 213 that overlaps with the semiconductor film 219 functions as the gate electrode of the transistor 252. The conductive film 221*a* also functions as a signal line, and a region of the conductive film 221*a* that overlaps with the semiconductor film 219 functions as the source electrode or the drain electrode of the transistor 252. In the top view of FIG. 10, an end portion of the scan line is located on the outer side of an end portion of the semiconductor film 219. Thus, the scan line functions as a light-blocking film for blocking light from a light source such as a backlight. As a result, the semiconductor film 219 included in the transistor is not irradiated with light, so that variations in electrical characteristics of the transistor can be suppressed.

The conductive film 221*b* is electrically connected to a conductive film 220 having a function of a pixel electrode. A conductive film 229 is provided over the conductive film 220 with an insulating film (not illustrated in FIG. 10) positioned therebetween.

The conductive film 229 functions as a common electrode, for example. The conductive film 229 has stripe regions extending in a direction intersecting with the signal line. The stripe regions are connected to a region extending in a direction parallel or substantially parallel to the signal line. Therefore, in the plurality of pixels in the display device 200, the stripe regions of the conductive film 229 have the same potential.

The capacitor 255 is formed in a region where the conductive film 220 and the conductive film 229 overlap with each other. The conductive film 220 and the conductive film 229 have light-transmitting properties. That is, the capacitor 255 transmits light.

Since having a light-transmitting property, the capacitor 255 can be formed large (in a large area) in the pixel 270. Accordingly, a display device having capacitance increased while increasing the aperture ratio, typically 50% or more, preferably 60% or more, can be provided. For example, in a high-resolution display device such as a liquid crystal display device, the area of a pixel is small, and accordingly, the area of a capacitor is small. For this reason, the amount of charge accumulated in the capacitor is reduced in the high-resolution display device. However, since the capacitor 255 of this embodiment has a light-transmitting property, when the capacitor is provided in a pixel, enough capacitance can be obtained in the pixel and the aperture ratio can be increased. Typically, the capacitor 255 can be suitably used for a high-resolution display device with a pixel density of 200 ppi or more, 300 ppi or more, or furthermore, 500 ppi or more.

In a liquid crystal display device, the larger the capacitance value of a capacitor is, the longer a period can be in which the orientation of liquid crystal molecules of a liquid crystal element can be kept constant in the state where an electric field is applied. Since the period can be made longer, for displaying a still image, the number of times of rewriting image data can be reduced, leading to a reduction in power consumption. According to the structure of this embodiment, the aperture ratio can be improved even in a high-resolution display device, which makes it possible to use light from a light source such as a backlight efficiently, so that power consumption of the display device can be reduced.

Figure 11:
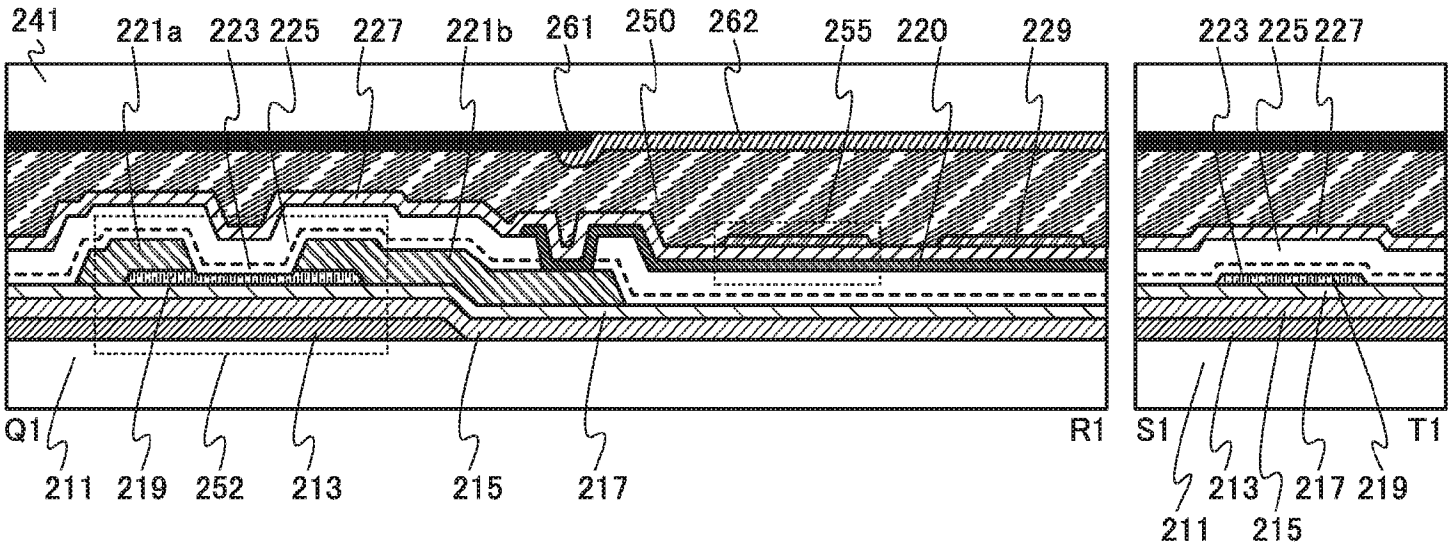
FIG. 11 illustrates a structural example of a display device of one embodiment.

FIG. 11 is a cross-sectional view taken along the dashed-dotted line Q1-R1 and the dashed-dotted line S1-T1 in FIG. 10. The transistor 252 illustrated in FIG. 11 is a channel-etched transistor. Note that the transistor 252 in the channel length direction and the capacitor 255 are illustrated in the cross-sectional view taken along the dashed-dotted line Q1-R1, and the transistor 252 in the channel width direction is illustrated in the cross-sectional view taken along the dashed-dotted line S1-T1.

The transistor 252 in FIG. 11 has a single-gate structure and includes the conductive film 213 functioning as a gate electrode over a substrate 211. The transistor 252 further includes an insulating film 215 formed over the substrate 211 and the conductive film 213 functioning as a gate electrode, an insulating film 217 formed over the insulating film 215, the semiconductor film 219 overlapping with the conductive film 213 functioning as a gate electrode with the insulating films 215 and 217 positioned therebetween, and the conductive films 221*a* and 221*b* functioning as the source electrode and the drain electrode which are in contact with the semiconductor film 219. An insulating film 223 is formed over the insulating film 217, the semiconductor film 219, and the conductive films 221*a* and 221*b* functioning as the source electrode and the drain electrode. An insulating film 225 is formed over the insulating film 223. The conductive film 220 is formed over the insulating film 225. The conductive film 220 is electrically connected to one of the conductive films 221*a* and 221*b* functioning as the source electrode and the drain electrode (here, the conductive film 221*b*) through an opening in the insulating film 223 and the insulating film 225. An insulating film 227 is formed over the insulating film 225 and the conductive film 220. The conductive film 229 is formed over the insulating film 227.

FIG. 11 illustrates the case where a liquid crystal layer 250 is interposed between a substrate 241 and the substrate 211. A light-blocking film 261 functioning as a black matrix, a color film 262 functioning as a color filter, and the like are provided on a surface of the substrate 241 facing the substrate 211.

The conductive film 220 may be provided over the insulating film 225 so as to overlap with the semiconductor film 219, in which case the transistor 252 has a double-gate structure in which the conductive film 220 is used as a second gate electrode.

A region where the conductive film 220, the insulating film 227, and the conductive film 229 overlap with each other functions as the capacitor 255.

Note that a cross-sectional view of one embodiment of the present invention is not limited thereto. The display device can have a variety of different structures. For example, the conductive film 220 may have a slit. Alternatively, the conductive film 220 may have a comb-like shape.

Figure 12:
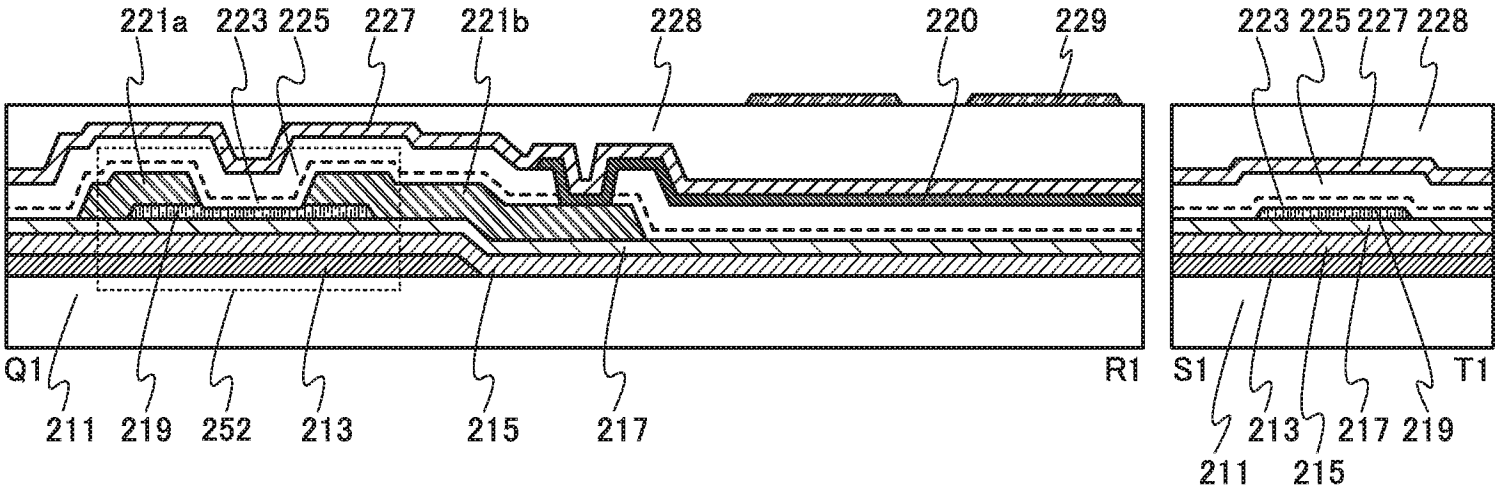
FIG. 12 illustrates a structural example of a display device of one embodiment.

As illustrated in FIG. 12, the conductive film 229 may be provided over an insulating film 228 over the insulating film 227. The insulating film 228 has a function of a planarization film.

<Modification Example of Pixel Structure>

Figure 13:
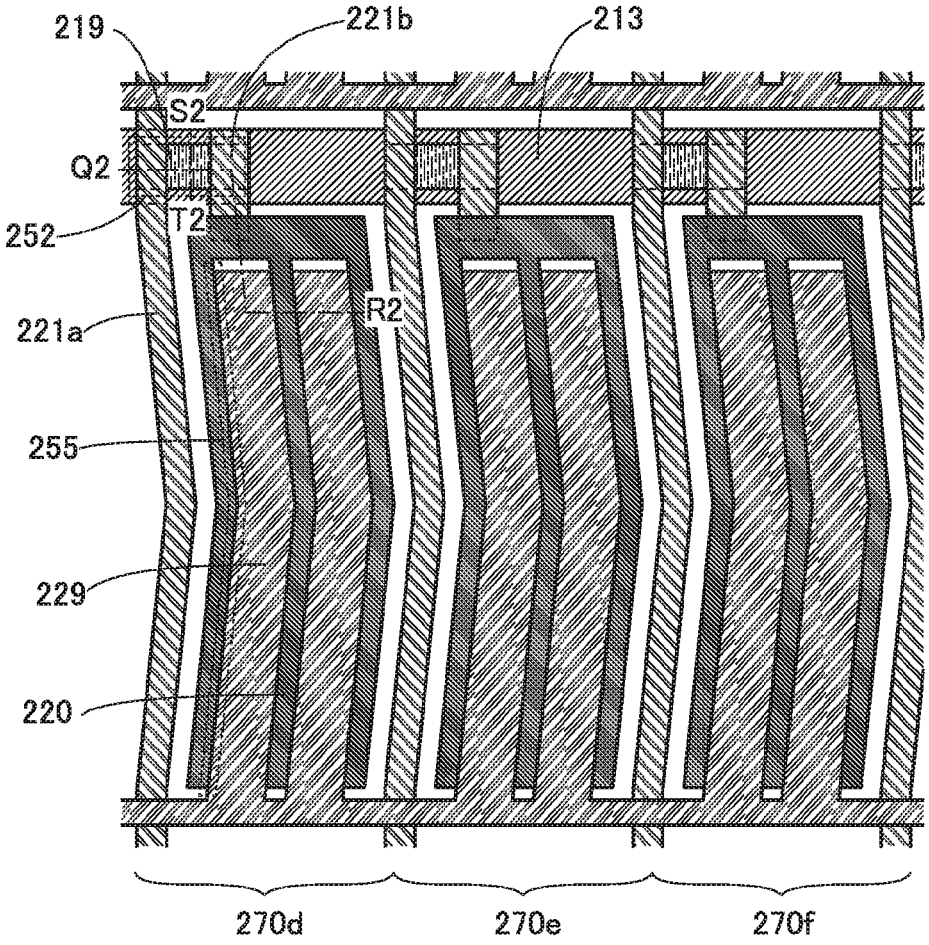
FIG. 13 is a top view illustrating the structure of pixels of one embodiment.

FIG. 13 is a top view illustrating pixels 270*d*, 270*e*, and 270*f* which are included in the display device 200 and are different from the pixels illustrated in FIG. 10. The display device 200 including the pixels illustrated in FIG. 13 is driven in an IPS mode.

In FIG. 13, the conductive film 213 functioning as a scan line extends in the horizontal direction in the drawing. The conductive film 221*a* functioning as a signal line extends substantially perpendicularly to the scan line (in the vertical direction in the drawing) and has partly a dogleg shape (V-like shape). Note that the conductive film 213 functioning as a scan line is electrically connected to the scan line driver circuit 274, and the conductive film 221*a* functioning as a signal line is electrically connected to the signal line driver circuit 276 (see FIG. 9A).

The transistor 252 is provided near the intersection portion of the scan line and the signal line. The transistor 252 includes the conductive film 213 functioning as a gate electrode, a gate insulating film (not illustrated in FIG. 13), a semiconductor film 219, where a channel region is formed, over the gate insulating film, and the conductive film 221*a* and a conductive film 221*b* which function as a source electrode and a drain electrode. The conductive film 213 also functions as a scan line, and a region of the conductive film 213 that overlaps with the semiconductor film 219 functions as the gate electrode of the transistor 252. The conductive film 221*a* also functions as a signal line, and a region of the conductive film 221*a* that overlaps with the semiconductor film 219 functions as the source electrode or the drain electrode of the transistor 252. In the top view of FIG. 13, an end portion of the scan line is located on the outer side of an end portion of the semiconductor film 219. Thus, the scan line functions as a light-blocking film for blocking light from a light source such as a backlight. As a result, the semiconductor film 219 included in the transistor is not irradiated with light, so that variations in electrical characteristics of the transistor can be suppressed.

The conductive film 221*b* is electrically connected to the conductive film 220 having a function of a pixel electrode. The conductive film 220 is formed in a comb-like shape. An insulating film (not illustrated in FIG. 13) is provided over the conductive film 220, and the conductive film 229 is provided over the insulating film. The conductive film 229 is formed in a comb-like shape to partly overlap and engage with the conductive film 220 when seen from the above. The conductive film 229 is electrically connected to a region extending in a direction parallel or substantially parallel to the scan line. Therefore, in the plurality of pixels in the display device 200, divided regions of the conductive film 229 have the same potential. Note that each of the conductive film 220 and the conductive film 229 has a dogleg shape (V-like shape) bent along the signal line (the conductive film 221*a*).

The capacitor 255 is formed in a region where the conductive film 220 and the conductive film 229 overlap with each other. The conductive film 220 and the conductive film 229 have light-transmitting properties. That is, the capacitor 255 transmits light.

Figure 14:
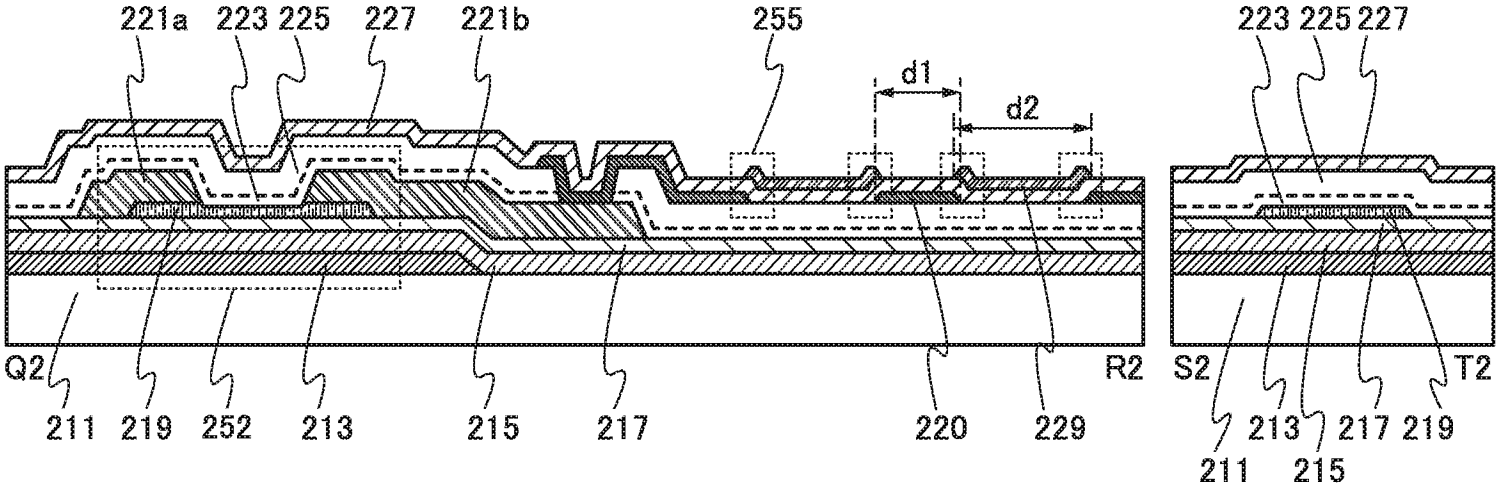
FIG. 14 illustrates a structural example of a display device of one embodiment.

FIG. 14 is a cross-sectional view taken along the dashed-dotted line Q2-R2 and the dashed-dotted line S2-T2 in FIG. 13. The transistor 252 illustrated in FIG. 14 is a channel-etched transistor. Note that the transistor 252 in the channel length direction and the capacitor 255 are illustrated in the cross-sectional view taken along the dashed-dotted line Q2-R2, and the transistor 252 in the channel width direction is illustrated in the cross-sectional view taken along the dashed-dotted line S2-T2.

The transistor 252 in FIG. 14 has a single-gate structure and includes the conductive film 213 functioning as a gate electrode over a substrate 211. The transistor 252 further includes an insulating film 215 formed over the substrate 211 and the conductive film 213 functioning as a gate electrode, an insulating film 217 formed over the insulating film 215, the semiconductor film 219 overlapping with the conductive film 213 functioning as a gate electrode with the insulating films 215 and 217 positioned therebetween, and the conductive films 221*a* and 221*b* functioning as the source electrode and the drain electrode which are in contact with the semiconductor film 219. An insulating film 223 is formed over the insulating film 217, the semiconductor film 219, and the conductive films 221*a* and 221*b* functioning as the source electrode and the drain electrode. An insulating film 225 is formed over the insulating film 223. The conductive film 220 is formed over the insulating film 225. The conductive film 220 is electrically connected to one of the conductive films 221*a* and 221*b* functioning as the source electrode and the drain electrode (here, the conductive film 221*b*) through an opening in the insulating film 223 and the insulating film 225. An insulating film 227 is formed over the insulating film 225 and the conductive film 220. The conductive film 229 is formed over the insulating film 227.

The conductive film 220 may be provided over the insulating film 225 so as to overlap with the semiconductor film 219, in which case the transistor 252 has a double-gate structure in which the conductive film 220 is used as a second gate electrode.

A region where the conductive film 220, the insulating film 227, and the conductive film 229 overlap with each other functions as the capacitor 255.

In the liquid crystal display device illustrated in FIG. 13 and FIG. 14, a capacitor in a pixel is formed in a region including an end portion of the conductive film 220 and an end portion of the conductive film 229 which overlap with each other. With this structure, a capacitor with a suitable size, not a too large size, can be formed in a large liquid crystal display device.

Figure 15:
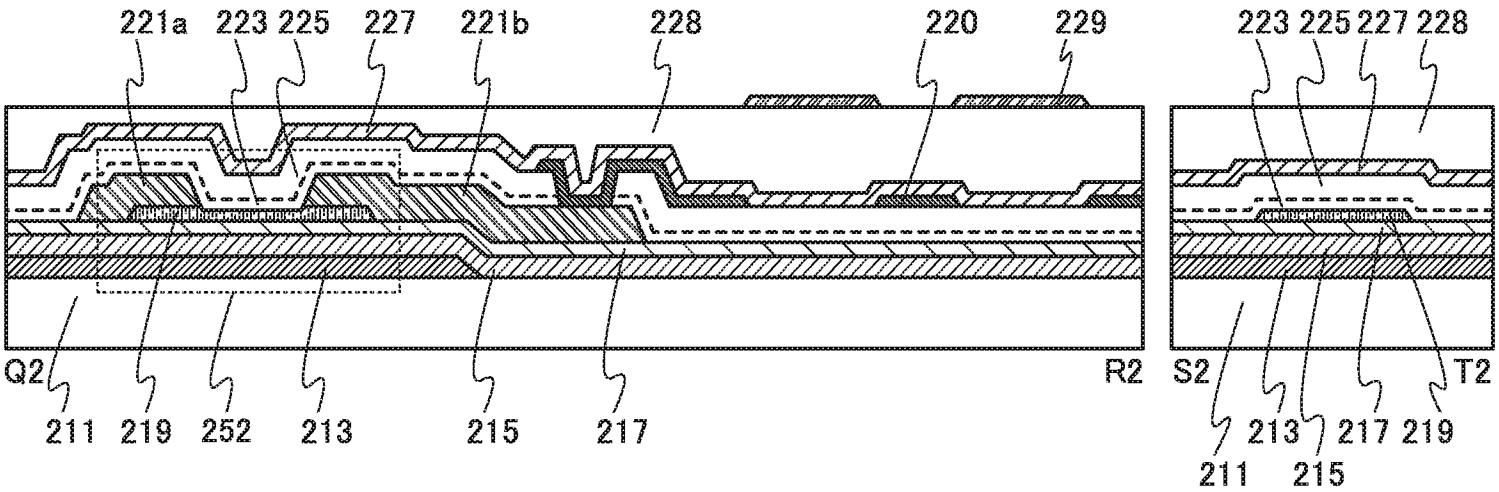
FIG. 15 illustrates a structural example of a display device of one embodiment.

As illustrated in FIG. 15, the conductive film 229 may be provided over an insulating film 228 over the insulating film 227.

Figure 16:
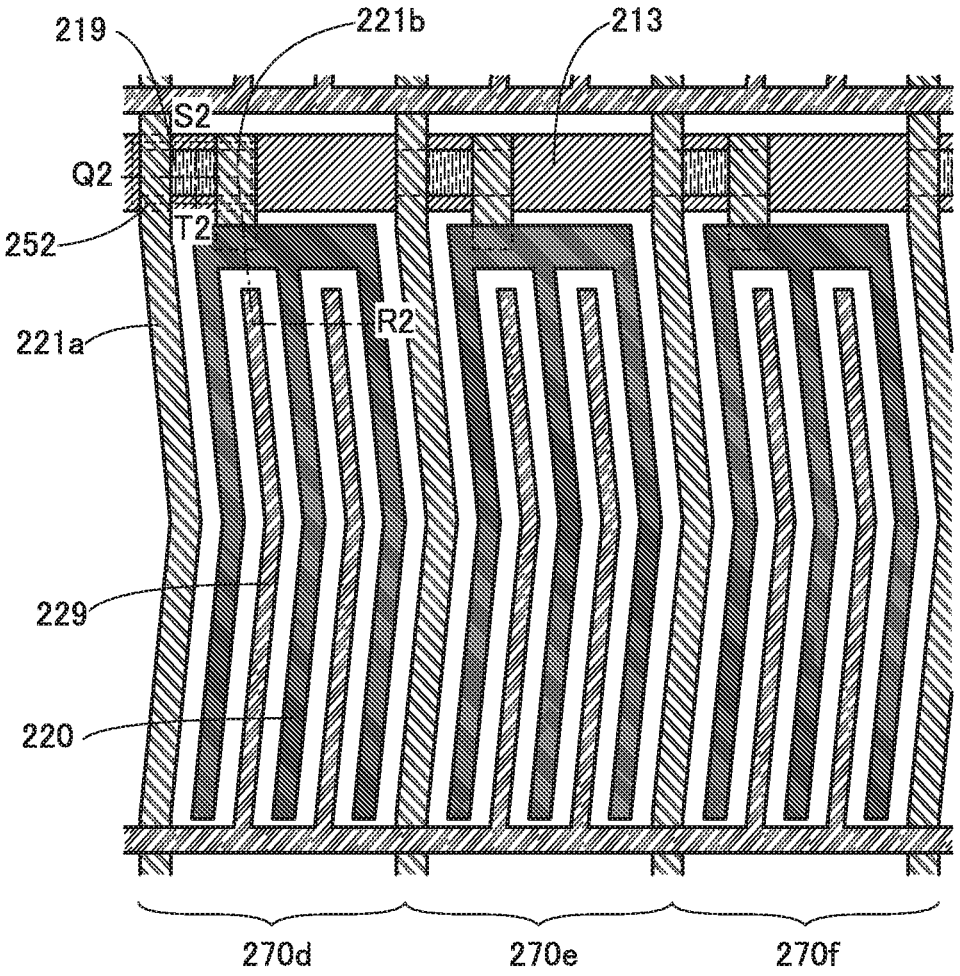
FIG. 16 is a top view illustrating the structure of pixels of one embodiment.
Figure 17:
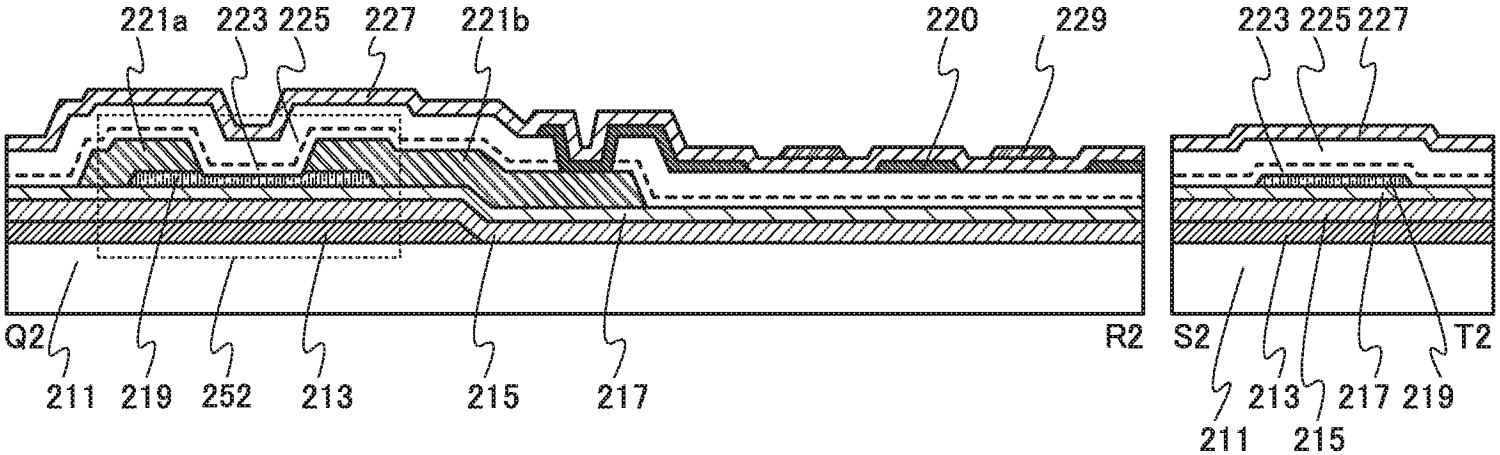
FIG. 17 illustrates a structural example of a display device of one embodiment.
Figure 18:
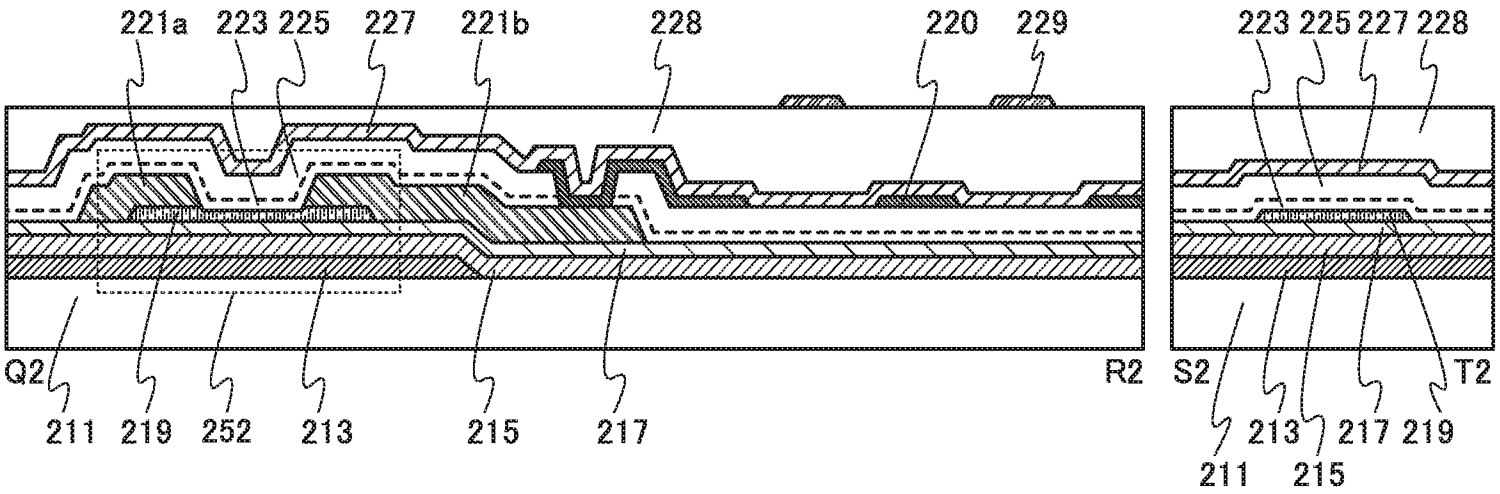
FIG. 18 illustrates a structural example of a display device of one embodiment.

As illustrated in FIG. 16 and FIG. 17, a structure in which the conductive film 220 and the conductive film 229 do not overlap with each other may be employed. The positions of the conductive film 220 and the conductive film 229 can be set as appropriate depending on the capacitance of the capacitor in accordance with the resolution and driving method of the display device. Note that the conductive film 229 in the display device illustrated in FIG. 17 may be provided over an insulating film 228 having a function of a planarization film (see FIG. 18).

Figure 19:
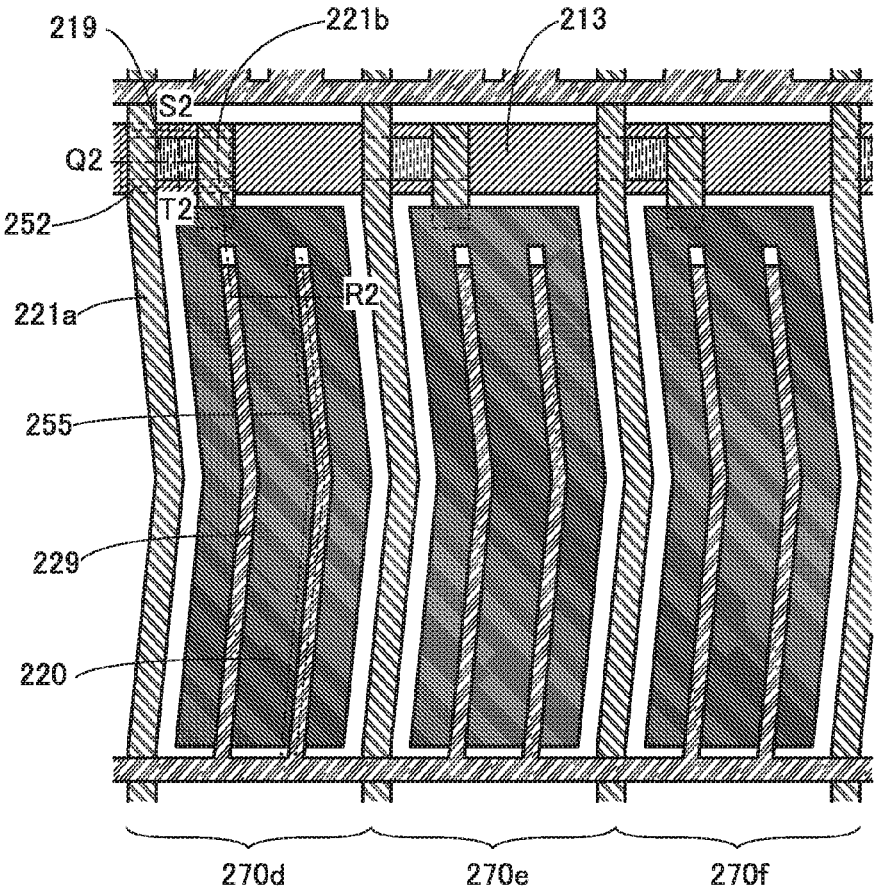
FIG. 19 is a top view illustrating the structure of pixels of one embodiment.
Figure 20:
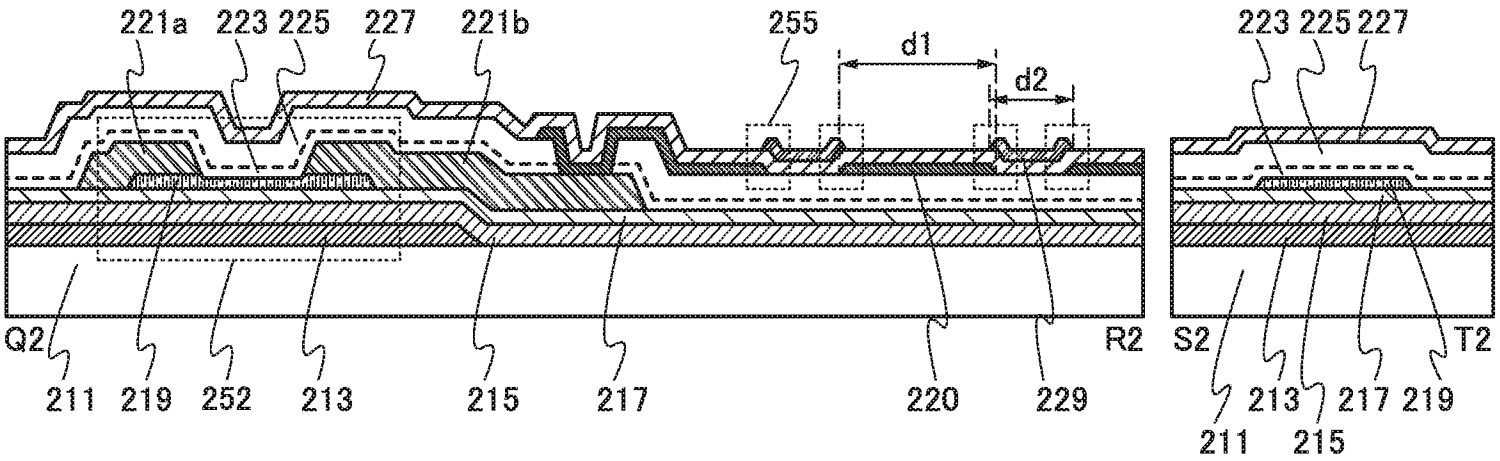
FIG. 20 illustrates a structural example of a display device of one embodiment.

In the liquid crystal display device illustrated in FIG. 13 and FIG. 14, a width (d1) of a region of the conductive film 220 extending in a direction parallel or substantially parallel to the signal line (the conductive film 221*a*) is smaller than a width (d2) of a region of the conductive film 229 extending in a direction parallel or substantially parallel to the signal line (see FIG. 14), but the widths are not limited to this relation. As illustrated in FIG. 19 and FIG. 20, the width d1 may be larger than the width d2. Alternatively, the width d1 may be equal to the width d2. Further alternatively, in a pixel (e.g., the pixel 270*d*), the widths of a plurality of regions extending in a direction parallel or substantially parallel to the signal line of the conductive film 220 and/or the conductive film 229 may be different from each other.

Figure 21:
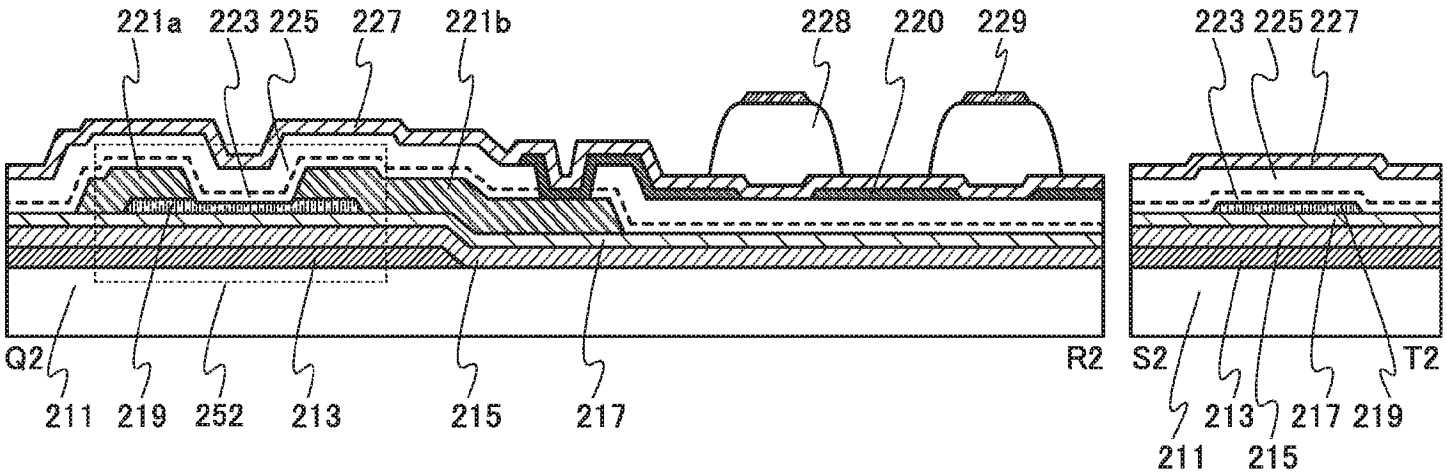
FIG. 21 illustrates a structural example of a display device of one embodiment.
Figure 22:
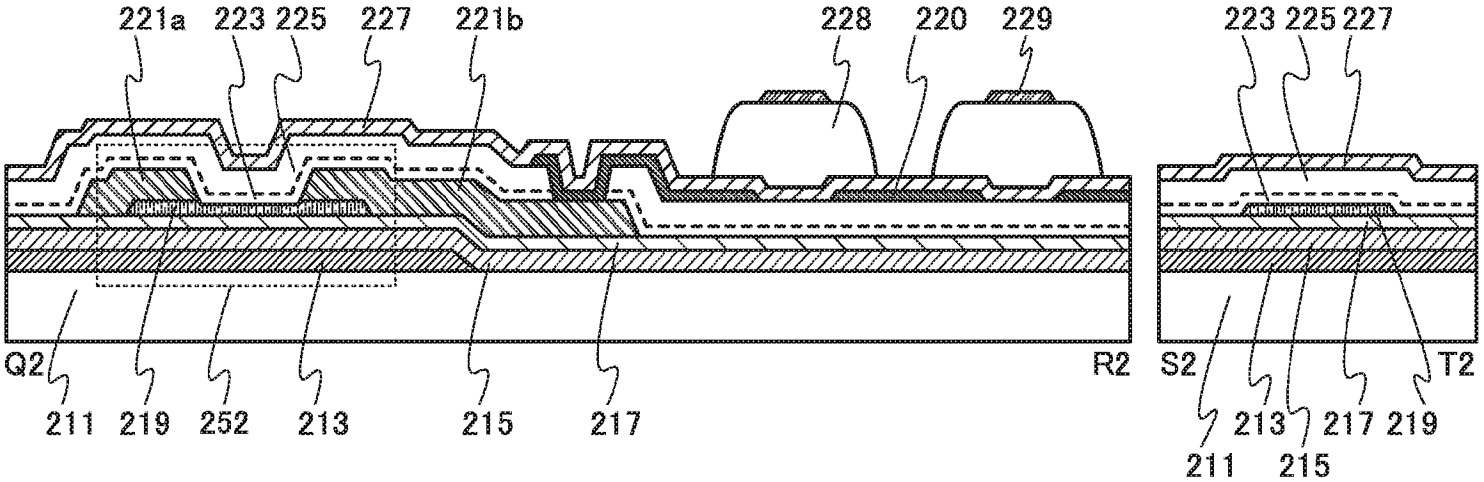
FIG. 22 illustrates a structural example of a display device of one embodiment.

As illustrated in FIG. 21, a structure in which the insulating film 228 over the insulating film 227 is removed such that only a region under the conductive film 229 is left may be employed. In that case, the insulating film 228 can be etched using the conductive film 229 as a mask. Unevenness of the conductive film 229 over the insulating film 228 having a function of a planarization film can be suppressed, and the insulating film 228 can have a gentle side surface from an end portion of the conductive film 229 to the insulating film 227. As illustrated in FIG. 22, a structure in which part of a surface of the insulating film 228 parallel to the substrate 211 is not covered with the conductive film 229 may also be employed.

Figure 23:
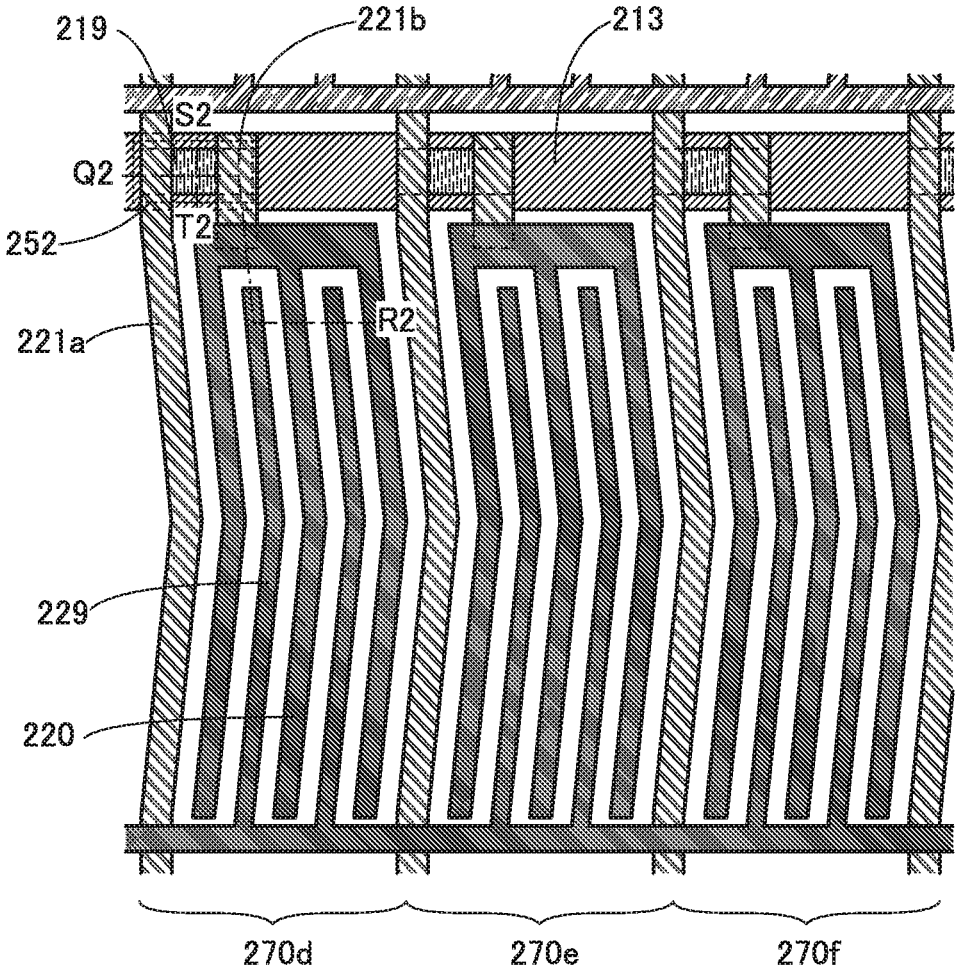
FIG. 23 is a top view illustrating the structure of pixels of one embodiment.
Figure 24:
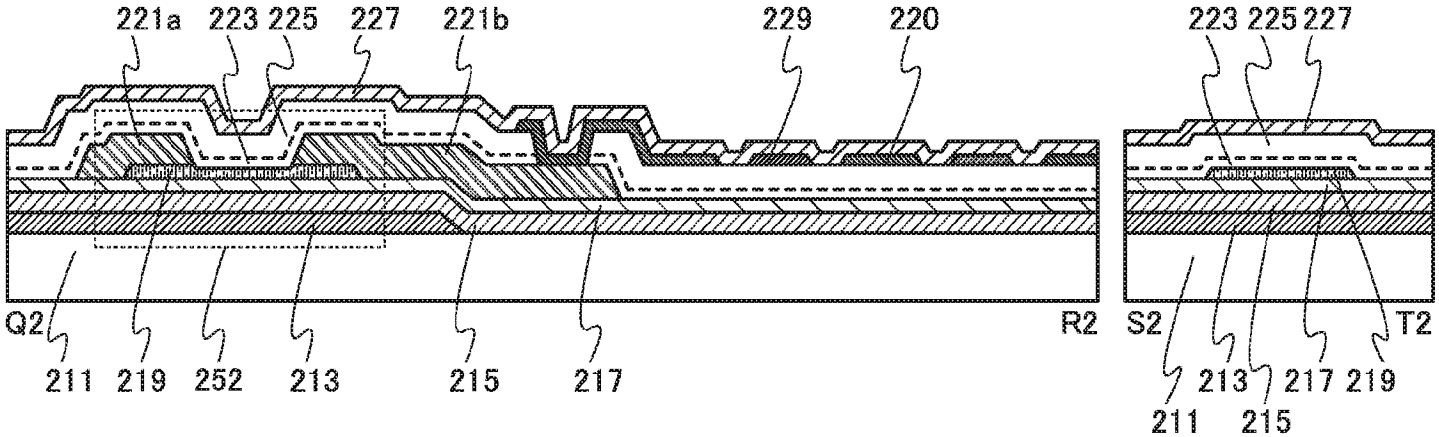
FIG. 24 illustrates a structural example of a display device of one embodiment.

As illustrated in FIG. 23 and FIG. 24, the conductive film 229 and the conductive film 220 may be formed over the same layer, that is, over the insulating film 225. The conductive film 229 illustrated in FIG. 23 and FIG. 24 can be formed with the same material at the same time as the conductive film 220.

The display device 200 can employ various modes and can include various display elements. Examples of the display element include a liquid crystal element, an electroluminescent (EL) element (e.g., an EL element including organic and inorganic materials, an organic EL element, or an inorganic EL element) including an LED (e.g., a white LED, a red LED, a green LED, or a blue LED), a transistor (a transistor that emits light depending on current), an electron-emitting element, an electrophoretic element, a display element using micro electro mechanical systems (MEMS) such as a grating light valve (GLV), a digital micromirror device (DMD), a digital micro shutter (DMS) element, a MIRASOL (registered trademark) display, an interferometric modulator display (IMOD) element, or a piezoelectric ceramic display, and an electrowetting element. Other than the above, the display device 200 may include display media whose contrast, luminance, reflectivity, transmittance, or the like is changed by electrical or magnetic effect. As the display element, quantum dots may also be used. An example of a display device including a liquid crystal element is a liquid crystal display (e.g., a transmissive liquid crystal display, a transflective liquid crystal display, a reflective liquid crystal display, a direct-view liquid crystal display, or a projection liquid crystal display). An example of a display device including an EL element is an EL display. Examples of a display device including an electron-emitting element are a field emission display (FED) and an SED-type flat panel display (SED: surface-conduction electron-emitter display). An example of a display device including quantum dots is a quantum dot display. An example of a display device including electronic ink or an electrophoretic element is electronic paper. In the case of a transflective liquid crystal display or a reflective liquid crystal display, some of or all of pixel electrodes function as reflective electrodes. For example, some or all of pixel electrodes are formed to contain aluminum, silver, or the like. In such a case, a memory circuit such as an SRAM can be provided under the reflective electrodes, leading to lower power consumption.

A progressive method, an interlace method, or the like can be employed as the display method of the display device 200. Color elements of pixels at the time of color display are not limited to three colors: R, G, and B (R, G, and B correspond to red, green, and blue, respectively). For example, one dot may be composed of four pixels: the R pixel, the G pixel, the B pixel, and a W (white) pixel. Alternatively, one dot may be composed of two colors among R, G, and B as in PenTile layout. The two colors may differ among dots. Alternatively, one or more colors of yellow, cyan, magenta, and the like may be added to RGB as a color element(s). Furthermore, the sizes of display regions of pixels in one dot may be different. Embodiments of the disclosed invention are not limited to a display device for color display; the disclosed invention can also be applied to a display device for monochrome display.

Color films (also referred to as color filters) may be used in a display device using white light (W) for a backlight (e.g., an organic EL element, an inorganic EL element, an LED, or a fluorescent lamp) in order to achieve a full-color display. For example, as the color films, a red (R) film, a green (G) film, a blue (B) film, a yellow (Y) film, and the like may be used in an appropriate combination. With the use of the color film, higher color reproducibility can be obtained than in the case without the color film. In that case, by providing a region with the color film and a region without the color film, white light in the region without the color film may be directly utilized for display. By partly providing the region without the color film, a decrease in luminance due to the color film can be suppressed, and 20% to 30% of power consumption can be reduced in some cases when an image is displayed brightly. Note that in the case where full-color display is performed using self-luminous elements such as organic EL elements or inorganic EL elements, the elements may emit light of their respective colors, R, G, B, Y, and white (W). By using self-luminous elements, power consumption can be further reduced as compared to the case of using the color film in some cases.

<Substrate>

There is no particular limitation on the property of a material and the like of the substrate 211 as long as the material has heat resistance high enough to withstand at least heat treatment to be performed later. For example, a glass substrate, a ceramic substrate, a quartz substrate, or a sapphire substrate may be used as the substrate 211. Alternatively, a single crystal semiconductor substrate or a polycrystalline semiconductor substrate made of silicon, silicon carbide, or the like, a compound semiconductor substrate made of silicon germanium or the like, an SOI (silicon on insulator) substrate, or the like may be used as the substrate 211. Furthermore, any of these substrates further provided with a semiconductor element may be used as the substrate 211. In the case where a glass substrate is used as the substrate 211, a large glass substrate having any of the following sizes can be used: the 6th generation (1500 mm×1850 mm), the 7th generation (1870 mm×2200 mm), the 8th generation (2200 mm×2400 mm), the 9th generation (2400 mm×2800 mm), and the 10th generation (2950 mm×3400 mm). Thus, a large-sized display device can be manufactured. Alternatively, a flexible substrate may be used as the substrate 211, and transistors, capacitors, and the like may be formed directly over the flexible substrate.

Other than the above, a transistor can be formed using any of various substrates as the substrate 211. There is no particular limitation on the type of a substrate. Examples of the substrate include a plastic substrate, a metal substrate, a stainless steel substrate, a substrate including stainless steel foil, a tungsten substrate, a substrate including tungsten foil, a flexible substrate, an attachment film, paper including a fibrous material, and a base film. Examples of the glass substrate include a barium borosilicate glass substrate, an aluminoborosilicate glass substrate, and a soda lime glass substrate. Examples of the flexible substrate include a flexible synthetic resin such as plastics typified by polyethylene terephthalate (PET), polyethylene naphthalate (PEN), and polyether sulfone (PES), and acrylic. Examples of the attachment film include polypropylene, polyester, polyvinyl fluoride, and polyvinyl chloride. Examples of the material for the base film include polyester, polyamide, polyimide, an inorganic vapor deposition film, and paper. Specifically, the use of semiconductor substrates, single crystal substrates, SOI substrates, or the like enables the manufacture of small-sized transistors with a small variation in characteristics, size, shape, or the like and with high current capability. A circuit using such transistors achieves lower power consumption of the circuit or higher integration of the circuit.

Note that a transistor may be formed using one substrate, and then the transistor may be transferred to another substrate. Examples of the substrate to which a transistor is transferred include, in addition to the above substrate over which the transistor can be formed, a paper substrate, a cellophane substrate, a stone substrate, a wood substrate, a cloth substrate (including a natural fiber (e.g., silk, cotton, or hemp), a synthetic fiber (e.g., nylon, polyurethane, or polyester), a regenerated fiber (e.g., acetate, cupra, rayon, or regenerated polyester), and the like), a leather substrate, and a rubber substrate. The use of such a substrate enables formation of a transistor with excellent properties, a transistor with low power consumption, or a device with high durability, high heat resistance, or a reduction in weight or thickness.

<Semiconductor Film>

The semiconductor film 219 preferably includes a film represented by an In-M-Zn oxide that contains at least indium (In), zinc (Zn), and M (a metal such as Al, Ti, Ga, Y, Zr, La, Ce, Sn, or Hf). In order to reduce variations in electrical characteristics of the transistor including the oxide semiconductor, the oxide semiconductor preferably contains a stabilizer.

Examples of the stabilizer, including metals that can be used as M, are gallium (Ga), tin (Sn), hafnium (Hf), aluminum (Al), and zirconium (Zr). Other examples of the stabilizer are lanthanoid such as lanthanum (La), cerium (Ce), praseodymium (Pr), neodymium (Nd), samarium (Sm), europium (Eu), gadolinium (Gd), terbium (Tb), dysprosium (Dy), holmium (Ho), erbium (Er), thulium (Tm), ytterbium (Yb), and lutetium (Lu).

As an oxide semiconductor included in the semiconductor film 219, any of the following can be used, for example: an In—Ga—Zn-based oxide, an In—Al—Zn-based oxide, an In—Sn—Zn-based oxide, an In—Hf—Zn-based oxide, an In—La—Zn-based oxide, an In—Ce—Zn-based oxide, an In—Pr—Zn-based oxide, an In—Nd—Zn-based oxide, an In—Sm—Zn-based oxide, an In—Eu—Zn-based oxide, an In—Gd—Zn-based oxide, an In—Tb—Zn-based oxide, an In—Dy—Zn-based oxide, an In—Ho—Zn-based oxide, an In—Er—Zn-based oxide, an In—Tm—Zn-based oxide, an In—Yb—Zn-based oxide, an In—Lu—Zn-based oxide, an In—Sn—Ga—Zn-based oxide, an In—Hf—Ga—Zn-based oxide, an In—Al—Ga—Zn-based oxide, an In—Sn—Al—Zn-based oxide, an In—Sn—Hf—Zn-based oxide, and an In—Hf—Al—Zn-based oxide.

Note that here, for example, an "In—Ga—Zn-based oxide" means an oxide containing In, Ga, and Zn as its main components, and there is no limitation on the ratio of In:Ga:Zn. The In—Ga—Zn-based oxide may contain another metal element in addition to In, Ga, and Zn.

The semiconductor film 219 and the conductive film 220 may include the same metal elements selected from metal elements contained in the above oxides. The use of the same metal elements for the semiconductor film 219 and the conductive film 220 can reduce the manufacturing cost. For example, when metal oxide targets with the same metal composition are used, the manufacturing cost can be reduced, and the same etching gas or the same etchant can be used in processing the semiconductor film 219 and the conductive film 220. Note that even when the semiconductor film 219 and the conductive film 220 include the same metal elements, they have different compositions in some cases. For example, a metal element in a film is released during the manufacturing process of the transistor and the capacitor, which might result in different metal compositions.

In the case where the semiconductor film 219 contains an In-M-Zn oxide, the proportions of In and M when the summation of In and M is assumed to be 100 atomic % are preferably as follows: the atomic percentage of In is higher than 25 atomic % and the atomic percentage of M is lower than 75 atomic %, more preferably, the atomic percentage of In is higher than 34 atomic % and the atomic percentage of M is lower than 66 atomic %.

The energy gap of the semiconductor film 219 is 2 eV or more, preferably 2.5 eV or more, more preferably 3 eV or more. With the use of an oxide semiconductor having such a wide energy gap, the off-state current of the transistor 252 can be reduced.

The thickness of the semiconductor film 219 is greater than or equal to 3 nm and less than or equal to 200 nm, preferably greater than or equal to 3 nm and less than or equal to 100 nm, more preferably greater than or equal to 3 nm and less than or equal to 50 nm.

In the case where the semiconductor film 219 contains an In-M-Zn oxide (M represents Al, Ga, Y, Zr, La, Ce, or Nd), it is preferable that the atomic ratio of metal elements of a sputtering target used for forming a film of the In-M-Zn oxide satisfy In≥M and Zn≥M. As the atomic ratio of metal elements of such a sputtering target, In:M:Zn=1:1:1, In:M:Zn=1:1:1.2, and In:M:Zn=3:1:2 are preferable. Note that the atomic ratio of metal elements in the formed semiconductor film 219 varies from the above atomic ratio of metal elements of the sputtering target within a range of ±40% as an error.

An oxide semiconductor film with a low carrier density is used as the semiconductor film 219. For example, an oxide semiconductor film whose carrier density is $1\times10^{17}/cm^3$ or lower, preferably $1\times10^{15}/cm^3$ or lower, more preferably $1\times10^{13}/cm^3$ or lower, more preferably $1\times10^{11}/cm^3$ or lower is used as the semiconductor film 219.

Note that, without limitation to those described above, a material with an appropriate composition may be used depending on required semiconductor characteristics and electrical characteristics (e.g., field-effect mobility and threshold voltage) of a transistor or variations in the semiconductor characteristics or electrical characteristics. To obtain the required semiconductor characteristics of the transistor, it is preferable that the carrier density, the impurity concentration, the defect density, the atomic ratio between a metal element and oxygen, the interatomic distance, the density, and the like of the semiconductor film 219 be set to appropriate values.

When silicon or carbon that is one of elements belonging to Group 14 is contained in the semiconductor film 219, oxygen vacancies are increased in the semiconductor film 219, and the semiconductor film 219 becomes n-type. Thus, the concentration of silicon or carbon (measured by secondary ion mass spectrometry (SIMS)) in the semiconductor film 219 is lower than or equal to $2\times10^{18}$ atoms/cm$^3$, preferably lower than or equal to $2\times10^{17}$ atoms/cm$^3$.

The concentration of an alkali metal or an alkaline earth metal in the semiconductor film 219, which is measured by SIMS, is lower than or equal to $1\times10^{18}$ atoms/cm$^3$, preferably lower than or equal to $2\times10^{16}$ atoms/cm$^3$. An alkali metal and an alkaline earth metal might generate carriers when bonded to an oxide semiconductor, in which case the off-state current of the transistor might be increased. Therefore, it is preferable to reduce the concentration of an alkali metal or an alkaline earth metal in the semiconductor film 219.

When nitrogen is contained in the semiconductor film 219, electrons serving as carriers are generated and the carrier density increases, so that the semiconductor film 219 easily becomes n-type. Thus, a transistor including an oxide semiconductor which contains nitrogen is likely to be normally on. For this reason, nitrogen in the oxide semiconductor film is preferably reduced as much as possible. For example, the concentration of nitrogen which is measured by SIMS is preferably set to lower than or equal to $5\times10^{18}$ atoms/$cm^3$.

The semiconductor film 219 may have, for example, a non-single crystal structure. Examples of the non-single crystal structure include a c-axis aligned crystalline oxide semiconductor (CAAC-OS) which is described later, a polycrystalline structure, a microcrystalline structure which is described later, and an amorphous structure. Among the non-single crystal structures, the amorphous structure has the highest density of defect states, whereas CAAC-OS has the lowest density of defect states.

The semiconductor film 219 may have an amorphous structure, for example. The oxide semiconductor film having an amorphous structure has disordered atomic arrangement and no crystalline component, for example. Alternatively, the oxide film having an amorphous structure has, for example, an absolutely amorphous structure and no crystal part.

Note that the semiconductor film 219 may be a mixed film including two or more of the following: a region having an amorphous structure, a region having a microcrystalline structure, a region having a polycrystalline structure, a CAAC-OS region, and a region having a single-crystal structure. The mixed film may have a stacked-layer structure of two or more of the following: a region having an amorphous structure, a region having a microcrystalline structure, a region having a polycrystalline structure, a CAAC-OS region, and a region having a single-crystal structure.

Examples of a material that can be used for the semiconductor film 219 further include silicon, germanium, and an organic semiconductor.

There is no particular limitation on the crystallinity of a semiconductor material used for the transistor, and an amorphous semiconductor or a semiconductor having crystallinity (a microcrystalline semiconductor, a polycrystalline semiconductor, a single-crystal semiconductor, or a semiconductor partly including crystal regions) may be used. It is preferable that a semiconductor having crystallinity be used, in which case deterioration of the transistor characteristics can be suppressed.

For example, the semiconductor film 219 preferably includes silicon. As the silicon, for example, amorphous silicon or silicon having crystallinity is preferably used. As the silicon having crystallinity, for example, microcrystalline silicon, polycrystalline silicon, single crystal silicon, or the like is preferably used. In particular, polycrystalline silicon can be formed at a lower temperature than single crystal silicon and has higher field effect mobility and higher reliability than amorphous silicon. With the use of such a polycrystalline semiconductor for a pixel, the aperture ratio of the pixel can be improved. Even in the case where pixels are provided at extremely high density, a gate driver circuit and a source driver circuit can be formed over a substrate over which the pixels are formed, and the number of components of an electronic device can be reduced.

The bottom-gate transistor described in this embodiment is preferable because the number of manufacturing steps can be reduced. In addition, since amorphous silicon can be formed at a lower temperature than polycrystalline silicon, when amorphous silicon is used for the semiconductor film 219, materials with low heat resistance can be used for an electrode and a substrate below the semiconductor film 219, so that the range of choices of materials can be widened. For example, the above-mentioned large glass substrate can be favorably used.

<Insulating Film>

As each of the insulating films 215 and 217 functioning as a gate insulating film of the transistor 252, an insulating film including at least one of the following films formed by a plasma chemical vapor deposition (CVD) method, a sputtering method, or the like can be used: a silicon oxide film, a silicon oxynitride film, a silicon nitride oxide film, a silicon nitride film, an aluminum oxide film, a hafnium oxide film, an yttrium oxide film, a zirconium oxide film, a gallium oxide film, a tantalum oxide film, a magnesium oxide film, a lanthanum oxide film, a cerium oxide film, and a neodymium oxide film. Note that the stacked structure of the insulating films 215 and 217 is not necessarily employed, and an insulating film with a single-layer structure selected from the above films may be used.

The insulating film 215 has a function of a blocking film that inhibits penetration of oxygen. For example, in the case where excess oxygen is supplied to the insulating film 217, the insulating film 223, the insulating film 225, and/or the semiconductor film 219, the insulating film 215 can inhibit penetration of oxygen.

Note that the insulating film 217 that is in contact with the semiconductor film 219 functioning as a channel region of the transistor 252 is preferably an oxide insulating film and preferably includes a region including oxygen in excess of the stoichiometric composition (an oxygen-excess region). In other words, the insulating film 217 is an insulating film capable of releasing oxygen. In order to provide the oxygen-excess region in the insulating film 217, the insulating film 217 may be formed in an oxygen atmosphere, for example. Alternatively, the oxygen-excess region may be formed by supplying oxygen to the formed insulating film 217. As a method for supplying oxygen, an ion implantation method, an ion doping method, a plasma immersion ion implantation method, plasma treatment, or the like can be employed.

In the case where hafnium oxide is used for the insulating films 215 and 217, the following effect is attained. Hafnium oxide has a higher dielectric constant than silicon oxide and silicon oxynitride. Therefore, the thicknesses of the insulating films 215 and 217 can be made large as compared with the case where silicon oxide is used; as a result, a leakage current due to a tunnel current can be low. That is, it is possible to provide a transistor with a low off-state current. Moreover, hafnium oxide with a crystalline structure has a higher dielectric constant than hafnium oxide with an amorphous structure. Therefore, it is preferable to use hafnium oxide with a crystalline structure in order to provide a transistor with a low off-state current. Examples of the crystalline structure include a monoclinic crystal structure and a cubic crystal structure. Note that one embodiment of the present invention is not limited to the above examples.

In this embodiment, a silicon nitride film is formed as the insulating film 215, and a silicon oxide film is formed as the insulating film 217. The silicon nitride film has a higher dielectric constant than a silicon oxide film and needs a larger thickness for capacitance equivalent to that of the silicon oxide film. Thus, when the silicon nitride film is included as the gate insulating film of the transistor 252, the physical thickness of the insulating film can be increased. Therefore, the electrostatic breakdown of the transistor 252 can be prevented by inhibiting a reduction in the withstand voltage of the transistor 252 and improving the withstand voltage of the transistor 252.

The insulating film 228 can be formed using, for example, a heat-resistant organic material, such as a polyimide resin, an acrylic resin, a polyimide amide resin, a benzocyclobutene resin, a polyamide resin, or an epoxy resin. For example, the insulating film 228 can be formed by forming an organic resin film over an insulating film, patterning the organic resin film into a desired region, and etching the insulating film to remove unnecessary regions.

<Gate Electrode, Source Electrode, and Drain Electrode>

The conductive films 213, 221*a*, and 221*b* can be formed to have a single-layer structure or a stacked-layer structure using any of metals such as aluminum, titanium, chromium, nickel, copper, yttrium, zirconium, molybdenum, silver, tantalum, and tungsten, or an alloy containing any of these metals as its main component. For example, a two-layer structure in which a titanium film is stacked over an aluminum film; a two-layer structure in which a titanium film is stacked over a tungsten film; a two-layer structure in which a copper film is stacked over a molybdenum film; a two-layer structure in which a copper film is stacked over an alloy film containing molybdenum and tungsten; a two-layer structure in which a copper film is stacked over an alloy film containing copper, magnesium, and aluminum; a three-layer structure in which an aluminum film or a copper film is stacked over a titanium film or a titanium nitride film, and a titanium film or a titanium nitride film is formed thereover; a three-layer structure in which an aluminum film or a copper film is stacked over a molybdenum film or a molybdenum nitride film, and a molybdenum film or a molybdenum nitride film is formed thereover; or the like can be employed. In the case where the conductive films 221*a* and 221*b* have a three-layer structure, it is preferable that each of the first and third layers be a film formed of titanium, titanium nitride, molybdenum, tungsten, an alloy containing molybdenum and tungsten, an alloy containing molybdenum and zirconium, or molybdenum nitride, and that the second layer be a film formed of a low-resistance material such as copper, aluminum, gold, silver, or an alloy containing copper and manganese. A light-transmitting conductive material such as indium tin oxide, indium oxide containing tungsten oxide, indium zinc oxide containing tungsten oxide, indium oxide containing titanium oxide, indium tin oxide containing titanium oxide, indium zinc oxide, or indium tin oxide to which silicon oxide is added may also be used. The materials that can be used for the conductive films 213, 221*a*, and 221*b* can be deposited by, for example, a sputtering method.

<Conductive Film>

The conductive film 229 has a function of a common electrode. A material having a property of transmitting visible light is used for the conductive film 229, for example. Specifically, a material including one of indium (In), zinc (Zn), and tin (Sn) is preferably used. For the conductive film 229, a light-transmitting conductive material such as indium oxide containing tungsten oxide, indium zinc oxide containing tungsten oxide, indium oxide containing titanium oxide, indium tin oxide containing titanium oxide, indium tin oxide (ITO), indium zinc oxide, or indium tin oxide to which silicon oxide is added can also be used. The conductive film 229 can be formed by a sputtering method, for example.

The conductive film 220 has a function of a pixel electrode. For the conductive film 220, a material similar to that of the conductive film 229 can be used.

Alternatively, for the conductive film 220, an oxide semiconductor similar to that of the semiconductor film 219 is preferably used. In that case, it is preferable that the conductive film 220 be formed to have a lower electric resistance than a region in the semiconductor film 219 where a channel is formed.

<Method for Controlling Resistivity of Oxide Semiconductor>

An oxide semiconductor film that can be used as each of the semiconductor film 219 and the conductive film 220 includes a semiconductor material whose resistivity can be controlled by oxygen vacancies in the film and/or the concentration of impurities such as hydrogen or water in the film. Accordingly, at least one of treatment for increasing oxygen vacancies and/or impurity concentration and treatment for reducing oxygen vacancies and/or impurity concentration is performed on the semiconductor film 219 and the conductive film 220, whereby the resistivity of each of the oxide semiconductor films can be controlled.

Specifically, plasma treatment is performed on the oxide semiconductor film used as the conductive film 220 functioning as the electrode of the capacitor 255 to increase oxygen vacancies and/or impurities such as hydrogen or water in the oxide semiconductor film, so that the oxide semiconductor film can have a high carrier density and low resistivity. Furthermore, an insulating film containing hydrogen is formed in contact with the oxide semiconductor film to diffuse hydrogen from the insulating film containing hydrogen (e.g., the insulating film 227) to the oxide semiconductor film, so that the oxide semiconductor film can have a high carrier density and low resistivity.

The semiconductor film 219 that functions as the channel region of the transistor 252 is not in contact with the insulating films 215 and 227 containing hydrogen because the insulating films 217, 223, and 225 are provided. With the use of an insulating film containing oxygen, in other words, an insulating film capable of releasing oxygen for at least one of the insulating films 217, 223, and 225, oxygen can be supplied to the semiconductor film 219. The semiconductor film 219 to which oxygen is supplied has high resistivity because oxygen vacancies in the film or at the interface are compensated. Note that as the insulating film capable of releasing oxygen, a silicon oxide film or a silicon oxynitride film can be used, for example.

In order to reduce the resistivity of the oxide semiconductor film, an ion implantation method, an ion doping method, a plasma immersion ion implantation method, or the like can be employed to inject hydrogen, boron, phosphorus, or nitrogen into the oxide semiconductor film.

In order to reduce the resistivity of the oxide semiconductor film, plasma treatment may be performed on the oxide semiconductor film. For the plasma treatment, a gas containing at least one of a rare gas (He, Ne, Ar, Kr, or Xe), hydrogen, and nitrogen is typically used. Specifically, plasma treatment in an Ar atmosphere, plasma treatment in a mixed gas atmosphere of Ar and hydrogen, plasma treatment in an ammonia atmosphere, plasma treatment in a mixed gas atmosphere of Ar and ammonia, plasma treatment in a nitrogen atmosphere, or the like can be employed.

In the oxide semiconductor film subjected to the plasma treatment, an oxygen vacancy is formed in a lattice from which oxygen is released (or in a portion from which oxygen is released). This oxygen vacancy can cause carrier generation. When hydrogen is supplied from an insulating film that is in the vicinity of the oxide semiconductor film (specifically, an insulating film that is in contact with the lower surface or the upper surface of the oxide semiconductor film), and hydrogen is bonded to the oxygen vacancy, an electron serving as a carrier might be generated.

The oxide semiconductor film in which oxygen vacancies are compensated with oxygen and the hydrogen concentration is reduced can be referred to as a highly purified intrinsic or substantially highly purified intrinsic oxide semiconductor film. Here, the term "substantially intrinsic" refers to a state where an oxide semiconductor film has a carrier density of lower than $8\times10^{11}/cm^3$, preferably lower than $1\times10^{11}/cm^3$, more preferably lower than $1\times10^{10}/cm^3$. A highly purified intrinsic or substantially highly purified intrinsic oxide semiconductor film has few carrier generation sources and can thus have a low carrier density. The highly purified intrinsic or substantially highly purified intrinsic oxide semiconductor film has a low density of defect states and can accordingly have a low density of trap states.

The highly purified intrinsic or substantially highly purified intrinsic oxide semiconductor film has an extremely low off-state current; even when an element has a channel width of $1\times10^6$ μm and a channel length of 10 μm, the off-state current can be lower than or equal to the measurement limit of a semiconductor parameter analyzer, i.e., lower than or equal to $1\times10^{-13}$ A, at a voltage (drain voltage) between a source electrode and a drain electrode ranging from 1 V to 10 V. Accordingly, the transistor 252 in which the channel region is formed in the semiconductor film 219 that is a highly purified intrinsic or substantially highly purified intrinsic oxide semiconductor film can have a small variation in electrical characteristics and high reliability.

For example, an insulating film containing hydrogen, in other words, an insulating film capable of releasing hydrogen, typically, a silicon nitride film, is used as the insulating film 227, whereby hydrogen can be supplied to the conductive film 220. The hydrogen concentration of the insulating film capable of releasing hydrogen is preferably higher than or equal to $1\times10^{22}$ atoms/$m^3$. Such an insulating film is formed in contact with the conductive film 220, whereby hydrogen can be effectively contained in the conductive film 220. In this manner, the resistivity of the oxide semiconductor film can be controlled by changing the structure of insulating films in contact with the semiconductor film 219 and the conductive film 220. Note that a material for the insulating film 215 may be similar to the material for the insulating film 227. When silicon nitride is used for the insulating film 215, oxygen released from the insulating film 217 can be prevented from being supplied to the conductive film 213, so that oxidation of the conductive film 213 can be inhibited.

Hydrogen contained in the oxide semiconductor film reacts with oxygen bonded to a metal atom to be water, and in addition, an oxygen vacancy is formed in a lattice from which oxygen is released (or in a portion from which oxygen is released). Due to entry of hydrogen into the oxygen vacancy, an electron serving as a carrier is generated in some cases. Furthermore, bonding of part of hydrogen to oxygen bonded to a metal atom causes generation of an electron serving as a carrier in some cases. Accordingly, the conductive film 220 formed in contact with the insulating film containing hydrogen is an oxide semiconductor film that has a higher carrier density than the semiconductor film 219.

In the semiconductor film 219 where the channel region of the transistor 252 is formed, it is preferable to reduce hydrogen as much as possible. Specifically, in the semiconductor film 219, the hydrogen concentration which is measured by SIMS is set to lower than or equal to $2\times10^{20}$ atoms/$cm^3$, preferably lower than or equal to $5\times10^{19}$ atoms/$cm^3$, more preferably lower than or equal to $1\times10^{19}$ atoms/$cm^3$, more preferably lower than or equal to $1\times10^{18}$ atoms/$cm^3$, more preferably lower than or equal to $5\times10^{17}$ atoms/$cm^3$, more preferably lower than or equal to $1\times10^{16}$ atoms/$cm^3$.

The conductive film 220 that functions as the electrode of the capacitor 255 is an oxide semiconductor film that has a higher hydrogen concentration and/or a larger number of oxygen vacancies (i.e., a lower resistivity) than the semiconductor film 219. The hydrogen concentration in the conductive film 220 is higher than or equal to $8\times10^{19}$ atoms/$cm^3$, preferably higher than or equal to $1\times10^{20}$ atoms/$cm^3$, more preferably higher than or equal to $5\times10^{20}$ atoms/$cm^3$. The hydrogen concentration in the conductive film 220 is greater than or equal to 2 times, preferably greater than or equal to 10 times the hydrogen concentration in the semiconductor film 219. The resistivity of the conductive film 220 is preferably greater than or equal to $1\times10^{-8}$ times and less than $1\times10^{-1}$ times the resistivity of the semiconductor film 219. The resistivity of the conductive film 220 is typically higher than or equal to $1\times10^{-3}$ Ωcm and lower than $1\times10^{4}$ Ωcm, preferably higher than or equal to $1\times10^{-3}$ Ωcm and lower than $1\times10^{-1}$ Ωcm.

<Protective Insulating Film>

As each of the insulating films 223, 225 and 227 functioning as a protective insulating film of the transistor 252, an insulating film including at least one of the following films formed by a plasma CVD method, a sputtering method, or the like can be used: a silicon oxide film, a silicon oxynitride film, a silicon nitride oxide film, a silicon nitride film, an aluminum oxide film, a hafnium oxide film, an yttrium oxide film, a zirconium oxide film, a gallium oxide film, a tantalum oxide film, a magnesium oxide film, a lanthanum oxide film, a cerium oxide film, and a neodymium oxide film.

Note that the insulating film 223 that is in contact with the semiconductor film 219 functioning as a channel region of the transistor 252 is preferably an oxide insulating film and preferably includes a region including oxygen in excess of the stoichiometric composition (an oxygen-excess region). In other words, the insulating film 223 is an insulating film capable of releasing oxygen. In order to provide the oxygen-excess region in the insulating film 223, the insulating film 223 may be formed in an oxygen atmosphere, for example. Alternatively, the oxygen-excess region may be formed by supplying oxygen to the formed insulating film 223. As a method for supplying oxygen, an ion implantation method, an ion doping method, a plasma immersion ion implantation method, plasma treatment, or the like can be employed.

The use of the insulating film capable of releasing oxygen as the insulating film 223 can reduce the number of oxygen vacancies in the semiconductor film 219 by transferring oxygen to the semiconductor film 219 functioning as the channel region of the transistor 252. For example, the number of oxygen vacancies in the semiconductor film 219 can be reduced by using an insulating film having the following feature: the number of oxygen molecules released from the insulating film by heat treatment at a film surface temperature of higher than or equal to 100° C. and lower than or equal to 700° C., or higher than or equal to 100° C. and lower than or equal to 500° C. is greater than or equal to $1.0\times10^{18}$ molecules/$cm^3$ when measured by thermal desorption spectroscopy (hereinafter referred to as TDS).

It is preferable that the number of defects in the insulating film 223 be small; typically, the spin density corresponding to a signal that appears at g=2.001 due to a dangling bond of silicon be lower than or equal to $3\times10^{17}$ spins/$cm^3$ by ESR measurement. This is because if the density of defects in the insulating film 223 is high, oxygen is bonded to the defects and the amount of oxygen that permeates the insulating film 223 is decreased. Furthermore, it is preferable that the amount of defects at the interface between the insulating film 223 and the semiconductor film 219 be small; typically, the spin density of a signal that appears at g=1.89 or more and 1.96 or less due to the defect in the semiconductor film 219 be lower than or equal to $1\times10^{17}$ spins/cm$^3$, more preferably lower than or equal to the lower limit of detection by ESR measurement.

Note that all oxygen entering the insulating film 223 from the outside moves to the outside of the insulating film 223 in some cases. Alternatively, some oxygen entering the insulating film 223 from the outside remains in the insulating film 223 in some cases. Furthermore, movement of oxygen occurs in the insulating film 223 in some cases in such a manner that oxygen enters the insulating film 223 from the outside and oxygen contained in the insulating film 223 moves to the outside of the insulating film 223. When an oxide insulating film which is permeable to oxygen is formed as the insulating film 223, oxygen released from the insulating film 225 provided over the insulating film 223 can be moved to the semiconductor film 219 through the insulating film 223.

The insulating film 223 can be formed using an oxide insulating film having a low density of states due to nitrogen oxide. Note that the density of states due to nitrogen oxide can be formed between the energy of the valence band maximum ($E_{v_os}$) and the energy of the conduction band minimum ($E_{c_os}$) of the oxide semiconductor film. A silicon oxynitride film that releases a small amount of nitrogen oxide, an aluminum oxynitride film that releases a small amount of nitrogen oxide, or the like can be used as the oxide insulating film.

Note that a silicon oxynitride film that releases a small amount of nitrogen oxide is a film of which the amount of released ammonia is larger than the amount of released nitrogen oxide in TDS; the number of released ammonia molecules is typically greater than or equal to $1\times10^{18}$ molecules/cm$^3$ and less than or equal to $5\times10^{19}$ molecules/cm$^3$. The amount of released ammonia corresponds to the released amount caused by heat treatment at a film surface temperature of higher than or equal to 50° C. and lower than or equal to 650° C., preferably higher than or equal to 50° C. and lower than or equal to 550° C.

Nitrogen oxide ($NO_x$; x is greater than 0 and less than or equal to 2, preferably greater than or equal to 1 and less than or equal to 2), typically $NO_2$ or NO, forms states in the insulating film 223, for example. The states are positioned in the energy gap of the semiconductor film 219. Therefore, when nitrogen oxide is diffused to the interface between the insulating film 223 and the semiconductor film 219, an electron is trapped by the state on the insulating film 223 side in some cases. As a result, the trapped electron remains in the vicinity of the interface between the insulating film 223 and the semiconductor film 219; thus, the threshold voltage of the transistor is shifted in the positive direction.

Nitrogen oxide reacts with ammonia and oxygen in heat treatment. Since nitrogen oxide contained in the insulating film 223 reacts with ammonia contained in the insulating film 225 in heat treatment, nitrogen oxide contained in the insulating film 223 is reduced. Therefore, an electron is hardly trapped at the interface between the insulating film 223 and the semiconductor film 219.

In a transistor using the oxide insulating film as the insulating film 223, the shift in threshold voltage can be reduced, which leads to a smaller variation in electrical characteristics of the transistor.

Note that in an ESR spectrum obtained at 100 K or lower of the insulating film 223, by heat treatment in a manufacturing process of the transistor, typically heat treatment at a temperature of lower than 400° C. or lower than 375° C. (preferably higher than or equal to 340° C. and lower than or equal to 360° C.), a first signal that appears at a g-factor of greater than or equal to 2.037 and less than or equal to 2.039, a second signal that appears at a g-factor of greater than or equal to 2.001 and less than or equal to 2.003, and a third signal that appears at a g-factor of greater than or equal to 1.964 and less than or equal to 1.966 are observed. The split width of the first and second signals and the split width of the second and third signals, which are obtained by ESR measurement using an X-band, are each approximately 5 mT. The sum of the spin densities of the first signal that appears at a g-factor of greater than or equal to 2.037 and less than or equal to 2.039, the second signal that appears at a g-factor of greater than or equal to 2.001 and less than or equal to 2.003, and the third signal that appears at a g-factor of greater than or equal to 1.964 and less than or equal to 1.966 is less than $1\times10^{18}$ spins/cm$^3$, typically greater than or equal to $1\times10^{17}$ spins/cm$^3$ and less than $1\times10^{18}$ spins/cm$^3$.

In the ESR spectrum at 100 K or lower, the first signal that appears at a g-factor of greater than or equal to 2.037 and less than or equal to 2.039, the second signal that appears at a g-factor of greater than or equal to 2.001 and less than or equal to 2.003, and the third signal that appears at a g-factor of greater than or equal to 1.964 and less than or equal to 1.966 correspond to signals attributed to nitrogen oxide ($NO_x$; x is greater than 0 and less than or equal to 2, preferably greater than or equal to 1 and less than or equal to 2). Typical examples of nitrogen oxide include nitrogen monoxide and nitrogen dioxide. In other words, the smaller the sum of the spin densities of the first signal that appears at a g-factor of greater than or equal to 2.037 and less than or equal to 2.039, the second signal that appears at a g-factor of greater than or equal to 2.001 and less than or equal to 2.003, and the third signal that appears at a g-factor greater than or equal to 1.964 and less than or equal to 1.966 is, the lower the content of nitrogen oxide in the oxide insulating film is.

The nitrogen concentration of the oxide insulating film measured by SIMS is lower than or equal to $6\times10^{20}$ atoms/cm$^3$.

The oxide insulating film is formed by a PECVD method at a substrate temperature of higher than or equal to 220° C. and lower than or equal to 350° C. using silane and dinitrogen monoxide, whereby a dense and hard film can be formed.

The insulating film 225 in contact with the insulating film 223 is formed using an oxide insulating film whose oxygen content is in excess of that in the stoichiometric composition. Part of oxygen is released from the oxide insulating film whose oxygen content is in excess of that in the stoichiometric composition by heating. The oxide insulating film whose oxygen content is in excess of that in the stoichiometric composition is an oxide insulating film of which the amount of released oxygen converted into oxygen atoms is greater than or equal to $1.0\times10^{19}$ atoms/cm$^3$, preferably greater than or equal to $3.0\times10^{20}$ atoms/cm$^3$ in TDS. Note that the temperature of the film surface in the TDS is preferably higher than or equal to 100° C. and lower than or equal to 700° C., or higher than or equal to 100° C. and lower than or equal to 500° C.

Furthermore, it is preferable that the amount of defects in the insulating film 225 be small; typically, the spin density of a signal that appears at g=2.001 due to a dangling bond of silicon be lower than $1.5\times10^{18}$ spins/cm$^3$, preferably lower than or equal to $1\times10^{18}$ spins/cm$^3$ by ESR measurement. Note that the insulating film 225 is provided more apart from the semiconductor film 219 than the insulating film 223 is; thus, the insulating film 225 may have higher defect density than the insulating film 223.

The thickness of the insulating film 223 can be greater than or equal to 5 nm and less than or equal to 150 nm, preferably greater than or equal to 5 nm and less than or equal to 50 nm, more preferably greater than or equal to 10 nm and less than or equal to 30 nm. The thickness of the insulating film 225 can be greater than or equal to 30 nm and less than or equal to 500 nm, preferably greater than or equal to 150 nm and less than or equal to 400 nm.

The insulating films 223 and 225 can be formed using insulating films formed of the same kinds of materials; thus, a boundary between the insulating films 223 and 225 cannot be clearly observed in some cases. Thus, in this embodiment, the boundary between the insulating films 223 and 225 is shown by a dashed line. Although a two-layer structure of the insulating films 223 and 225 is described in this embodiment, the present invention is not limited to this. For example, a single-layer structure of the insulating film 223, a single-layer structure of the insulating film 225, or a stacked-layer structure of three or more layers may be used.

The insulating film 227 functioning as a dielectric film of the capacitor 255 is preferably a nitride insulating film. The relative dielectric constant of a silicon nitride film is higher than that of a silicon oxide film, and the silicon nitride film needs to have a larger film thickness than the silicon oxide film to obtain a capacitance equivalent to that of the silicon oxide film. Thus, when the silicon nitride film is included as the insulating film 227 functioning as the dielectric film of the capacitor 255, the physical thickness of the insulating film can be increased. Therefore, the electrostatic breakdown of the capacitor 255 can be prevented by inhibiting a reduction in the withstand voltage of the capacitor 255 and improving the withstand voltage of the capacitor 255. Note that the insulating film 227 also has a function of decreasing the resistivity of the conductive film 220 that functions as the electrode of the capacitor 255.

The insulating film 227 has a function of blocking oxygen, hydrogen, water, an alkali metal, an alkaline earth metal, or the like. By providing the insulating film 227, it is possible to prevent outward diffusion of oxygen from the semiconductor film 219, outward diffusion of oxygen contained in the insulating films 223 and 225, and entry of hydrogen, water, or the like into the semiconductor film 219 from the outside. Note that instead of the nitride insulating film having a blocking effect against oxygen, hydrogen, water, an alkali metal, an alkaline earth metal, or the like, an oxide insulating film having a blocking effect against oxygen, hydrogen, water, or the like may be provided. As examples of the oxide insulating film having a blocking effect against oxygen, hydrogen, water, or the like, an aluminum oxide film, an aluminum oxynitride film, a gallium oxide film, a gallium oxynitride film, an yttrium oxide film, an yttrium oxynitride film, a hafnium oxide film, and a hafnium oxynitride film can be given.

At least part of this embodiment can be implemented in combination with any of the other embodiments described in this specification as appropriate.

Embodiment 3

In this embodiment, structural examples of a display device that can be used in the information processing device described in the above embodiment will be described.

Figure 25A:
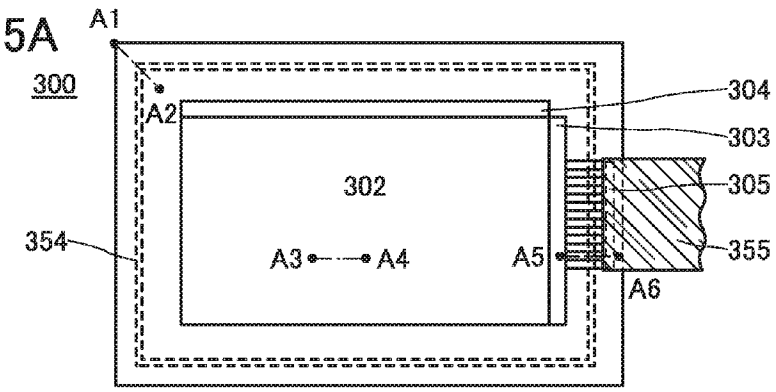
FIGS. 25A and 25B illustrate a structural example of a display device of one embodiment.
Figure 25B:
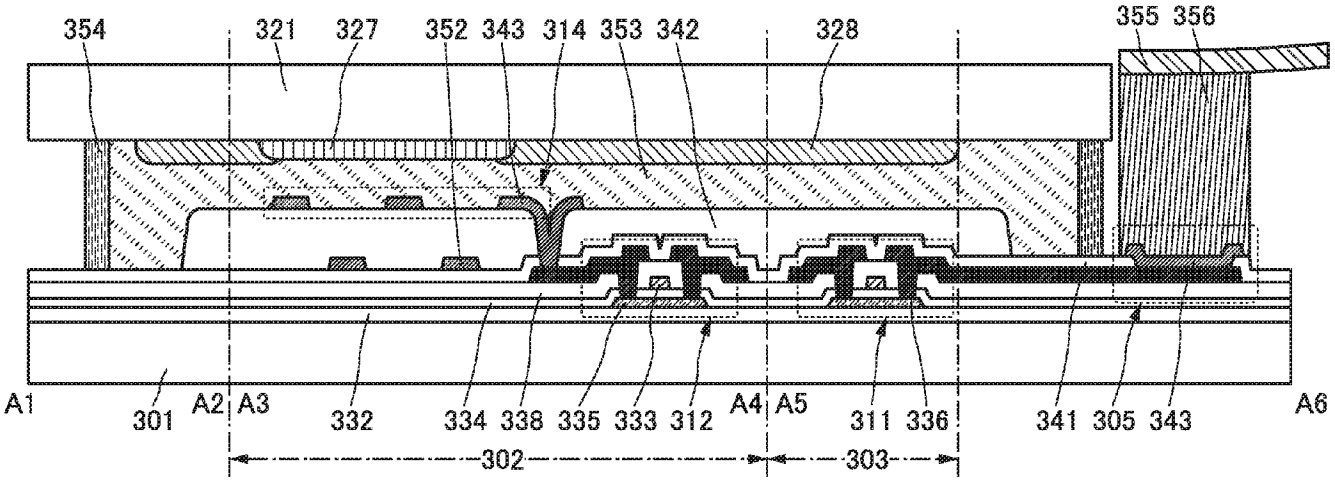

FIG. 25A is a schematic top view of a display device 300. FIG. 25B is a schematic cross-sectional view taken along the lines A1-A2, A3-A4, and A5-A6 in FIG. 25A. Note that in FIG. 25A, some components are not illustrated for clarity.

The display device 300 includes, over a top surface of a substrate 301, a display portion 302, a signal line driver circuit 303, a scan line driver circuit 304, and an external connection terminal 305.

The display portion 302 includes a liquid crystal element 314. In the liquid crystal element 314, the orientation of liquid crystal is controlled by an electric field generated in a direction parallel to the substrate surface.

The display device 300 includes an insulating layer 332, an insulating layer 334, an insulating layer 338, an insulating layer 341, an insulating layer 342, a transistor 311, a transistor 312, the liquid crystal element 314, a first electrode 343, a second electrode 352, a liquid crystal 353, a color filter 327, a light-blocking layer 328, a sealant 354, an FPC 355, an anisotropic conductive connection layer 356, and the like.

A pixel includes at least one switching transistor 312 and a storage capacitor that is not illustrated. The first electrode 343 with a comb-like shape that is electrically connected to one of a source electrode and a drain electrode of the transistor 312 is provided over the insulating layer 342. The second electrode 352 with a comb-like shape is provided over the insulating layer 341. The first electrode 343 and the second electrode 352 are apart from each other when seen from the above.

For at least one of the first electrode 343 and the second electrode 352, a light-transmitting conductive material is used. It is preferable to use a light-transmitting conductive material for both of these electrodes because the aperture ratio of the pixel can be increased.

The color filter 327 is provided such that it overlaps with the first electrode 343 and the second electrode 352. The light-blocking layer 328 is provided to cover a side surface of the color filter 327. The color filter 327 is provided on a substrate 321 in FIG. 25B, but the position of the color filter is not limited to this position.

The liquid crystal 353 is provided between the substrate 301 and the substrate 321. An image can be displayed in the following way: voltage is applied between the first electrode 343 and the second electrode 352 to generate an electric field in the substantially horizontal direction, orientation of the liquid crystal 353 is controlled by the electric field, and polarization of light from a backlight provided outside the display device is controlled in each pixel.

Alignment films for controlling the orientation of the liquid crystal 353 are preferably provided on surfaces in contact with the liquid crystal 353. A light-transmitting material is used for the alignment films. Although not illustrated here, polarizing plates are provided on the surfaces of the substrate 321 and the substrate 301 that do not face the liquid crystal element 314.

As the liquid crystal 353, a thermotropic liquid crystal, a low-molecular liquid crystal, a high-molecular liquid crystal, a ferroelectric liquid crystal, or an anti-ferroelectric liquid crystal can be used, for example. Moreover, a liquid crystal exhibiting a blue phase is preferably used, in which case an alignment film is not needed and a wide viewing angle can be obtained.

A high-viscosity and low-fluidity material is preferably used for the liquid crystal 353.

Although the liquid crystal element 314 using an IPS mode is described in this structural example, the mode of the liquid crystal element is not limited to this, and a twisted nematic (TN) mode, a fringe field switching (FFS) mode, an axially symmetric aligned micro-cell (ASM) mode, an optically compensated birefringence (OCB) mode, a ferroelectric liquid crystal (FLC) mode, an antiferroelectric liquid crystal (AFLC) mode, or the like can be used.

The transistors (the transistors 311 and 312 and the like) in the display device 300 are top-gate transistors. Each of the transistors includes a semiconductor layer 335, an insulating layer 334 functioning as a gate insulating layer, and a gate electrode 333. In addition, the insulating layer 338 is provided to cover the gate electrode 333. A pair of electrodes 336 are provided to be electrically connected to the semiconductor layer 335 through openings formed in the insulating layers 334 and 338.

Here, an oxide semiconductor is preferably used for the semiconductor layer 335. As the oxide semiconductor, for example, the oxide semiconductor described in the above embodiment can be used.

The semiconductor layer 335 may include a region functioning as a source region or a drain region, which has lower resistance than a region functioning as a channel. For example, the source region and the drain region can be provided such that the source region and the drain region are in contact with the pair of electrodes 336 or that the region functioning as a channel is sandwiched between the source region and the drain region. For example, the source region and the drain region may be regions whose resistivity is controlled by the method described in the above embodiment.

Transistors with small variations can be formed at a low temperature in a large area by using an oxide semiconductor for the semiconductor layer 335 compared with the case of using polycrystalline silicon, for example.

Figure 26A:
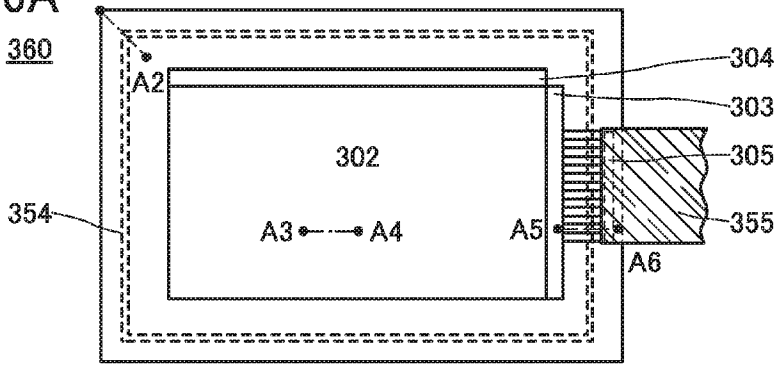
FIGS. 26A and 26B illustrate a structural example of a display device of one embodiment.
Figure 26B:
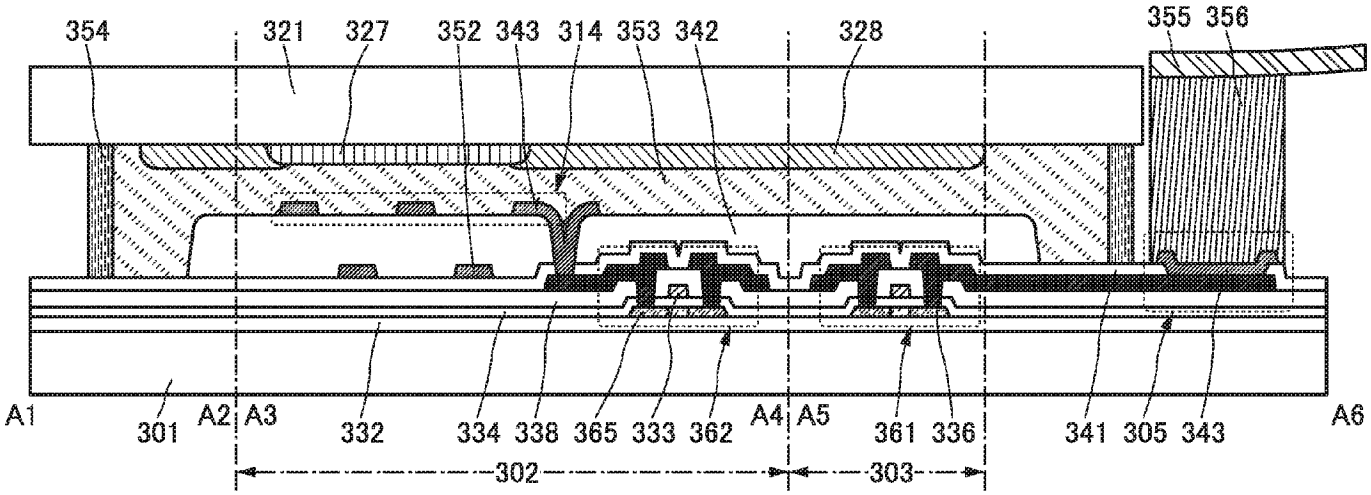

Silicon may be used for the semiconductor layer. FIG. 26A is a schematic top view of a display device 360 in which silicon is used for a semiconductor layer. FIG. 26B is a schematic cross-sectional view taken along the lines A1-A2, A3-A4, and A5-A6 in FIG. 26A. Note that in FIG. 26A, some components are not illustrated for clarity. Only components different from those of the display device 300 illustrated in FIGS. 25A and 25B are described below.

Transistors (a transistor 361, a transistor 362, and the like) in the display device 360 are top-gate transistors. Each of the transistors includes a semiconductor layer 365 including an impurity region functioning as a source region or a drain region, the insulating layer 334 functioning as a gate insulating layer, and the gate electrode 333. In addition, the insulating layer 338 is provided to cover the gate electrode 333. The pair of electrodes 336 are in contact with the source region and the drain region of the semiconductor layer 365 through openings formed in the insulating layers 334 and 338.

For the semiconductor layer 365, silicon is preferably used.

Although amorphous silicon may be used as silicon, silicon having crystallinity is particularly preferable. For example, microcrystalline silicon, polycrystalline silicon, single crystal silicon, or the like is preferably used. In particular, polycrystalline silicon can be formed at a lower temperature than single crystal silicon and has higher field effect mobility and higher reliability than amorphous silicon. With the use of such a polycrystalline semiconductor for a pixel, the aperture ratio of the pixel can be improved. Even in the case where pixels are densely provided per unit area, a gate driver circuit and a source driver circuit can be formed over a substrate over which the pixels are formed, and the number of components of an electronic device can be reduced.

In particular, when polycrystalline silicon or single crystal silicon transferred onto an insulating layer is used for the semiconductor layer, a top-gate structure is preferable. In that case, a material with low heat resistance can be used for a wiring or an electrode over the semiconductor layer, and a range of choices of the material can be widened. Note that when a high heat resistance material is used for a gate electrode or when polycrystalline silicon is formed at very low temperatures (e.g., lower than 450° C.), the bottom-gate structure described in the above embodiment is preferable because the number of manufacturing steps can be reduced.

Note that for a display device of one embodiment of the present invention, an active matrix method in which an active element is included in a pixel or a passive matrix method in which an active element is not included in a pixel can be used.

In the active matrix method, as an active element (a non-linear element), not only a transistor but also various active elements (non-linear elements) can be used. For example, a metal insulator metal (MIM) or a thin film diode (TFD) can be used. Such an element has few numbers of manufacturing steps; thus, the manufacturing cost can be reduced or yield can be improved. Furthermore, because the size of the element is small, the aperture ratio can be improved, leading to lower power consumption or higher luminance.

As a method other than the active matrix method, the passive matrix method in which an active element (a non-linear element) is not used may be used. Since an active element (a non-linear element) is not used, the number of manufacturing steps is small, so that the manufacturing cost can be reduced or yield can be improved. Furthermore, since an active element (a non-linear element) is not used, the aperture ratio can be improved, leading to lower power consumption or higher luminance.

At least part of this embodiment can be implemented in combination with any of the other embodiments described in this specification as appropriate.

Embodiment 4

In this embodiment, the configuration of a pixel circuit that can be used in a transmissive display device of one embodiment of the present invention will be described with reference to FIGS. 27A to 27C.

Figure 27A:
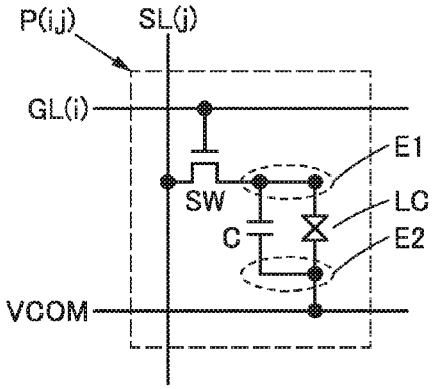
FIGS. 27A and 27B each illustrate a pixel circuit configuration and FIG. 27C is a top view illustrating a structure of pixels of one embodiment.

FIG. 27A is a circuit diagram illustrating an example of a pixel circuit P(i,j) for a pixel including a liquid crystal element.

Figure 27B:
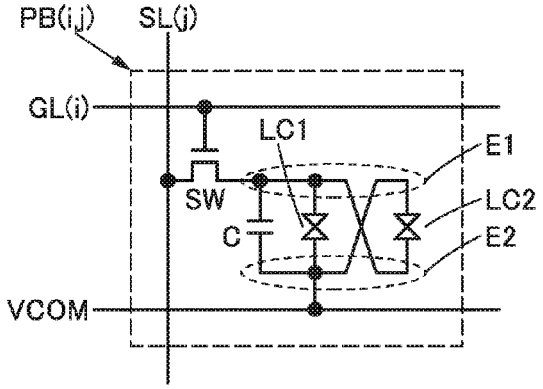
Figure 27C:
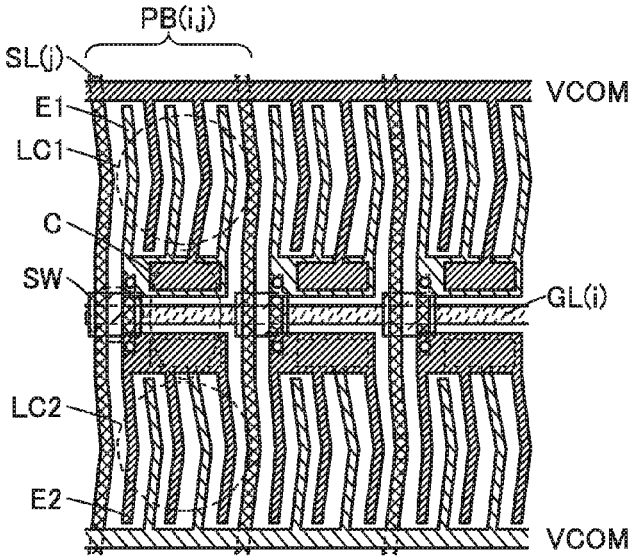

FIG. 27B is a circuit diagram illustrating an example of a pixel circuit PB(i,j) that has a configuration different from that of the pixel circuit P(i,j) illustrated in FIG. 27A. FIG. 27C is a top view illustrating an example of the layout of pixel circuits PB(i,j) each illustrated in FIG. 27B.

<Configuration Example 1 of Pixel Circuit>

The pixel circuit P(i,j) is electrically connected to a control line GL(i), a signal line SL(j), and a wiring VCOM and includes a transistor SW, a liquid crystal element LC, and a capacitor C (see FIG. 27A).

A gate of the transistor SW is electrically connected to the control line GL(i), and a first electrode of the transistor SW is electrically connected to the signal line SL(j).

A first electrode of the liquid crystal element LC is electrically connected to a second electrode of the transistor SW, and a second electrode of the liquid crystal element LC is electrically connected to the wiring VCOM.

A first electrode of the capacitor C is electrically connected to the second electrode of the transistor SW, and a second electrode of the capacitor C is electrically connected to the wiring VCOM.

The pixel circuit P(i,j) is provided over a substrate and includes the substrate, a second conductive film E2, and a first conductive film E1 between the substrate and the second conductive film E2.

For example, a light-transmitting conductive film can be used as the first conductive film and/or the second conductive film.

For example, the first conductive film E1 can be used for the first electrode of the liquid crystal element LC, and the second conductive film E2 can be used for the second electrode of the liquid crystal element LC.

For example, the first conductive film E1 can be used for the first electrode of the capacitor C, and the second conductive film E2 can be used for the second electrode of the capacitor C.

<Configuration Example 2 of Pixel Circuit>

The pixel circuit PB(i,j) is different from the pixel circuit P(i,j) illustrated in FIG. 27A in that a liquid crystal element LC1 and a liquid crystal element LC2 connected in parallel are provided instead of the liquid crystal element LC (see FIG. 27B). Different structures will be described in detail below, and the above description is referred to for other similar structures.

A first electrode of the liquid crystal element LC1 is electrically connected to the second electrode of the transistor SW, and a second electrode of the liquid crystal element LC1 is electrically connected to the wiring VCOM.

A second electrode of the liquid crystal element LC2 is electrically connected to the second electrode of the transistor SW, and a first electrode of the liquid crystal element LC2 is electrically connected to the wiring VCOM.

For example, the first conductive film E1 can be used for the first electrode of the liquid crystal element LC1, and the second conductive film E2 can be used for the second electrode of the liquid crystal element LC1. In addition, the first conductive film E1 can be used for the first electrode of the liquid crystal element LC2, and the second conductive film E2 can be used for the second electrode of the liquid crystal element LC2 (see FIG. 27C).

The pixel circuit PB(i,j) includes the liquid crystal element LC1 and the liquid crystal element LC2. The first electrode of the liquid crystal element LC1 includes the first conductive film E1 connected to the second electrode of the transistor SW, and the second electrode of the liquid crystal element LC1 includes the second conductive film E2 electrically connected to the wiring VCOM. The second electrode of the liquid crystal element LC2 includes the second conductive film E2 connected to the second electrode of the transistor SW, and the first electrode of the liquid crystal element LC2 includes the first conductive film E1 electrically connected to the wiring VCOM.

The liquid crystal element LC1 and the liquid crystal element LC2 are connected in parallel as described above. Accordingly, characteristics of the liquid crystal elements can be prevented from being asymmetric due to the positions of the first conductive film E1 and the second conductive film E2 even in the case where the liquid crystal elements are driven with the applied voltage inverted.

This embodiment can be combined with any of the other embodiments in this specification as appropriate.

Embodiment 5

In this embodiment, a display module and electronic devices that include the transmissive display device of one embodiment of the present invention will be described with reference to FIG. 28 and FIGS. 29A to 29G.

Figure 28:
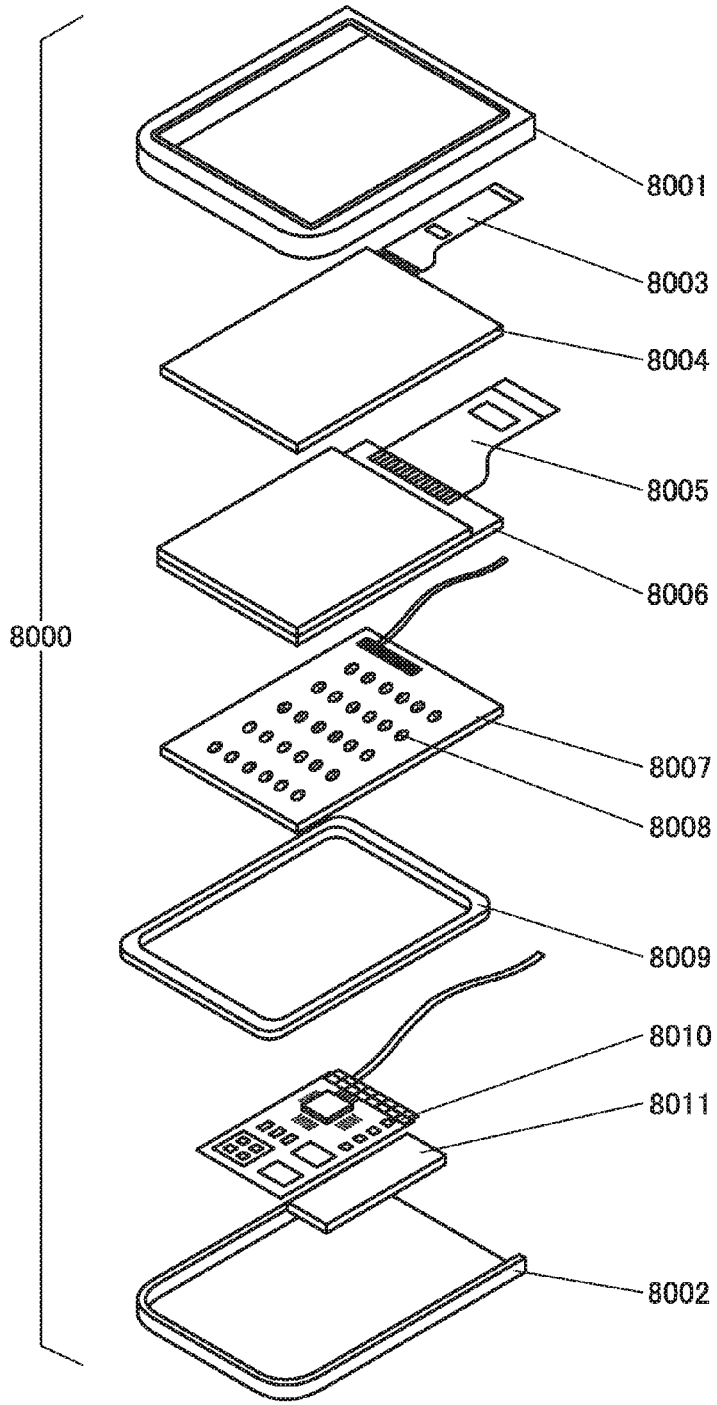
FIG. 28 illustrates a display module of one embodiment.

In a display module 8000 illustrated in FIG. 28, a touch panel 8004 connected to an FPC 8003, a display panel 8006 connected to an FPC 8005, a backlight 8007, a frame 8009, a printed board 8010, and a battery 8011 are provided between an upper cover 8001 and a lower cover 8002.

The display device of one embodiment of the present invention can be used for, for example, the display panel 8006.

The shapes and sizes of the upper cover 8001 and the lower cover 8002 can be changed as appropriate in accordance with the sizes of the touch panel 8004 and the display panel 8006.

The touch panel 8004 can be a resistive touch panel or a capacitive touch panel and may be formed so as to overlap with the display panel 8006. Alternatively, a counter substrate (sealing substrate) of the display panel 8006 can have a touch panel function. Further alternatively, a photosensor may be provided in each pixel of the display panel 8006 to form an optical touch panel.

The backlight 8007 includes a light source 8008. Although the light source 8008 is provided over the backlight 8007 in FIG. 28, one embodiment of the present invention is not limited to this structure. For example, a structure in which the light source 8008 is provided at an end portion of the backlight 8007 and a light diffusion plate is further provided may be employed.

The frame 8009 protects the display panel 8006 and functions as an electromagnetic shield for blocking electromagnetic waves generated by the operation of the printed board 8010. The frame 8009 can also function as a radiator plate.

The printed board 8010 is provided with a power supply circuit and a signal processing circuit for outputting a video signal and a clock signal. As a power source for supplying power to the power supply circuit, an external commercial power source or a power source using the battery 8011 provided separately may be used. The battery 8011 can be omitted in the case of using a commercial power source.

The display module 8000 may be additionally provided with a component such as a polarizing plate, a retardation plate, or a prism sheet.

FIGS. 29A to 29G illustrate electronic devices. These electronic devices can include a housing 5000, a display portion 5001, a speaker 5003, an LED lamp 5004, operation keys 5005 (including a power switch or an operation switch), a connection terminal 5006, a sensor 5007 (a sensor having a function of measuring force, displacement, position, speed, acceleration, angular velocity, rotational frequency, distance, light, liquid, magnetism, temperature, chemical substance, sound, time, hardness, electric field, current, voltage, electric power, radiation, flow rate, humidity, gradient, oscillation, odor, or infrared rays), a microphone 5008, and the like.

Figure 29A:
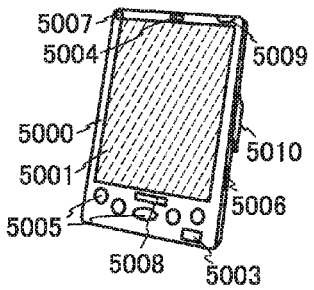
FIGS. 29A to 29G each illustrate an electronic device of one embodiment.
Figure 29B:
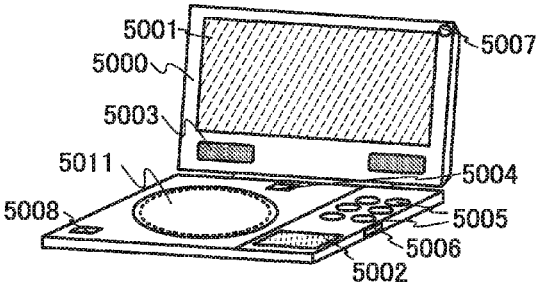
Figure 29C:
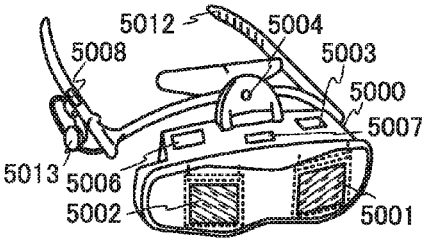
Figure 29D:
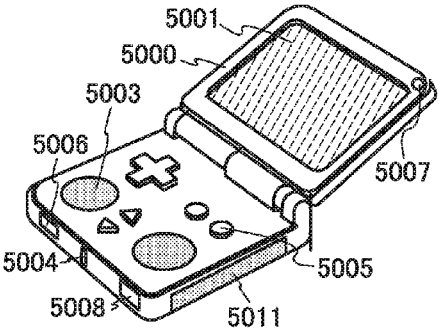
Figure 29E:
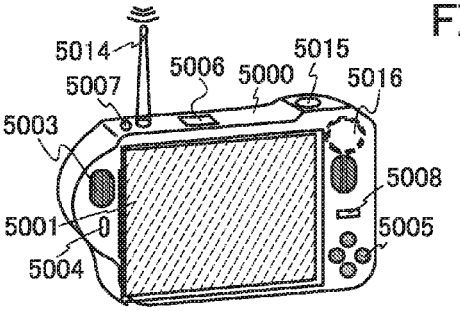
Figure 29F:
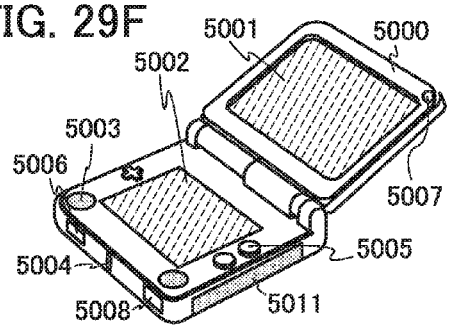
Figure 29G:
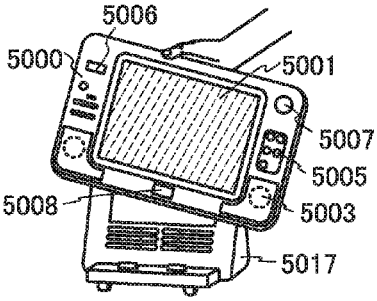

FIG. 29A illustrates a mobile computer, which can include a switch 5009, an infrared port 5010, and the like in addition to the above components. FIG. 29B illustrates a portable image reproducing device provided with a recording medium (e.g., a DVD reproducing device), which can include a second display portion 5002, a recording medium read portion 5011, and the like in addition to the above components. FIG. 29C illustrates a goggle-type display, which can include the second display portion 5002, a support 5012, an earphone 5013, and the like in addition to the above components. FIG. 29D illustrates a portable game machine, which can include the recording medium read portion 5011 and the like in addition to the above components. FIG. 29E illustrates a digital camera which has a television reception function and can include an antenna 5014, a shutter button 5015, an image receive portion 5016, and the like in addition to the above components. FIG. 29F illustrates a portable game machine, which can include the second display portion 5002, the recording medium read portion 5011, and the like in addition to the above components. FIG. 29G illustrates a portable television receiver, which can include a charger 5017 capable of transmitting and receiving signals, and the like in addition to the above components.

The electronic devices illustrated in FIGS. 29A to 29G can have a variety of functions, for example, a function of displaying a variety of information (e.g., a still image, a moving image, and a text image) on a display portion, a touch panel function, a function of displaying a calendar, date, time, and the like, a function of controlling processing with a variety of software (programs), a wireless communication function, a function of being connected to a variety of computer networks with a wireless communication function, a function of transmitting and receiving a variety of data with a wireless communication function, and a function of reading a program or data stored in a recording medium and displaying the program or data on a display portion.

Furthermore, the electronic device including a plurality of display portions can have a function of displaying image information mainly on one display portion while displaying text information mainly on another display portion, a function of displaying a three-dimensional image by displaying images where parallax is considered on a plurality of display portions, or the like. Furthermore, the electronic device including an image receive portion can have a function of photographing a still image, a function of photographing a moving image, a function of automatically or manually correcting a photographed image, a function of storing a photographed image in a recording medium (an external recording medium or a recording medium incorporated in a camera), a function of displaying a photographed image on the display portion, or the like. Note that functions that can be provided for the electronic devices illustrated in FIGS. 29A to 29G are not limited to the above, and the electronic devices can have a variety of functions.

The electronic devices described in this embodiment are characterized by including a display portion for displaying some sort of information. The display device described in the above embodiment can be employed for the display portion.

At least part of this embodiment can be implemented in combination with any of the other embodiments described in this specification as appropriate.

Example

In this example, an information processing device of one embodiment of the present invention will be described with reference to FIGS. 30A to 30C, FIGS. 31A to 31C, and FIGS. 32A and 32B.

Figure 30A:
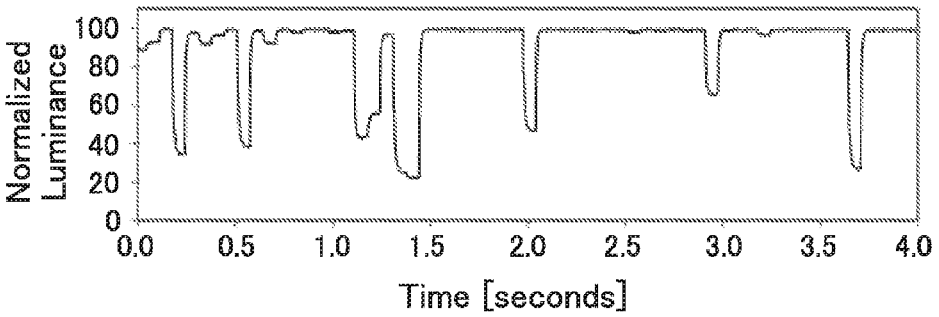
FIGS. 30A to 30C show changes in luminance of a display device described in Example.
Figure 30B:
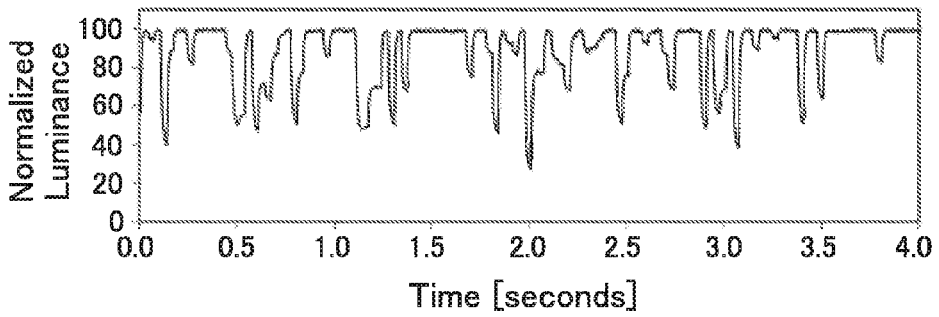
Figure 30C:
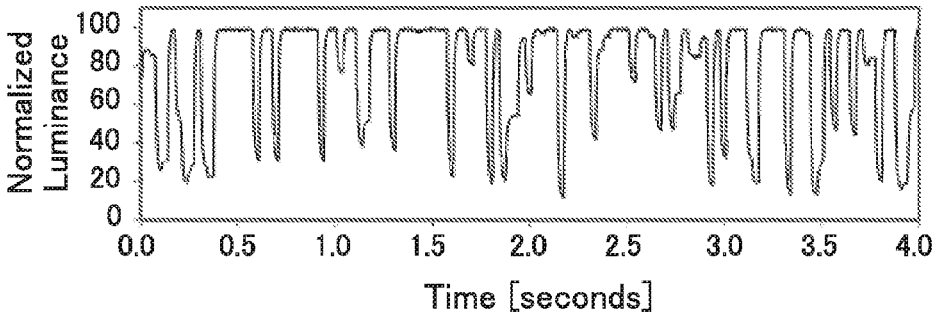

FIGS. 30A to 30C show the measurement results of luminance changes in a 100-μm-diameter region of a display device. Note that a text image was displayed in the display device while being scrolled. The text image includes 25 lines per page. Each line includes 49 letters with a font size of 20 points.

FIG. 30A shows a change in luminance observed when the text image was displayed while being scrolled at a speed of 2.5 pages/sec.

FIG. 30B shows a change in luminance observed when the letters in the text image were displayed with a higher gray level than that in FIG. 30A (specifically, the luminance of the letters was approximately 50% of that of the background image) while the text image was scrolled at a speed of 5 pages/sec.

FIG. 30C shows a change in luminance observed when the letters in the text image were displayed with the same gray level as that in FIG. 30A while the text image was scrolled at a speed of 5 pages/sec.

Figure 31A:
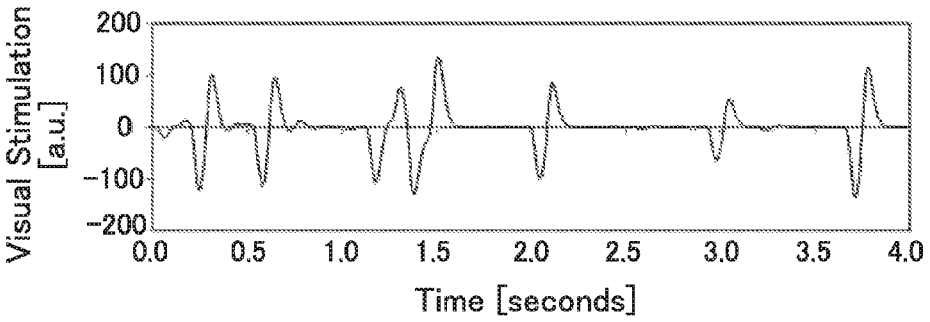
FIGS. 31A to 31C show changes in visual stimulation described in Example.
Figure 31B:
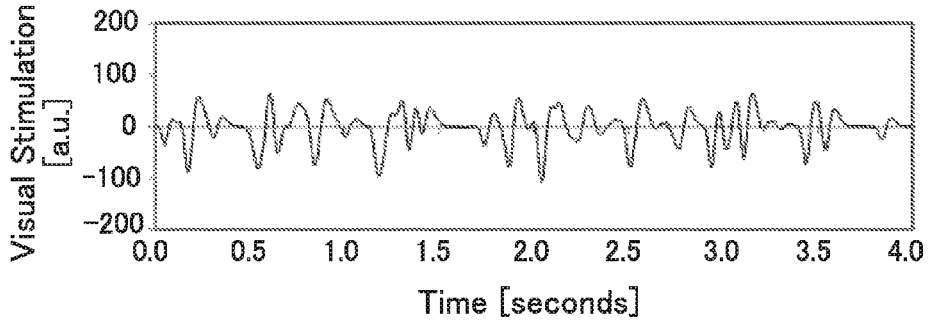
Figure 31C:
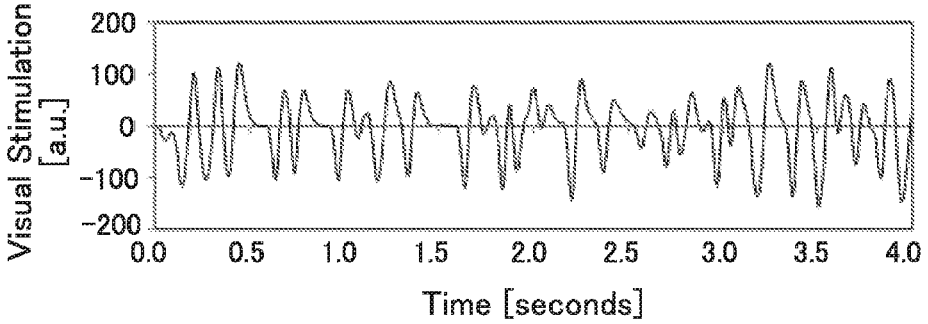

FIGS. 31A to 31C show the calculation results of changes in visual stimulation based on the luminance changes shown in FIGS. 30A to 30C. The calculation was performed using the Barten model, which agrees well with results of previous sensitivity evaluation. The Barten model is expressed by the following equation (1).

[Formula 1]

$$S(u, w) = \frac{\left(\frac{M_{opt}(u)}{k}\right)}{\sqrt{\frac{2}{T}\left(\frac{1}{X_0^2} + \frac{1}{X_{max}^2} + \frac{u^2}{N_{max}^2}\right)\left(\frac{1}{\eta p E} + \frac{\Phi_0}{[H_1(w)\{1 - H_2(w)F(u)\}]^2}\right)}} \tag{1}$$

In the equation, u and w are a parameter of the frequency of spatial modulation and a parameter of the frequency of temporal modulation, respectively. In addition, k represents a signal-noise ratio, T represents visual integration time, $X_0$ represents the size of an object, $X_{max}$ represents the upper limit of integration, $N_{max}$ represents the maximum number of integration cycles of bright and dark, η represents quantum efficiency, p represents a quantum conversion factor, E represents retinal illuminance, and $\Phi_0$ represents the spectral density of neural noise.

In the equation (1), $M_{opt}(u)$ represents a visual transfer function relating to spatial luminance modulation and is expressed by the following equation (2). In the equation (2), σ depends on the pupil diameter as a parameter and corresponds to the standard deviation of a line-spread function, where the structures of visual organs such as the ocular media and the retina are taken into consideration.

[Formula 2]

$$M_{opt}(u) = e^{-2\pi^2\sigma^2u^2} \tag{2}$$

In the equation (1), $H_1(w)$ and $H_2(w)$ each represent a transfer function relating to temporal modulation and are expressed by the following equation (3), where τ represents a time constant. The solution of the equation (1) agrees with the results of sensitivity evaluation in the case where 7 and 4 are substituted for n in $H_1(w)$ and $H_2(w)$, respectively.

[Formula 3]

$$H(w) = \frac{1}{\{1 + (2\pi w\tau)^2\}^{n/2}} \tag{3}$$

In addition, F(u) in the equation (1) represents a function of lateral inhibition and is expressed by the following equation (4). In the equation (4), $u_0$ represents the spatial frequency of lateral inhibition.

[Formula 4]

$$F(u) = 1 - \sqrt{1 - e^{-(u/u_0)^2}} \quad (4)$$

FIG. 31A shows the calculation result of the change in visual stimulation based on the luminance change shown in FIG. 30A, which was obtained by the Barten model.

FIG. 31B shows the calculation result of the change in visual stimulation based on the luminance change shown in FIG. 30B, which was obtained by the Barten model.

FIG. 31C shows the calculation result of the change in visual stimulation based on the luminance change shown in FIG. 30C, which was obtained by the Barten model.

Figure 32A:
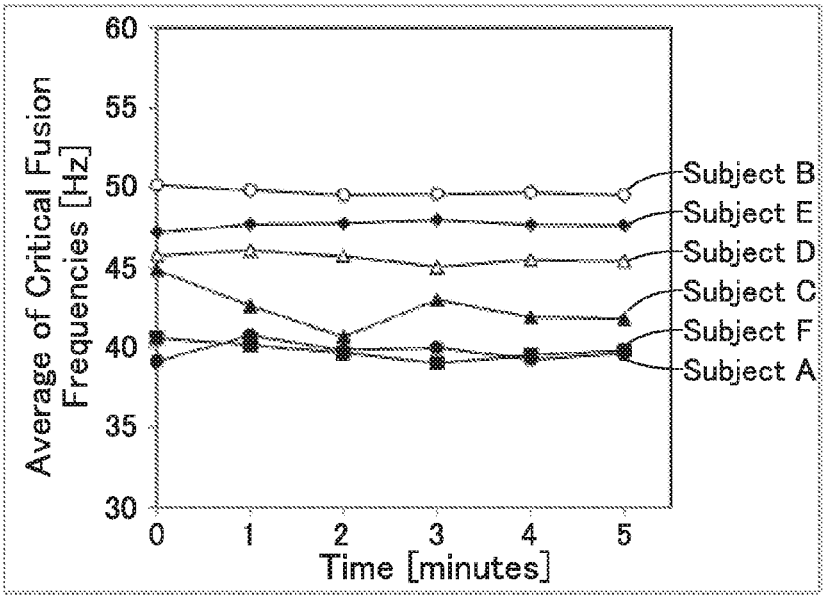
FIGS. 32A and 32B show changes in critical flicker (fusion) frequency of subjects described in Example.
Figure 32B:
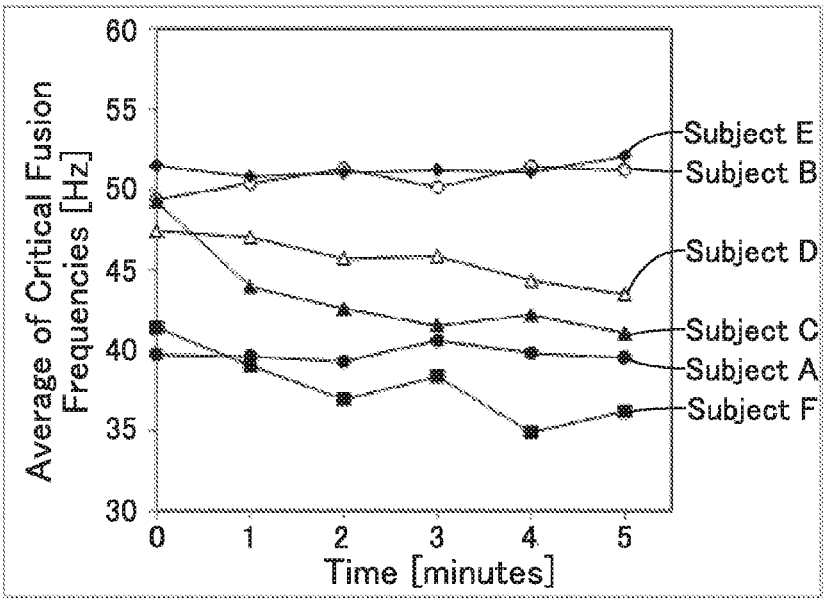

FIGS. 32A and 32B show the measurement results of the critical fusion frequencies (CFF) of six subjects who observed the text images of FIGS. 30A to 30C. Specifically, the text image was observed for a minute while being scrolled, and then, the CFF was measured ten times, and the measurement values were averaged. This process was repeated five times, and added time was counted as time of stressing.

FIG. 32A shows the measurement results of the CFFs of the six subjects who observed the text image of FIG. 30B.

FIG. 32B shows the measurement results of the CFFs of the six subjects who observed the text image of FIG. 30C.

Note that for the measurement, AQUOS PAD SH-06F produced by Sharp Corporation was used. The screen diagonal of the display panel was 7.0 inches, the pixel density was 323 ppi, and each pixel includes a VA-mode liquid crystal element and a transistor including an oxide semiconductor.

For the CFF measurement, a Roken-type digital flicker value tester, model RDF-1, produced by SIBATA SCIENTIFIC TECHNOLOGY LTD. was used.

<Result>

When compared in the same period, a luminance change at a low scroll speed (FIG. 30A and FIG. 31A) was smaller than that at a high scroll speed (FIG. 30C and FIG. 31C); accordingly, visual stimulation was suppressed when the scroll speed was low.

Comparison between luminance changes at a high scroll speed in the same period (FIGS. 30B and 30C and FIGS. 31B and 31C) showed that a luminance change in the text image displaying letters with a high gray level (i.e., the contrast was low) (FIG. 30B and FIG. 31B) was smaller, and thus, visual stimulation was suppressed.

In addition, decreases in the CFFs of the subjects who repeatedly observed the text image scrolled at a high speed were suppressed when the letters in the text image were displayed with a high gray level (i.e., when the contrast was low) (see FIGS. 32A and 32B).

Therefore, eye strain on the subject accumulated by high-speed scrolling can be reduced by displaying letters with a high gray level (i.e., displaying a low-contrast text image).

Specifically, when the letters with a high gray level (i.e., the low-contrast text image) were displayed, no decrease was observed in the CFFs of the subjects (see FIG. 32A).

On the other hand, when the gray level of the letters in the text image was not changed (i.e., the contrast was high), the CFFs of the subject A, the subject C, the subject D, and the subject F were decreased (see FIG. 32B).

This application is based on Japanese Patent Application serial no. 2015-040985 filed with Japan Patent Office on Mar. 3, 2015, and Japanese Patent Application serial no. 2015-040987 filed with Japan Patent Office on Mar. 3, 2015, the entire contents of which are hereby incorporated by reference.

What is claimed is:

1. A semiconductor device comprising:

a pixel portion configured to display image information in a first mode and a second mode;

an input portion configured to sense an input by a user; and a light supply portion configured to emit light to the pixel portion with first luminance in the first mode and with second luminance in the second mode, wherein one of the first mode and the second mode is selected when an event is supplied to the input portion, in accordance with a contrast of the image information and a proportion of an area of a dark portion in the image information, wherein, in the first mode, a contrast of image information to be displayed next is lower than the contrast of the image information displayed before supplying the event, and wherein, in the second mode, the image information is displayed while keeping the contrast of the image information.

2. The semiconductor device according to claim 1, wherein the event is one of swipe, drag, scroll, and page-turning.

3. The semiconductor device according to claim 1, wherein the pixel portion comprises a liquid crystal element.

4. The semiconductor device according to claim 1, wherein the pixel portion comprises a plurality of pixels, wherein each of the plurality of pixels comprises a transistor, and wherein a semiconductor layer of the transistor where a channel is formed comprises an oxide semiconductor.

5. The semiconductor device according to claim 1, wherein the pixel portion comprises a plurality of pixels, wherein each of the plurality of pixels comprises a transistor, and wherein a semiconductor layer of the transistor where a channel is formed comprises amorphous silicon or polycrystalline silicon.

6. The semiconductor device according to claim 1, wherein the input portion comprises at least one of a keyboard, a hardware button, a pointing device, a touch sensor, an imaging device, an audio input device, a viewpoint input device, and a pose detection device.

7. The semiconductor device according to claim 1, wherein the pixel portion and the input portion form a touch panel.

8. The semiconductor device according to claim 1, wherein, in the first mode, the contrast of the image information is decreased in synchronization with a speed of the event.

9. The semiconductor device according to claim 1, wherein the light supply portion includes a timing controller, a luminance adjustment circuit, a driver, and a light-emitting portion.

10. A semiconductor device comprising:

a pixel portion configured to display image information;

an input portion, a light supply portion configured to emit light to the pixel portion; and an arithmetic device configured to supply a control signal to the light supply portion and an image signal for displaying the image information in the pixel portion, wherein a mode for displaying the image information is switched to a first mode or a second mode when an event is supplied to the input portion, wherein the light supply portion is configured to emit the light with first luminance in the first mode and with second luminance in the second mode, wherein the first mode is selected depending on the control signal when a proportion of an area of a dark portion in image information to be displayed next is 30% or more and the second mode is selected depending on the control signal when the proportion of the area of the dark portion in the image information to be displayed next is less than 30%, wherein, in the first mode, a contrast of the image information to be displayed next is lower than the contrast of the image information displayed before supplying the event, and wherein, in the second mode, the image information is displayed while keeping the contrast of the image information.

11. The semiconductor device according to claim 10, wherein the pixel portion comprises a liquid crystal element.

12. The semiconductor device according to claim 10, wherein the pixel portion comprises a plurality of pixels, wherein each of the plurality of pixels comprises a transistor, and wherein a semiconductor layer of the transistor where a channel is formed comprises an oxide semiconductor.

13. The semiconductor device according to claim 10, wherein the pixel portion comprises a plurality of pixels, wherein each of the plurality of pixels comprises a transistor, and wherein a semiconductor layer of the transistor where a channel is formed comprises amorphous silicon or polycrystalline silicon.

14. The semiconductor device according to claim 10, wherein the pixel portion functions as a touch panel.

15. The semiconductor device according to claim 10, wherein the event is one of swipe, drag, scroll, and page-turning.

16. The semiconductor device according to claim 10, wherein, in the first mode, the contrast of the image information is decreased in synchronization with a speed of the event.

17. The semiconductor device according to claim 10, wherein the light supply portion includes a timing controller, a luminance adjustment circuit, a driver, and a light-emitting portion.

18. A semiconductor device comprising:

a pixel portion configured to display image information;

an input portion, a light supply portion configured to emit light to the pixel portion; and an arithmetic device configured to supply a control signal to the light supply portion and an image signal for displaying the image information in the pixel portion, wherein a mode for displaying the image information is switched to a first mode or a second mode when an event is supplied to the input portion, wherein the light supply portion is configured to emit the light with first luminance in the first mode and with second luminance in the second mode, wherein the first mode is selected depending on the control signal when a contrast of image information to be displayed next exceeds a predetermined value and the second mode is selected depending on the control signal when the contrast of the image information to be displayed next does not exceed the predetermined value, wherein, in the first mode, a contrast of the image information to be displayed next is lower than the contrast of the image information displayed before supplying the event, and wherein, in the second mode, the image information is displayed while keeping the contrast of the image information.

19. The semiconductor device according to claim 18, wherein the pixel portion comprises a liquid crystal element.

20. The semiconductor device according to claim 18, wherein the pixel portion comprises a plurality of pixels, wherein each of the plurality of pixels comprises a transistor, and wherein a semiconductor layer of the transistor where a channel is formed comprises an oxide semiconductor.

21. The semiconductor device according to claim 18, wherein the pixel portion comprises a plurality of pixels, wherein each of the plurality of pixels comprises a transistor, and wherein a semiconductor layer of the transistor where a channel is formed comprises amorphous silicon or polycrystalline silicon.

22. The semiconductor device according to claim 18, wherein the pixel portion functions as a touch panel.

23. The semiconductor device according to claim 18, wherein the event is one of swipe, drag, scroll, and page-turning.

24. The semiconductor device according to claim 18, wherein, in the first mode, the contrast of the image information is decreased in synchronization with a speed of the event.

25. The semiconductor device according to claim 18, wherein the light supply portion includes a timing controller, a luminance adjustment circuit, a driver, and a light-emitting portion.

* * * * *